US012745826B2

(12) United States Patent
Jones

(10) Patent No.: US 12,745,826 B2
(45) Date of Patent: Sep. 29, 2026

(54) SUNSHIELD WITH UV ABSORBERS, SOLAR POWERED COMPONENTS, AND MISTING TECHNOLOGIES

(71) Applicant: Michael Jones, South Glens Falls, NY (US)

(72) Inventor: Michael Jones, South Glens Falls, NY (US)

( * ) Notice: Subject to any disclaimer, the term of this patent is extended or adjusted under 35 U.S.C. 154(b) by 117 days.

(21) Appl. No.: 18/433,396

(22) Filed: Feb. 5, 2024

(65) Prior Publication Data

US 2025/0248493 A1 Aug. 7, 2025

Related U.S. Application Data

(60) Provisional application No. 63/475,677, filed on Dec. 5, 2022.

(51) Int. Cl.

| | |
|---|---|
| ***A45B 23/00*** | (2006.01) |
| ***A47C 7/66*** | (2006.01) |
| ***A47C 7/74*** | (2006.01) |

(52) U.S. Cl.

CPC ..... *A45B 23/00* (2013.01); *A47C 7/66* (2013.01); *A47C 7/744* (2013.01); *A45B 2023/0006* (2013.01); *A45B 2023/0031* (2013.01); *A45B 2023/0093* (2013.01); *A45B 2200/1018* (2013.01); *A45B 2200/1027* (2013.01); *A45B 2200/1036* (2013.01); *A45B 2200/1045* (2013.01); *A45B 2200/1054* (2013.01)

(58) Field of Classification Search

CPC .... A45B 2200/1018; A45B 2200/1027; A45B 2200/1036; A45B 2200/1045; A45B 2200/1054; A47C 7/66; A47C 7/744

USPC ..... 297/184.1, 184.11, 184.14, 184.15, 217, 297/217.3; 5/418

See application file for complete search history.

(56) References Cited

U.S. PATENT DOCUMENTS 614,364 A * 11/1898 Burnham ..... A45B 11/00 135/90
2,618,285 A * 11/1952 Heisig ..... A45B 11/00 403/109.5

(Continued)

FOREIGN PATENT DOCUMENTS

WO 2021/016656 * 2/2021 ..... A47C 7/666

*Primary Examiner* — Robert Canfield

(74) *Attorney, Agent, or Firm* — Edison Law Group, PLLC

(57) ABSTRACT

The sunshade/shield structure invention is practical, portable, and effective in skin care protection and prevention of skin cancer. It can be made as a commercial use product with less portability features or a residential/consumer model which is portable and can be disassembled and reassembled quickly via pins and or shock cords like camping hike tents. Its aerodynamic design is wind resistant and porous so water during a storm won't pool and stress the frame. It can be made of metal materials that are powder coated or high-impact absorbing, UV-protected plastics. The ground frame/base can be extended in length or width for custom chair fitting and stability because the frame sleeves in and out. A sand or ground anchor can be used in the yard or on the beach instead of the ground stand. The leg post interfaces with both ground and sand anchor bases. The ground frame will have two roller wheels so moving will be easy. Tip the shade back and touch the wheels to the hard surface for easy relocating.

24 Claims, 66 Drawing Sheets

(56) References Cited

U.S. PATENT DOCUMENTS 4,300,798 A * 11/1981 Musgrove ..... A47C 7/66 297/162
4,781,411 A * 11/1988 Kolb ..... B63B 17/02 248/397
5,096,257 A * 3/1992 Clark ..... A47C 1/143 135/96
5,320,405 A 6/1994 Foster
5,441,067 A * 8/1995 James ..... A47C 7/66 135/96
5,579,797 A * 12/1996 Rogers ..... A45B 23/00 135/96
5,593,205 A * 1/1997 Vanderminden, Sr. .. A47C 7/66 24/339
5,638,849 A * 6/1997 Scott ..... A47C 7/66 297/188.05
5,823,617 A 10/1998 Schafer
5,979,793 A * 11/1999 Louis ..... F24F 5/0035 239/289
6,298,866 B1 * 10/2001 Molnar, IV ..... A45B 23/00 108/50.13
6,682,000 B1 * 1/2004 Apple ..... A45B 25/00 239/289
7,347,217 B2 * 3/2008 Bree ..... A45B 23/00 135/117
8,479,756 B1 * 7/2013 Tieskotter ..... B62J 17/08 135/88.03
9,289,039 B2 3/2016 Akin
9,375,547 B2 * 6/2016 Augustine ..... A61M 16/06
10,051,931 B2 * 8/2018 Zadie ..... F24S 25/00
2005/0161067 A1 * 7/2005 Hollins ..... A45B 23/00 135/16
2005/0164627 A1 * 7/2005 Boone, Jr. ..... A45B 3/00 454/338
2005/0172987 A1 * 8/2005 Byrnes ..... A45B 3/00 135/33.5
2011/0193372 A1 8/2011 Pizzuto
2014/0265462 A1 * 9/2014 Fleming ..... A47C 1/143 297/180.14
2015/0282627 A1 10/2015 Gjelaj
2018/0049523 A1 * 2/2018 Zadie ..... E04H 12/22
2019/0283843 A1 * 9/2019 Greer ..... B63J 99/00
2022/0265052 A1 8/2022 Christopher
2024/0011317 A1 * 1/2024 Green ..... E04H 15/58
2025/0375037 A1 * 12/2025 Clemons ..... A47C 1/14

* cited by examiner

SUNSHIELD WITH UV ABSORBERS, SOLAR POWERED COMPONENTS, AND MISTING TECHNOLOGIES

RELATED APPLICATIONS

This application claims benefit to provisional application U.S. 63/475,677 filed Dec. 5, 2022 and is incorporated in its entirety.

BACKGROUND OF THE INVENTION

Conventional umbrellas require lots of surrounding space for you to capitalize on the shadow/shade. Oftentimes, they can't be adjusted enough to block the sun's constant movement and force you to chase the shadow. Body Lenz did, now called The UV Oasis does it better. What has been called "The ultimate sunshade" by users worldwide was introduced. Test studies supporting these facts are cited on the website, www.theuvoasis.com.

Most conventional shade styles, then and now have limited capabilities because of the design. In most cases, even when intended to be used by one seated/lounging, conventional design is known to be ineffective most of the time. Case-in-point, when the sun is low (early morning or late afternoon) you can't adjust is low enough to block your sun exposure so often you're forced to sit a long way from the umbrella. Totally unacceptable. Think about 9 am or 4 pm+lounging by the pool.

It provides the users young and old a way to prevent damage to their skin and possible skin cancer. Conventional umbrellas whether tilted on the pole, cantilever design, or by physically moving the entire umbrella or your position physically chasing the shade the sun, is often impractical if not impossible because of the users' physical limitations, umbrellas bulky design and or your surroundings. Furniture, walls, shrubbery, deck rails, often stop users' ability to move the seating or umbrella get in the shade.

All users, especially those mentioned, can't effectively control their sun exposure without major physically relocating their seating position or major repositioning needed with conventional umbrella. Often physically relocating either seating or the unwieldy umbrella can't be accomplished because of its weight, height, existing walls, shrubs, tables, or others seated near them. Use on smaller apartment/condos decks or patios, hotel decks/patios are limiting factors with conventional umbrellas. Overhead ceilings/deck/patios, structures and limited floor space stop many users of conventional umbrellas.

SUMMARY OF THE INVENTION

The invention creates a way for individuals of all races, nationalities, and physical abilities to create a shaded, cooler, easily used means of enjoying the sun safer. It does that by its unique way of adjusting in multiple ways block the suns UV rays which can be cancer causing. Seniors, physically less abled and children are examples of users will welcome our user-friendly product. It is usable on hard surfaces, decks, lawns, and sandy/dirt surfaces in ways conventional umbrellas can't. It makes laying or sitting outside in a safer, healthier ways by blocking or limiting users direct UV rays which can cause skin cancer, more enjoyable.

This invention not only address your safety and comfort level in a stylish, but dermatologist also approved, and lab tested method with structural and designs and technologies that enhance the user's protection, comforts, and enjoyment.

User creature comfort features that we expect today were incorporated. They include adjustable/extending ground frame length and widths to accommodate different positions of the sun to effectively cover its users, furniture sizes and overall stability when needed. A second overlaying shield attaches to the primary shield to increase the UV protection turns a tanning shield (more porous fabric) to a blocking shield without disassembly and replacing the entire installed primary shield material. Combined with solar energy distribution and connections, misting/fogging for evaporative cooling, integrated fan/blower devices, removeable insect netting, wireless networking (e.g., Wi-Fi®) and wireless technology to exchange data over short distances using short-wavelength UHF radio waves (e.g., Bluetooth®) connectivity/distribution, audio speakers, lockable storage, adjustable light color LED lighting for evening, ambience use with a insect repelling color choice, shelf for drinks and personal items access, wheels on the ground frame for easy moving, locking storage for personal items is also incorporated in the utility box. There you will also find controlled access to the solar powered devices (water pump, removeable water container for fogging/misting and solar components control network).

The device is designed to be practical in its method of use. The user can adjust the shield forward, backwards, left, right and up or down in seconds blocking or filtering the suns UV rays. It gives the user a much more practical means of control versus conventional umbrella for full or partial body coverage. As stated, conventional umbrellas force their users to constantly move the umbrella or sitting location to gain shade/blockage of the sun. This invention drastically reduces this flawed design.

It's portable by design or semi portable models address two different end user's environment and needs. The structural frames may be made of high impact, lightweight, UV protected plastic or power coated metal. Portability is possible (shock cord and/or pinned frame structural joints allow disassembly for portability) or for usage in more permanent, in lesser relocating applications such as at some home, or commercial setting like hotels or resort pool areas, less disassembly is suggested. Both provide the same shade/UV control via the chosen shade/shield. Material and physical shield/shade positioning thumbscrews. Controlled sun exposure is possible by the user adjusting the shield and choosing which overhead sunshields to use, choose either a shade material with open weave or maximum shade capabilities by choosing a filtering film or closed weave material or my doubling up of the filtering shield feature which is overlaid on primary shield. The amount of the users UV A & B exposure allows those seeking a tan a controllable method (slower, less sun intensity) at the same time a cooler, less skin damaging environment of doing so or no exposure and cooler environment by using a more absorbing, closed weave shield previously mentioned.

According to an embodiment of this invention, a product, sunshade/shield structure, helps prevent skin damage leading to skin cancer while providing it's solo user optimal shade. The most effective, easiest to adjust in relation to the sun's position, practical and stylish yet strongest sunshade ever has been created. Using superior UV materials, redesigns and forward thinking features such as solar collecting cooling devices like, forced air wireless connectivity, micro-LED lighting, lockable storage, plus some indirect UV protection via netting which surrounds the sunshade/shield structure that stops insects too. Meaning you can enjoy the same seating at night without the bugs. It is durable yet portable.

This invention's product physically provides limited or total blockage/shade from the suns direct UV rays while around the pool, on the beach, patio, lawn, or deck often not possible with conventional umbrellas. The product by its design will help prevent sunburns and skin cancer by limiting the amount of UV exposure and increase the comforts being sought by its users in a controllable shading way. It not only works effortlessly by adults but also seniors and children. Conventional umbrellas as we know them do not offer ease of use or effective block the sun when it moves across the sky. This invention does. We've all seen how the umbrellas of yesteryear and today can't block the sun most of the day unless it's moved with great effort a great distance from the user. That is not the case of this invention. It's provided coverage is always within reach while sitting or reclining by design. Seniors and children benefit immediately with a turn of the strategically position/controlling frame or shield thumbscrews.

By design, our shade/shield solves that problem by means of its unique design adjustment features. Whether the sun is overhead, left or right of the users sitting or lounge chair, in front of or behind them, the shield can be adjusted to help control your sun exposure. All umbrellas/shades are affected by seasonal location/movement of the sun, my invention takes this problem in consideration and by design enhancing the user's ability to be in the shade more effectively and with much less effort.

Its users need a sunshield which helps prevent UV related health issues around the pool, on the patio, beach or lawn. It shades allows the wind to blow over, under, and through the UV blocking porous shade material while filtering or blocking sun's direct rays and when needed, allows water to run through it when it rains. The reason, concept, needs, features, and materials chosen are perfect. Our redesign is easy to adjust and follows the sun without leaving your upright or lounge chair. It's easily assembled and disassembled when needed. All these features work well together to block or limit the user's direct UV exposure and heat related health issues.

DETAILED DESCRIPTION OF THE INVENTION

Figure 1:
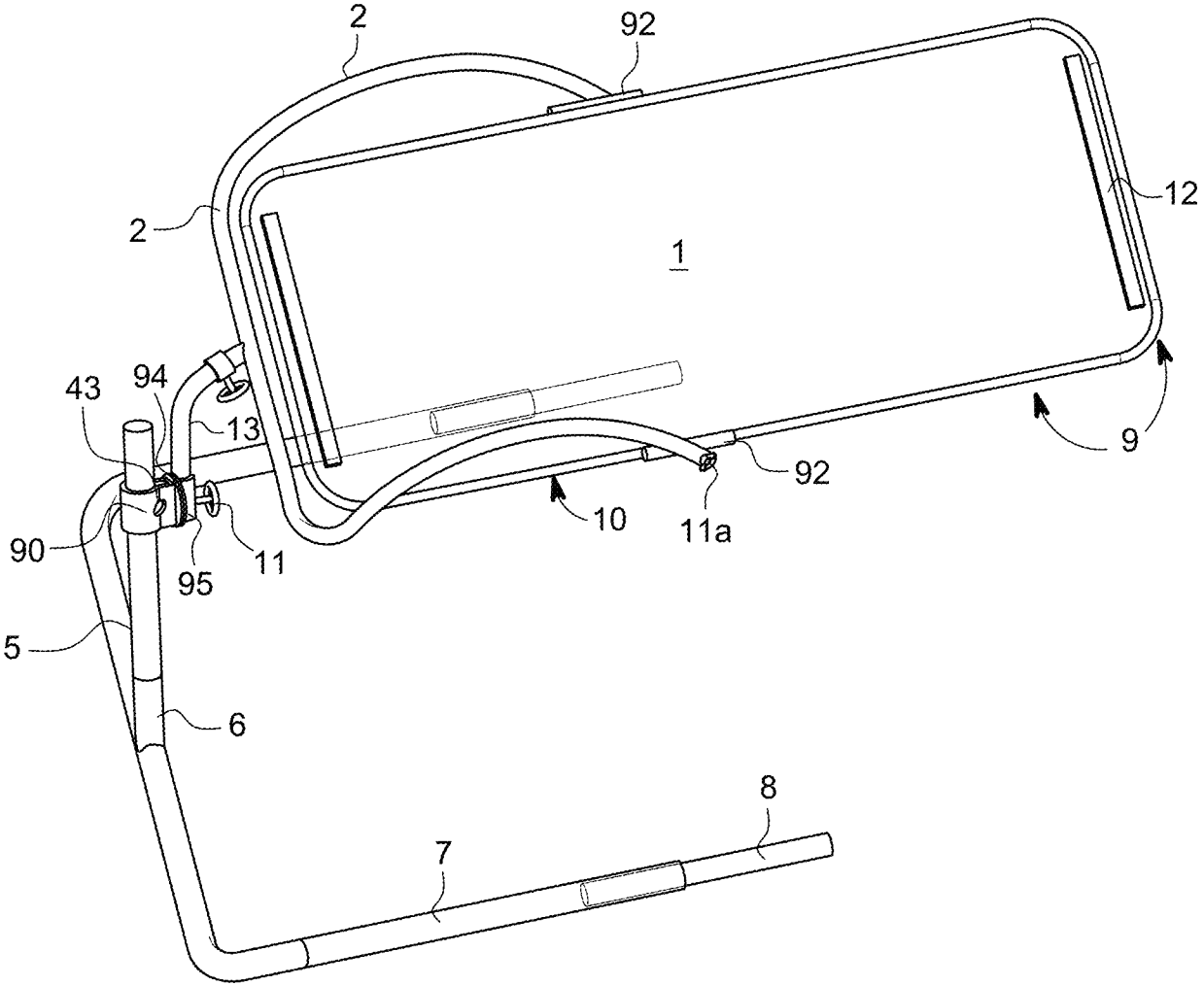
FIG. 1 is a schematic of part of a sunshade/shield embodiment shown in a perspective view.

A more complete appreciation of this disclosure and many of the attendant advantages thereof will be readily obtained as the same becomes better understood by reference to the following detailed description when considered in connection with the accompanying drawings, wherein:

FIG. 1 illustrates a sunshade/shield 1 of film or mesh fabric with left and right shade frame front 9 and left and right shade frame rear 10 and has a hook and loop shade 12 tension at the rear of the shade and the front of the shade to bend the shade down on either end of the shade. Part 92 is welded to rear frame 10 and front frame 9 slides into part 92 and yoke 2 attaches to 92 via thumbscrew 11*a*. Also included is a yoke 2, disposed up above the sunshade/shield 1, framing and connecting to the sunshade/shield 1 via a quick release or a thumbscrew 11. The yoke 2 is also attached to an expandable ground frame 7/8 via a gooseneck 13 with a thumbscrew or quick-release levers 11 tilt adjuster/leg height/gooseneck rotator 90/94/95 connected to a leg 5 with an internal sleeve which is also connected to leg post 6 which connects to ground frame 7/8, a ground frame 7 that stretches out over the ground in a rectangular shape including an inner sleeve 8 telescoping ground frame 7. The tilt adjuster/leg height/gooseneck rotator 90/94/95 is available to raise, lower or tilt the sunshade/shield 1 one way or another. This tilt adjuster/leg height/gooseneck rotator 90/94/95 is very effective during the early morning or late in the afternoon sunshine when the sun is lower in the sky, the sunshade/shield 1 can be maneuvered to keep the sun at bay.

Figure 2:
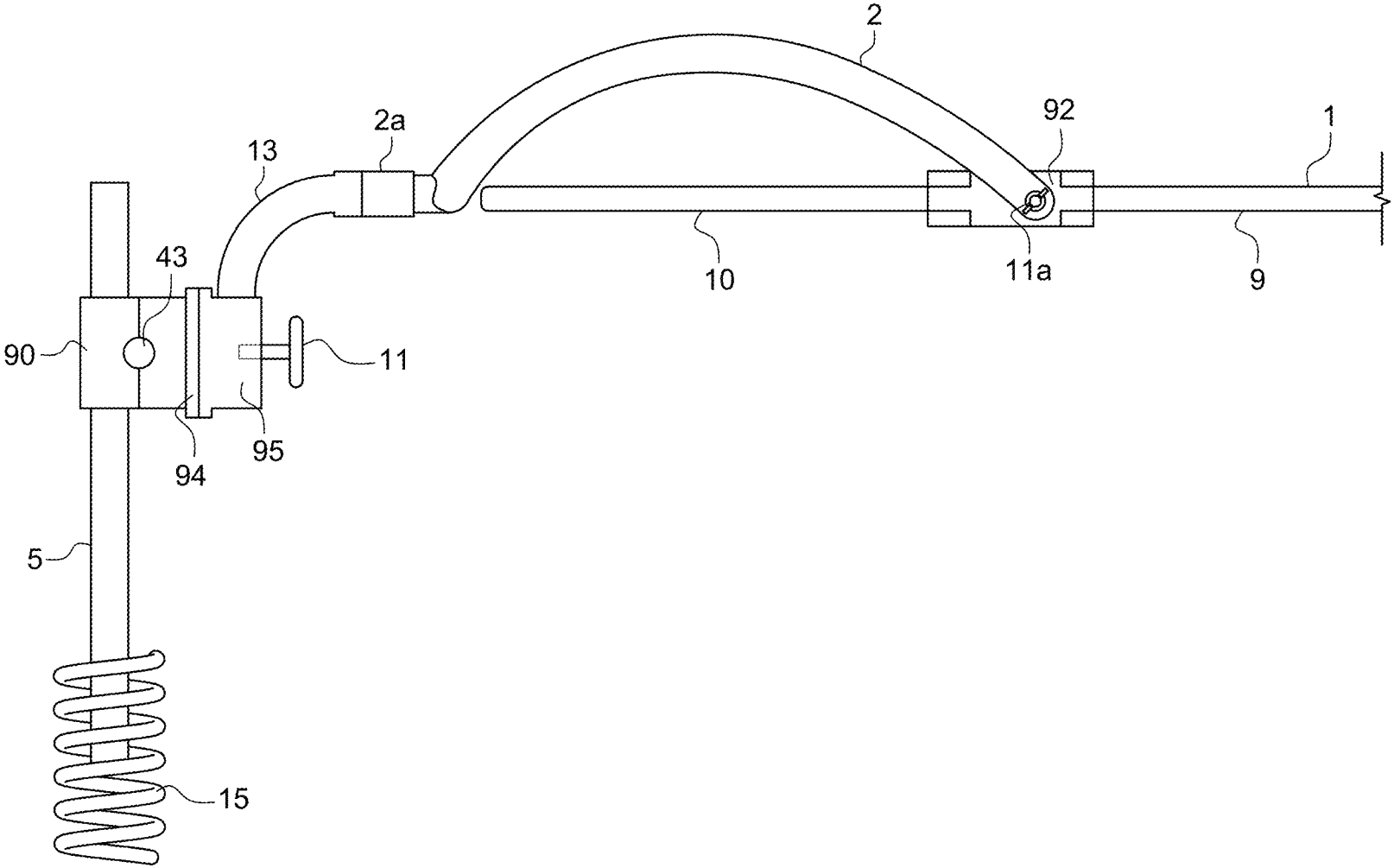
FIG. 2 is a schematic of part of a sunshade/shield embodiment shown in a side view.

FIG. 2 illustrates a side view of the sunshade/shield 1 where the left side of the yoke 2 punches through an opening in the left shade frame 9 via a quick release or a thumbscrew 11 and the gooseneck 13 is connected to the leg 5 with internal sleeve with a quick release/thumbscrew tilt adjuster/leg height/gooseneck rotator 90/94/95 and is also connected to the yoke 2 with a thumbscrew or quick-release lever 11. The leg, part 5 with an internal sleeve can also be used with our sand anchor 15 instead of the ground frame 7.

Figure 3A:
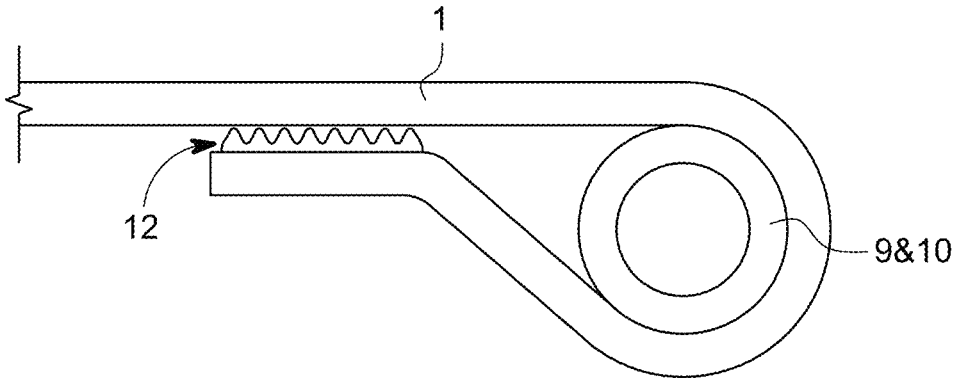
FIG. 3A is a schematic of a cross-section of a hook and loop shade tension embodiment.

FIG. 3*a* illustrates a cross-sectional view of the hook and loop shade tension 12 located in the front and rear of the sunshade/shield 1, where the shade rolls over both the right and left shade frame 9 (FIG. 5 #17) and attaches to the underside of the sunshade/shield 1 with hook and loop fasteners 12.

Figure 3B:
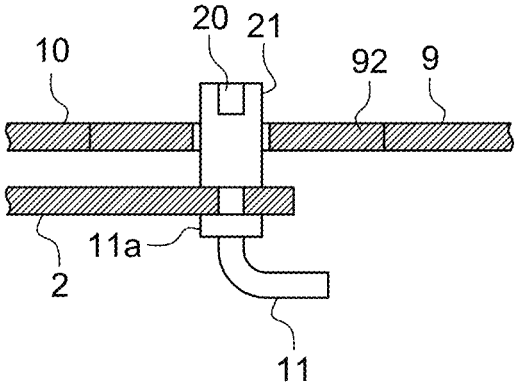
FIG. 3B is a schematic of a cross-section of a thumbscrew/quick release embodiment.

FIG. 3*b* illustrates a cross-sectional view of the thumbscrew/quick release 11 located on the left yoke arm 2 showing the connection of the left yoke arm 2 to the left shade frame 9. Left shade frame 9 slides into rear shade frame sleeve 92.

Figure 3C:
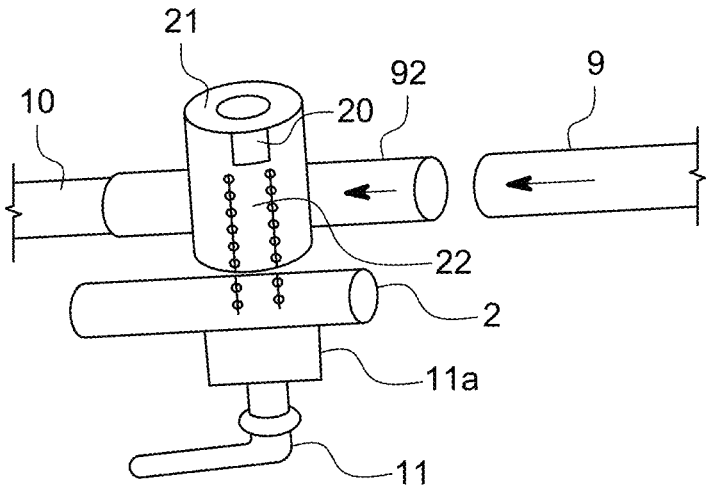
FIG. 3C is a schematic of a cross-section of a thumbscrew/quick release embodiment.

FIG. 3*c* illustrates a cross-sectional view of the thumbscrew/quick release 11 which connects rear shade frame 10 with front shade frame 9 via rear shade frame sleeve 92, and connects yoke 2. The thumb screw 11, is shown in detail where there is threaded insert 21 and thumbscrew/quick release thread 22 for the thumbscrew 11 to screw into.

Figure 4:
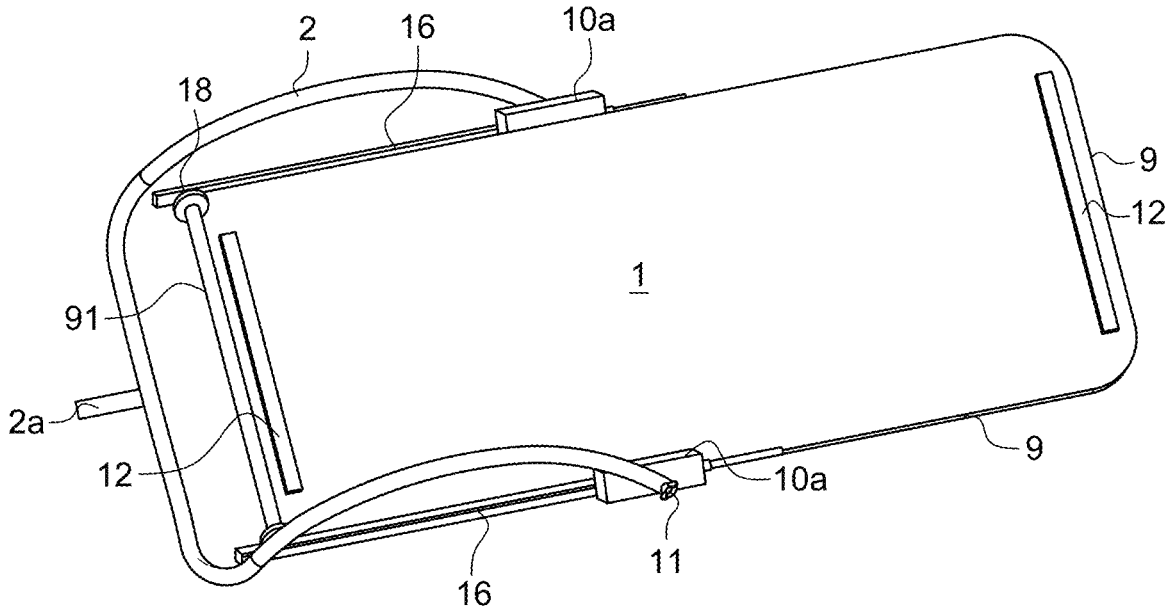
FIG. 4 is a schematic of a portion of a sunshade/shield embodiment shown in a perspective view.

FIG. 4 illustrates only the shade portion of the sunshade/shield 1 highlighting the roller component 18 of the rolling shade tube 91.

Figure 5:
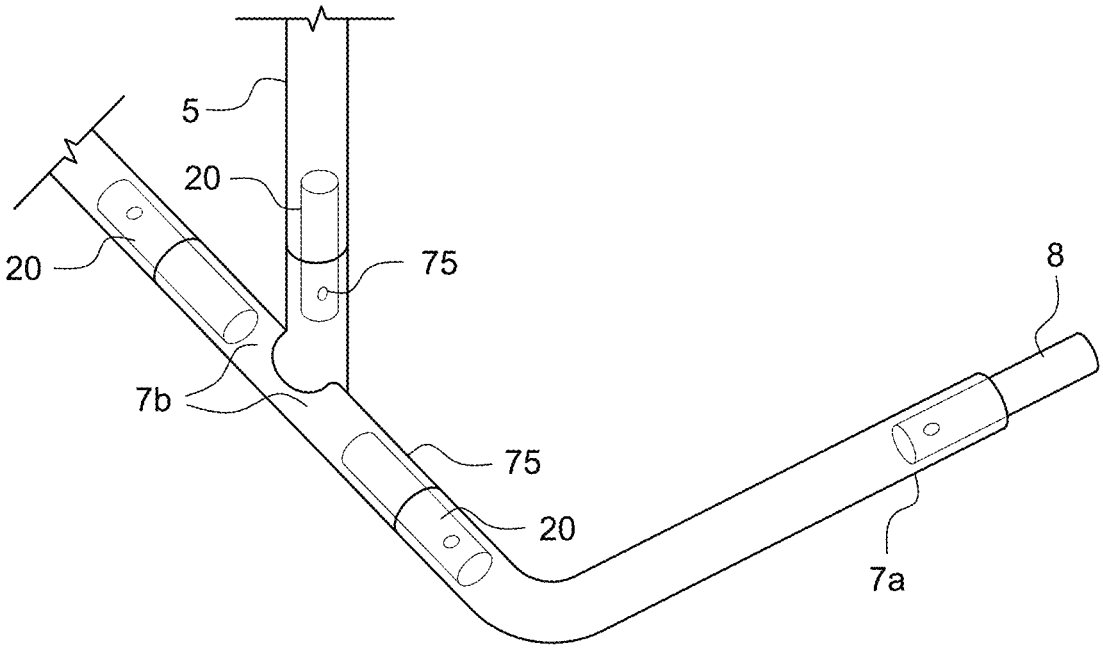
FIG. 5 is a schematic of a portion of a ground frame embodiment shown in a perspective view.

FIG. 5 illustrates the ground frame 7 with pin-button connectors 20 to widen the ground frame 7. Also shown is how the leg post 6 has an internal sleeve and connects with the ground frame 7 at a 90 angle.

Figure 6:
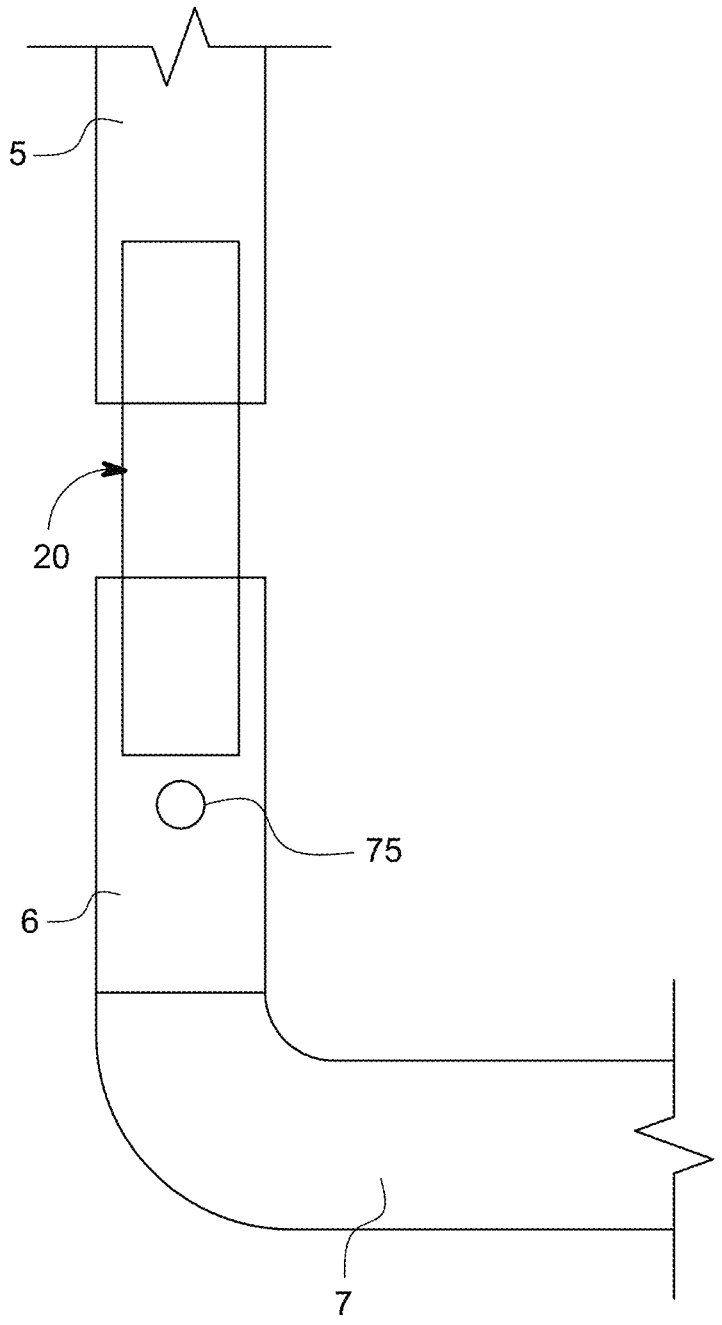
FIG. 6 is a schematic of a cross-section of an internal sleeve embodiment.

FIG. 6 illustrates the shade of FIG. 1, internal sleeve 20 to connect the legs of the ground frame 7 by a push pin in hole 75.

Figure 7:
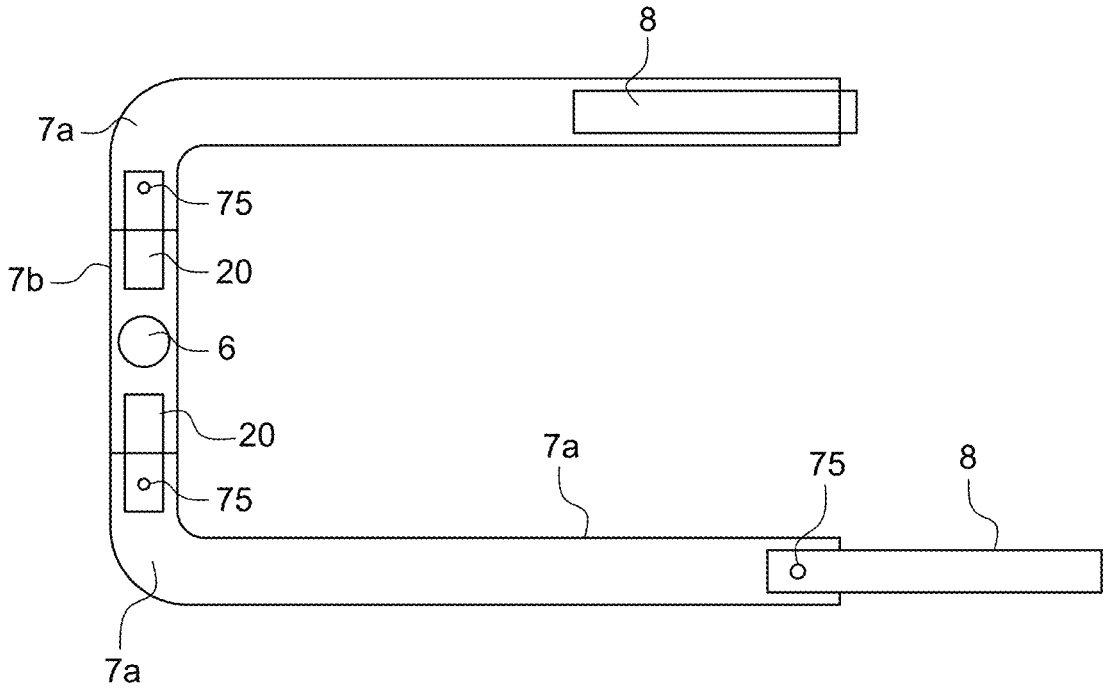
FIG. 7 is a schematic of an embodiment a ground frame embodiment shown from a top view.

FIG. 7 illustrates the sunshade/shield of FIG. 1 detailing the ability to disassemble the ground frame or expand its width 7 and the ground frame length 8, increasing the ground frame's stability.

Figure 8:
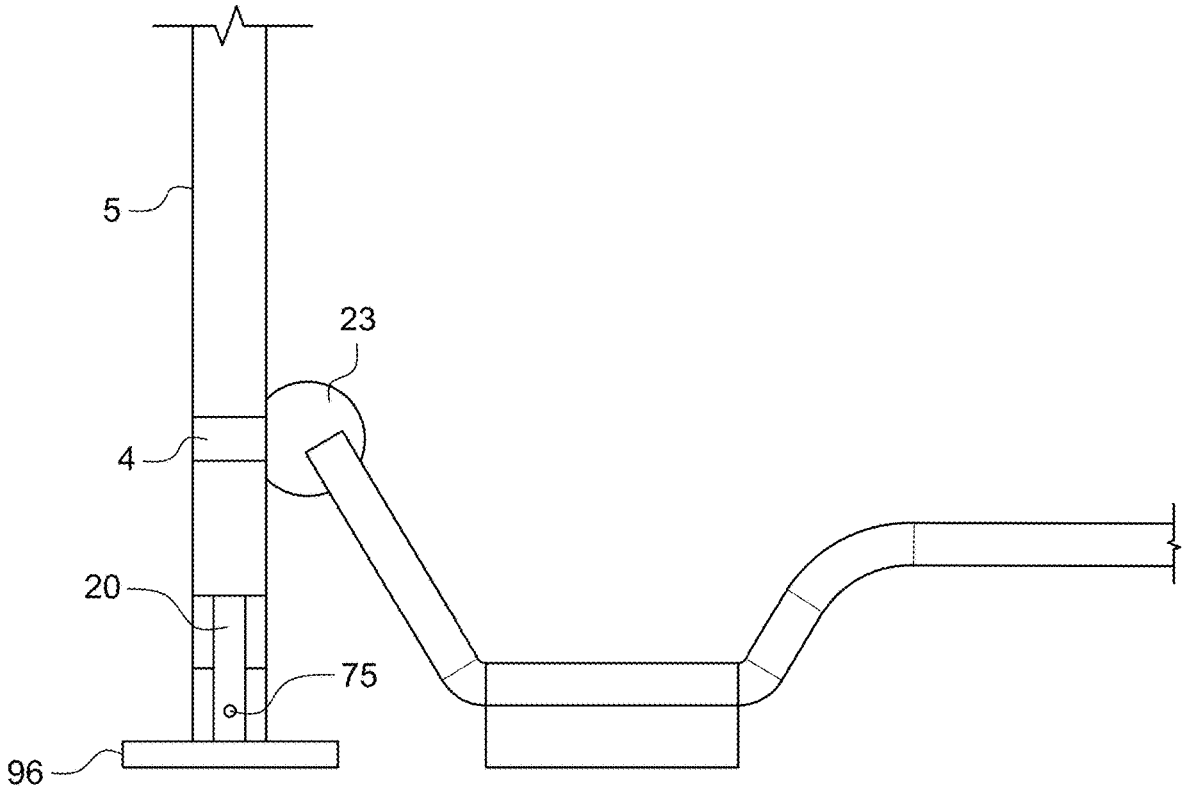
FIG. 8 is a schematic of an embodiment of a sunshade/shield attached to a chair.

FIG. 8 illustrates a model-specific sunshade/shield of FIG. 1, with leg 5 which is attached to a chair frame version with leg chair collar 4 on leg 5, connected to a c-clamp 23 on the chair. A thumbscrew 11 connects the leg chair collar 4 to the chair c-clamp 23.

Figure 8A:
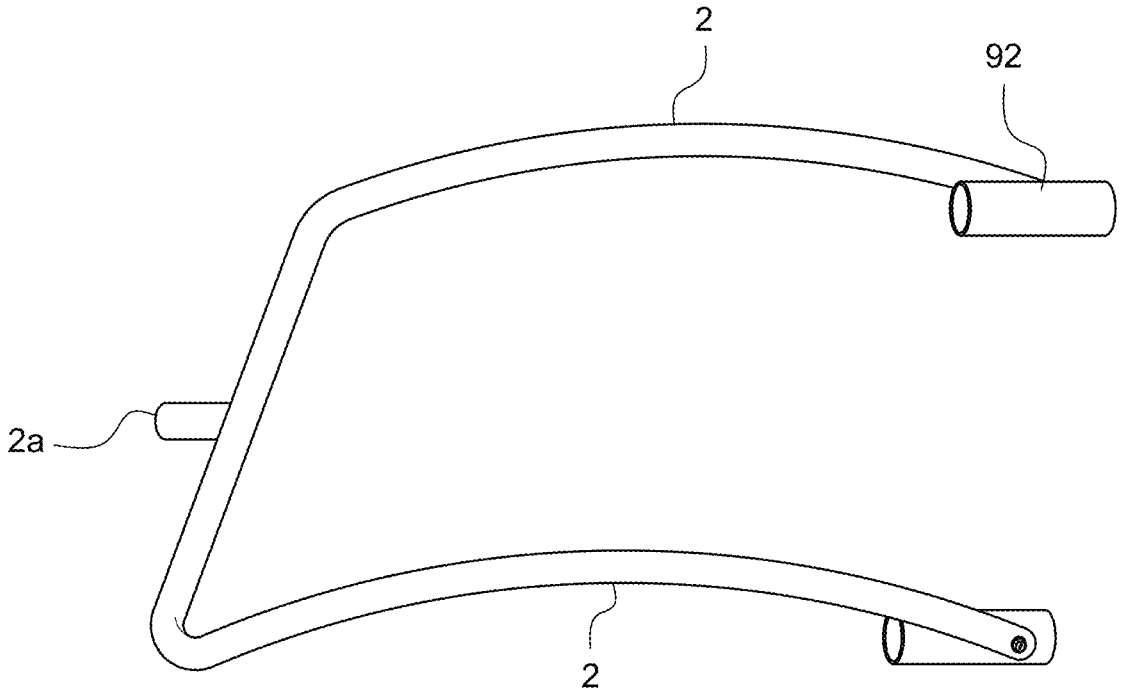
FIG. 8A is a schematic of an embodiment of a sunshade/shield attached to a chair.

FIG. 8*a* illustrates the sunshade/shield 1 of FIG. 1 detailing the rear shade frame sleeve 92 also on the left and right which is bonded to rear shade frame 10, for connecting rear shade frame 10 with front shade frame 9.

Figure 9:
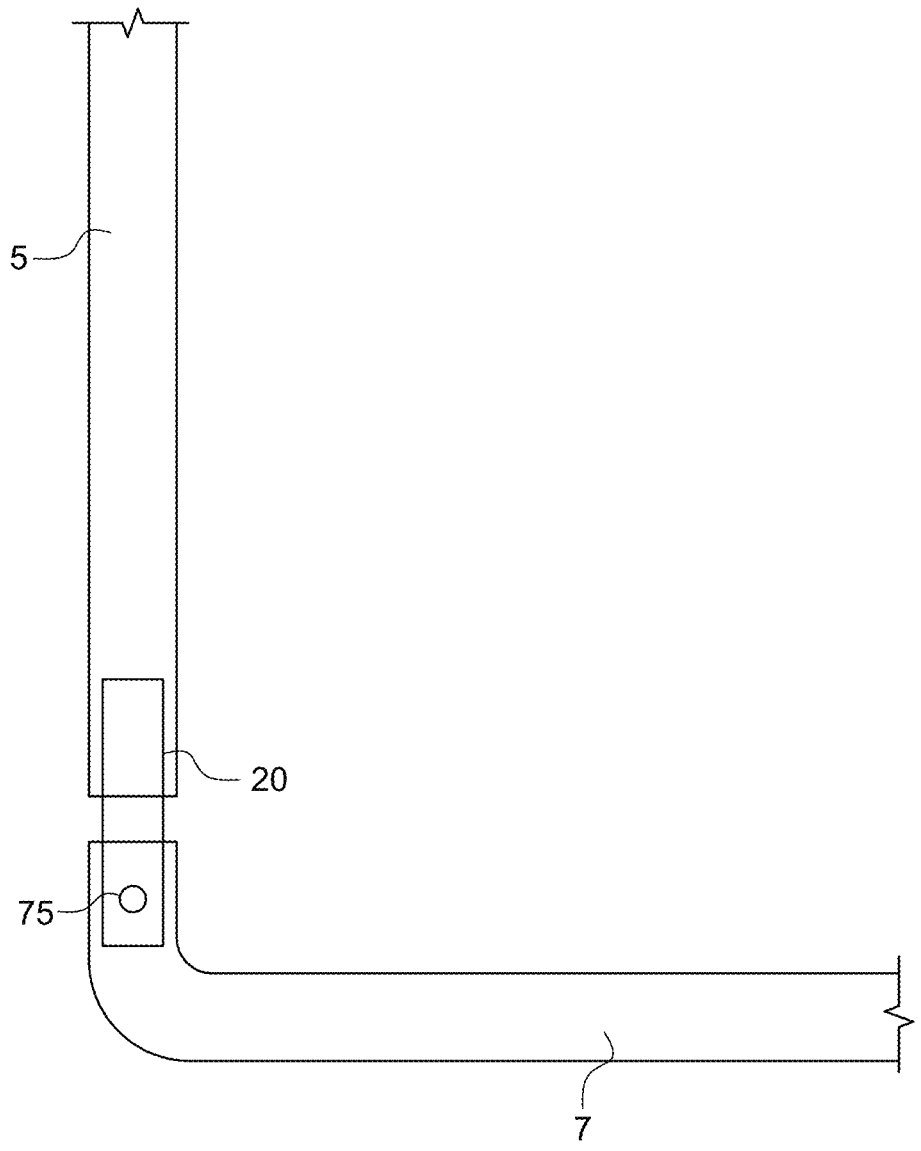
FIG. 9 is a schematic of an embodiment of a portion of a sunshade/shield leg.

FIG. 9 illustrates the sunshade/shield 1 of FIG. 1 detailing the leg 5 the sunshade/shield 1 has when attached to the ground frame 7 versions by the internal sleeve 20 which is bonded to 5 and secured by push pin thru hole 75.

Figure 10:
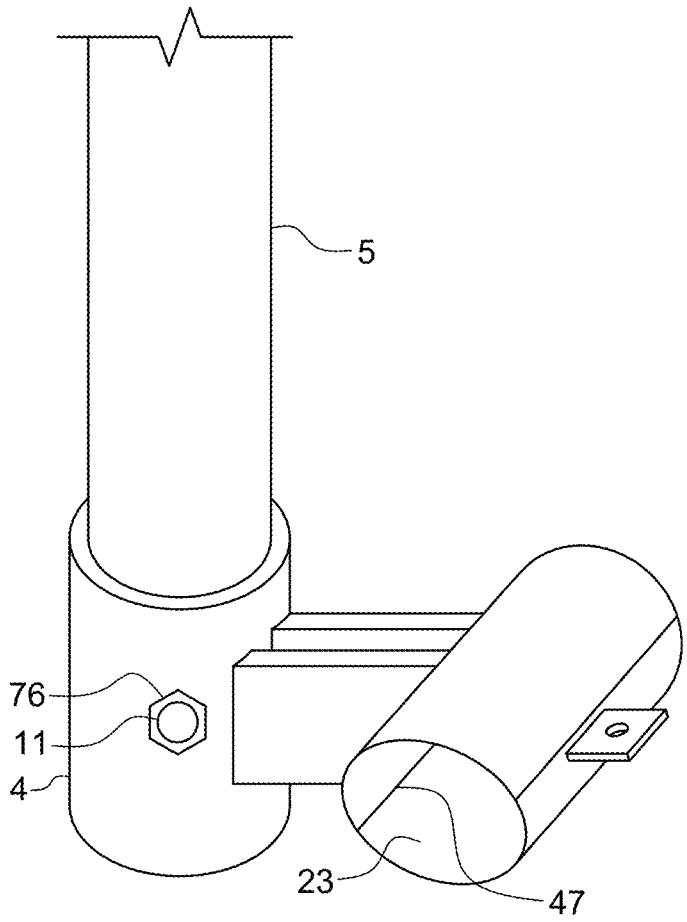
FIG. 10 is a schematic of an embodiment of a portion of a sunshade/shield connection to a chair.

FIG. 10 illustrates the sunshade/shield 1 of FIG. 1 detailing the connections in FIG. 8 where a thumbscrew and nut 11/76 secures leg chair collar 4 to leg to chair c-clamp/hinge assembly 23/47.

Figure 11:
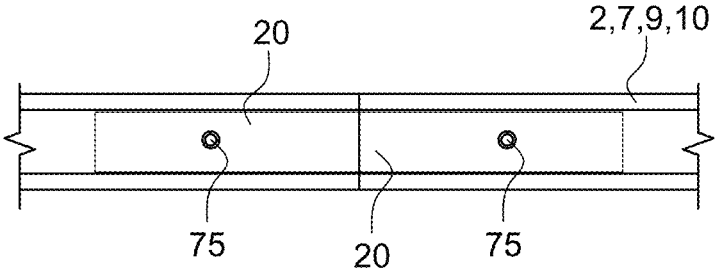
FIG. 11 is a schematic of an embodiment of a portion of a sunshade/shield thumbscrew with push pin connectors.

FIG. 11 illustrates the sunshade/shield 1 of FIG. 1, detailing the 5-inch straight section of parts 2/7/9/and 10 where the pin button connectors 20/75 are located for disassembly on portable models.

Figure 12:
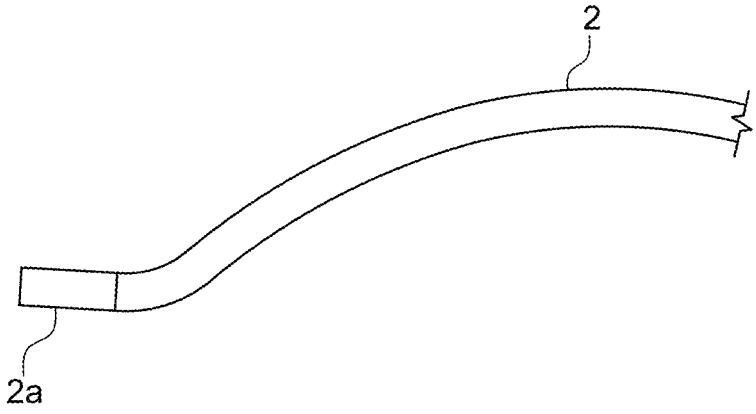
FIG. 12 is a schematic of an embodiment of a portion of a sunshade/shield yoke and yoke post.

FIG. 12 illustrates the sunshade/shield 1 of FIG. 1, detailing yoke 2 with yoke post 2*a*.

Figure 12A:
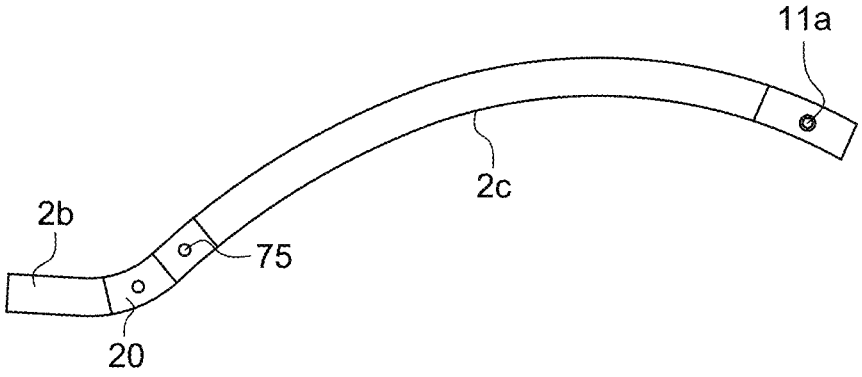
FIG. 12A is a schematic of an embodiment of a portion of a sunshade/shield yoke, yoke post and thumbscrew.

FIG. 12*a* illustrates the sunshade/shield structure as in FIG. 1, detailing yoke 2*b* with yoke post 2*a* and thumbscrew 11*a* with push pin connectors 20/75 for disassembly.

Figure 13:
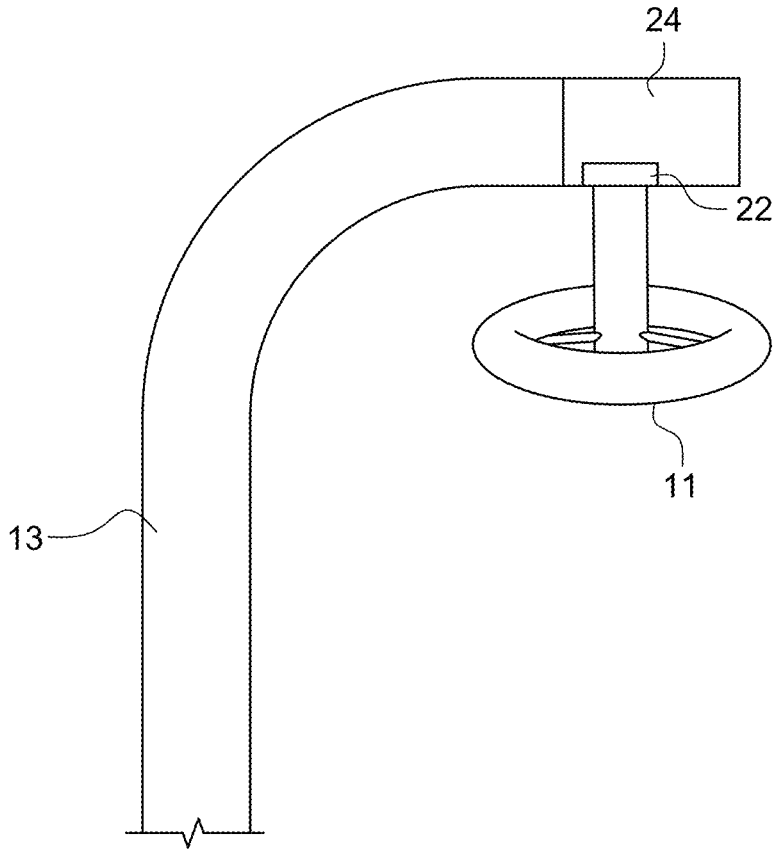
FIG. 13 is a schematic of an embodiment of a portion of a sunshade/shield gooseneck.

FIG. 13 illustrates the sunshade/shield 1 of FIG. 1, detailing the gooseneck 13 and the thumbscrew or quick-release connector 11 of the gooseneck 13 to the control of rotating the yoke 2 via gooseneck collar 24.

Figure 14:
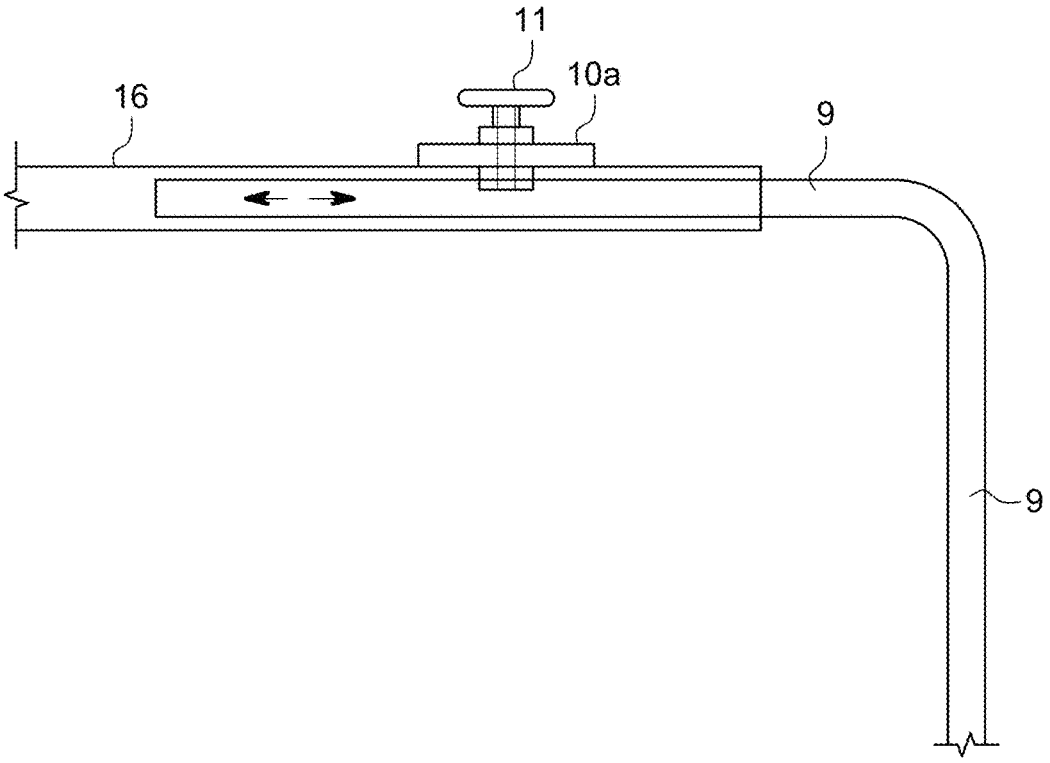
FIG. 14 is a schematic of an embodiment of a portion of a sunshade/shield tilt component.

FIG. 14 illustrates the sunshade/shield of FIG. 4 detailing the shade frame tilt component plate 10*a* connected to square rear shade frame 16 with round tubing of 9 inserted. Part 9 when inserted in 16 allows for shortening of shade part 1. Tilt adjustments are possible by tilt component 10*a* via quick release or thumbscrew 11, with nut 76 tightening the tilt adjuster (the tilt component plate) and quick release.

Figure 15:
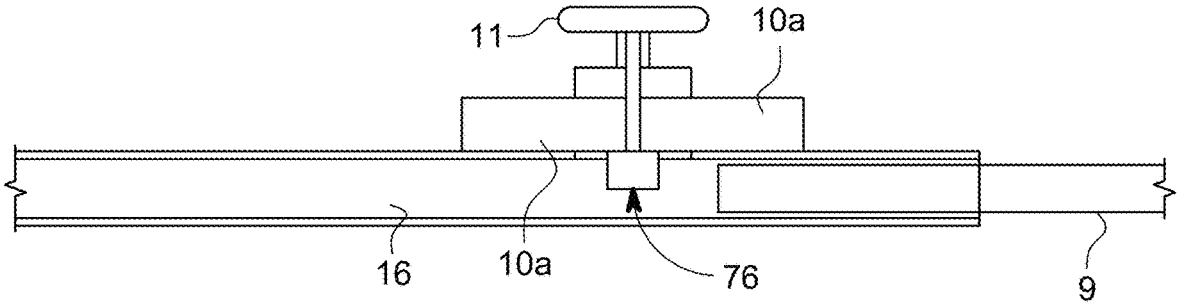
FIG. 15 is a schematic of an embodiment of a portion of a sunshade/shield square rear shade from tilt component.

FIG. 15 illustrates the sunshade/shield 1 of FIG. 4, detailing the square rear shade frame 16 tilt component plate 10*a* connected to square rear shade frame 16 via a quick release or thumbscrew 11, secured with nut 76 which allows the square rear shade frame 16 to tilt and allow front frame 9 to slide into it, and also showing the rear shade/shield square tubing 16 with round sleeve rear shade 9 protruding from square rear shade frame tubing 16.

Figure 15A:
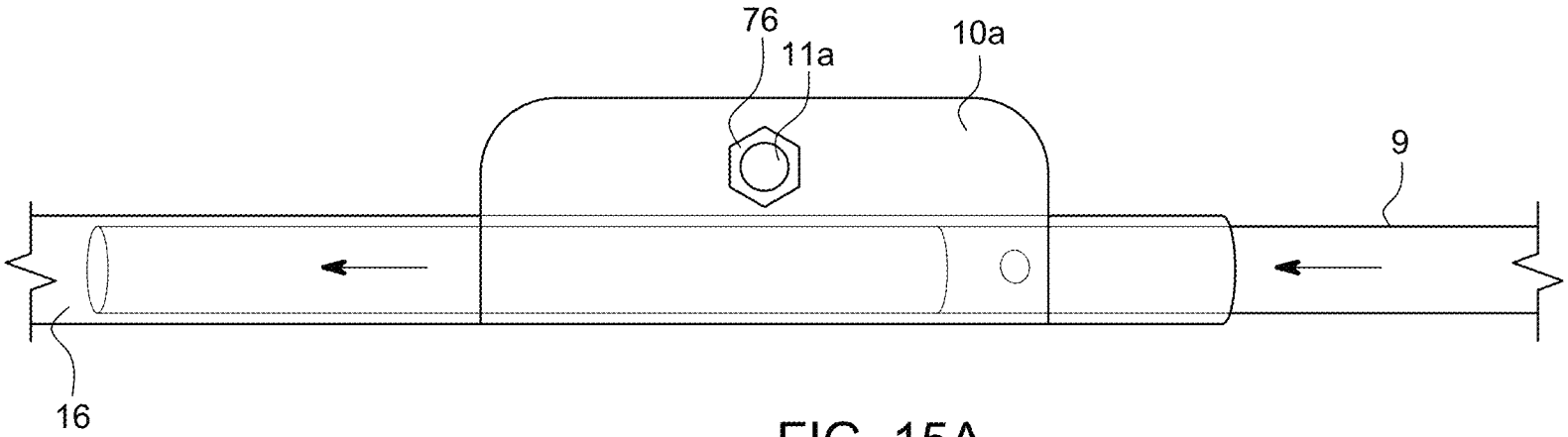
FIG. 15A is a schematic of an embodiment of a portion of a sunshade/shield rear shade frame tubing connections.

FIG. 15*a* illustrates the sunshade/shield 1 of FIG. 4, detailing the 11*a* through hole for quick release/thumbscrew 11 locking nut 11*a* with square rear shade frame tubing 16 surrounding round rear shade frame tubing 9 which can be lengthened or shortened by its insertion.

Figure 16:
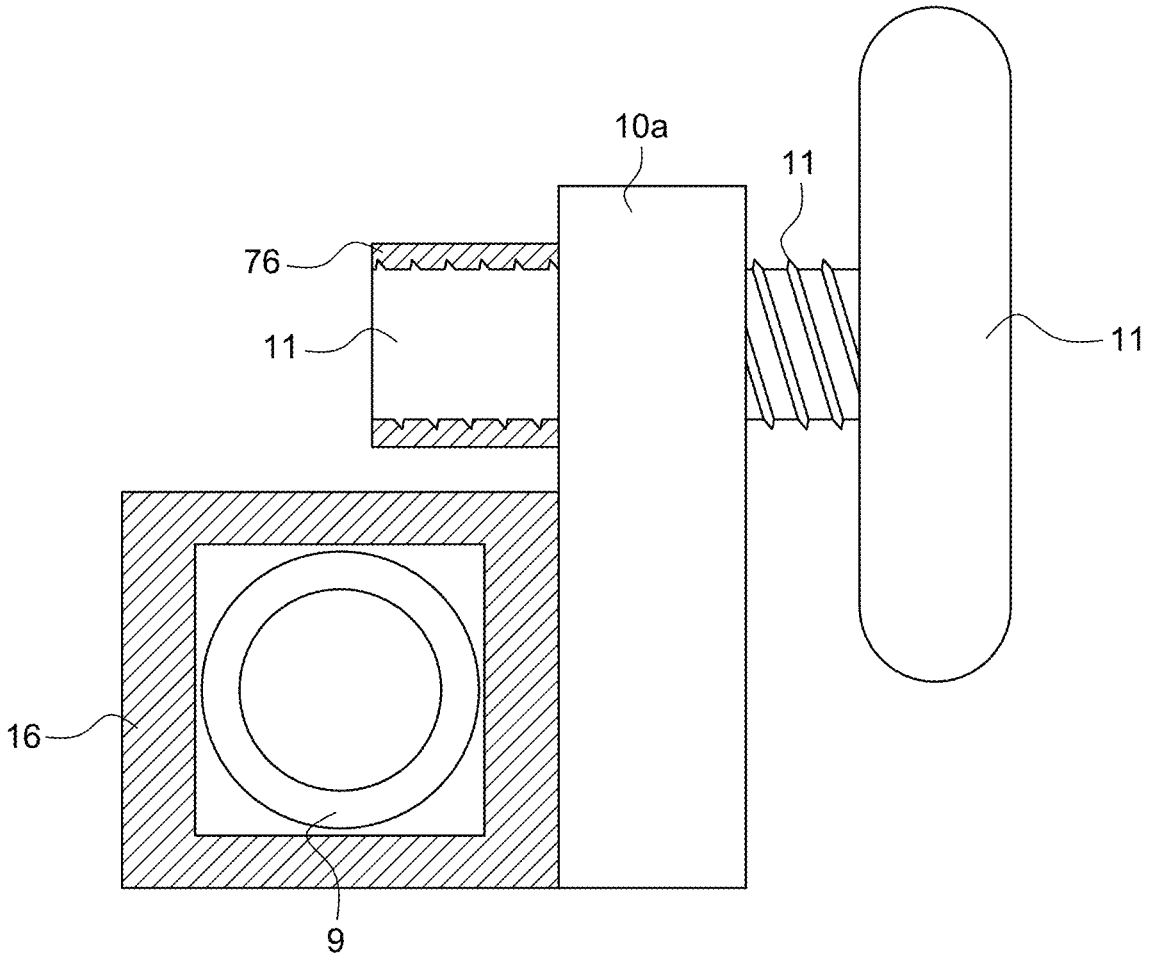
FIG. 16 is a schematic of an embodiment of a portion of a sunshade/shield rear shade frame tubing in cross section.

FIG. 16 illustrates the sunshade/shield 1 of FIG. 4, wherein the quick release or thumbscrew 11 is shown through square rear shade frame 16 tilt component plate 10*a* and secured with nut 76 and shown is a cross-section of square rear shade frame tubing 16 which contains within the round front shade frame tubing 9.

Figure 17:
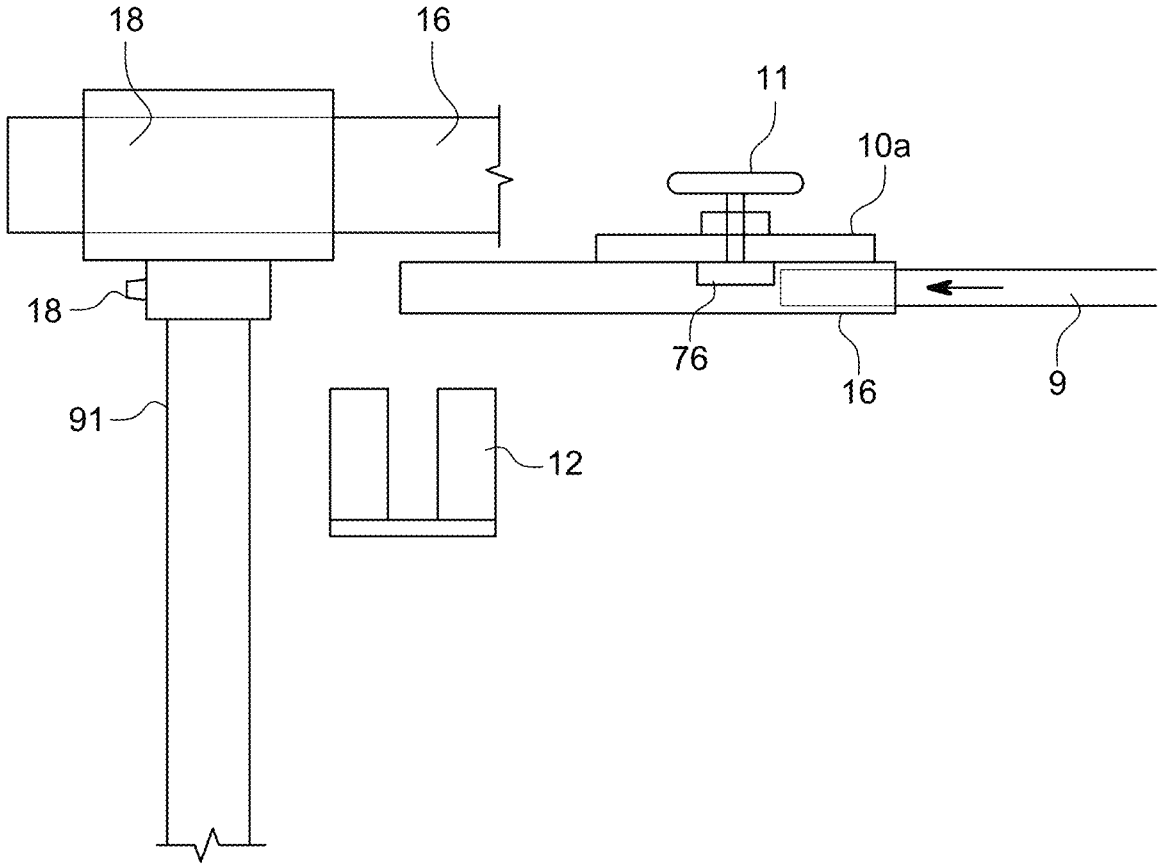
FIG. 17 is a schematic of an embodiment of a portion of a sunshade/shield rear shade frame tubing in cross-section.

FIG. 17 illustrates the sunshade/shield 1 of FIG. 4, wherein the quick release or thumbscrew 11 is shown which is bonded and attached to 10*a*. The square rear shade frame 16 tubing is bonded to 10*a* and 9 is slid into square tubing 16. The hook and loop 12 is also shown as the hook and loop bottom of the shade which interfaces with 12 as the hook and loop top of the shade. The rolling mechanics of this component design of shade 1 is accomplished by rolling the shade 1 around part 91 which is connected to a locking roller control internal of part 18 which is attached to the square tubing of part 16. The mechanical tightener part 18 creates tension of part 1 when part 9 is slid into part 16 when part 1 is adjusted to shorten the part 1 shade length.

Figure 18:
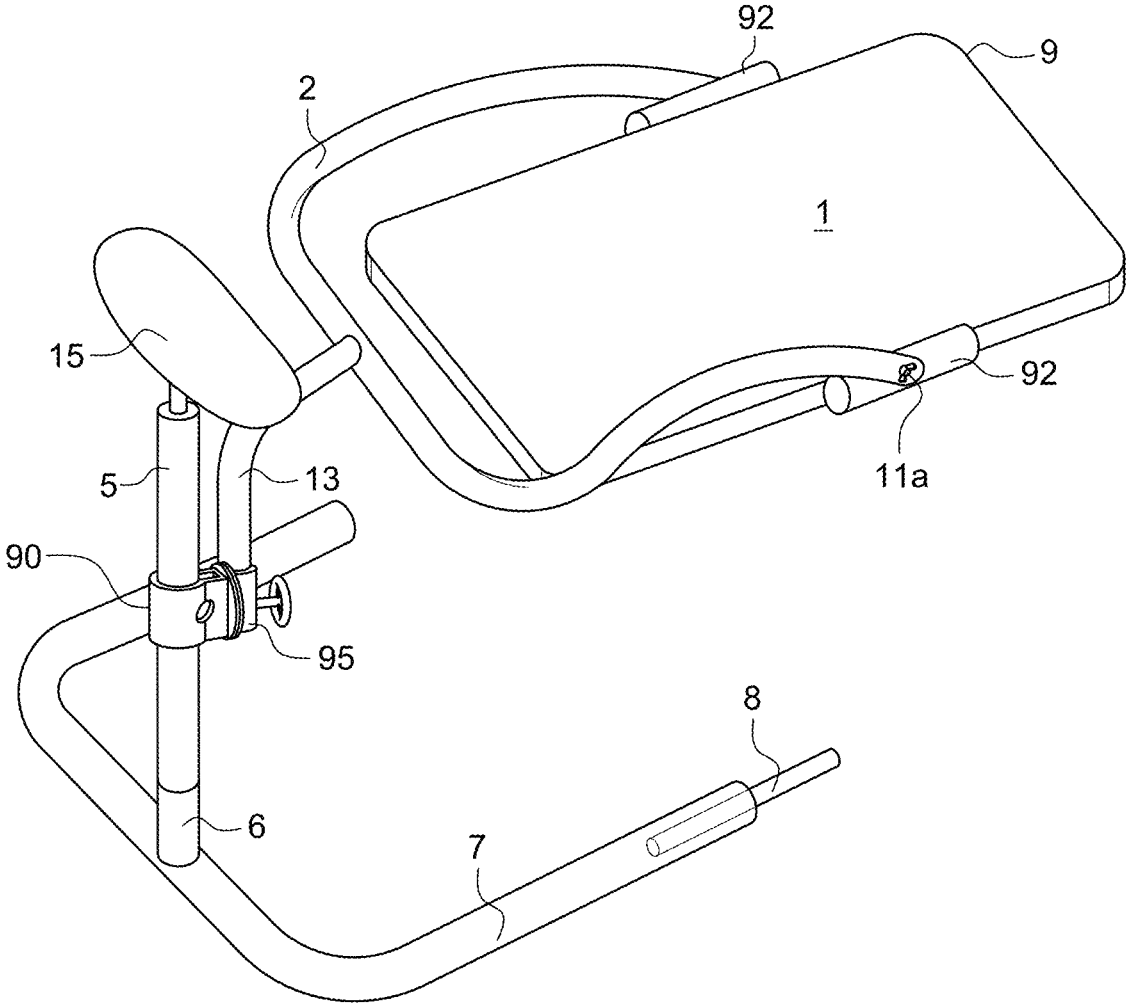
FIG. 18 is a schematic of an embodiment of a sunshade/shield in perspective view showing a solar panel installation.

FIG. 18 illustrates the sunshade/shield of FIG. 1, further comprising a solar panel 15 is shown extending out of and supported by leg 5 which connects to ground frame 7 or sand anchor part 83 with telescoping sleeve extending out and angle adjust/tilting towards the sun on leg 5.

Figure 19:
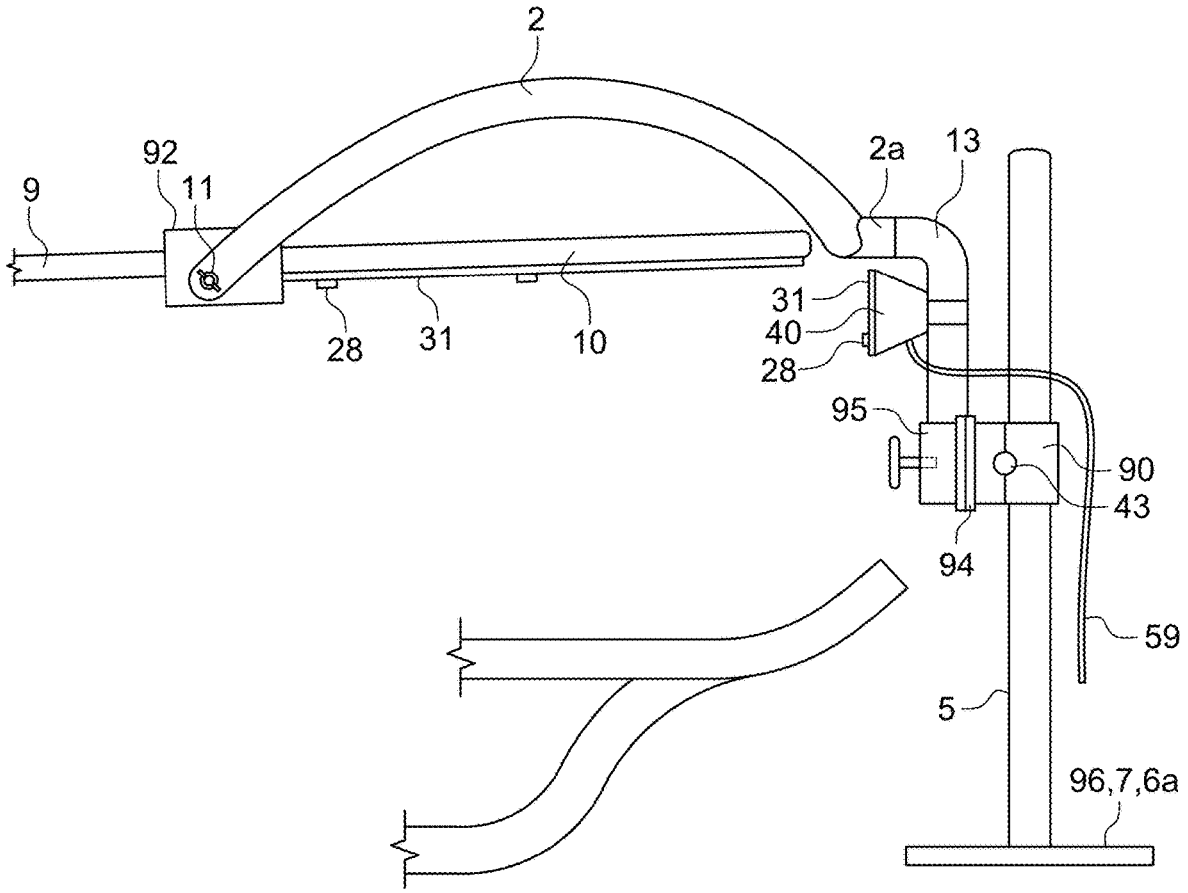
FIG. 19 is a schematic of an embodiment of a portion of a sunshade/shield in side view.

FIG. 19 illustrates the sunshade of FIG. 1, further comprising mister 40, fed with water via hose 59. Additionally, misters 28 are arranged around fan 40 and on the bottom of shade frame sections 9/10 along with LED strip lighting 31 around fan face 40 and on underside of parts 9/10. Supply of water for 28 is through tubing 59.

Figure 20:
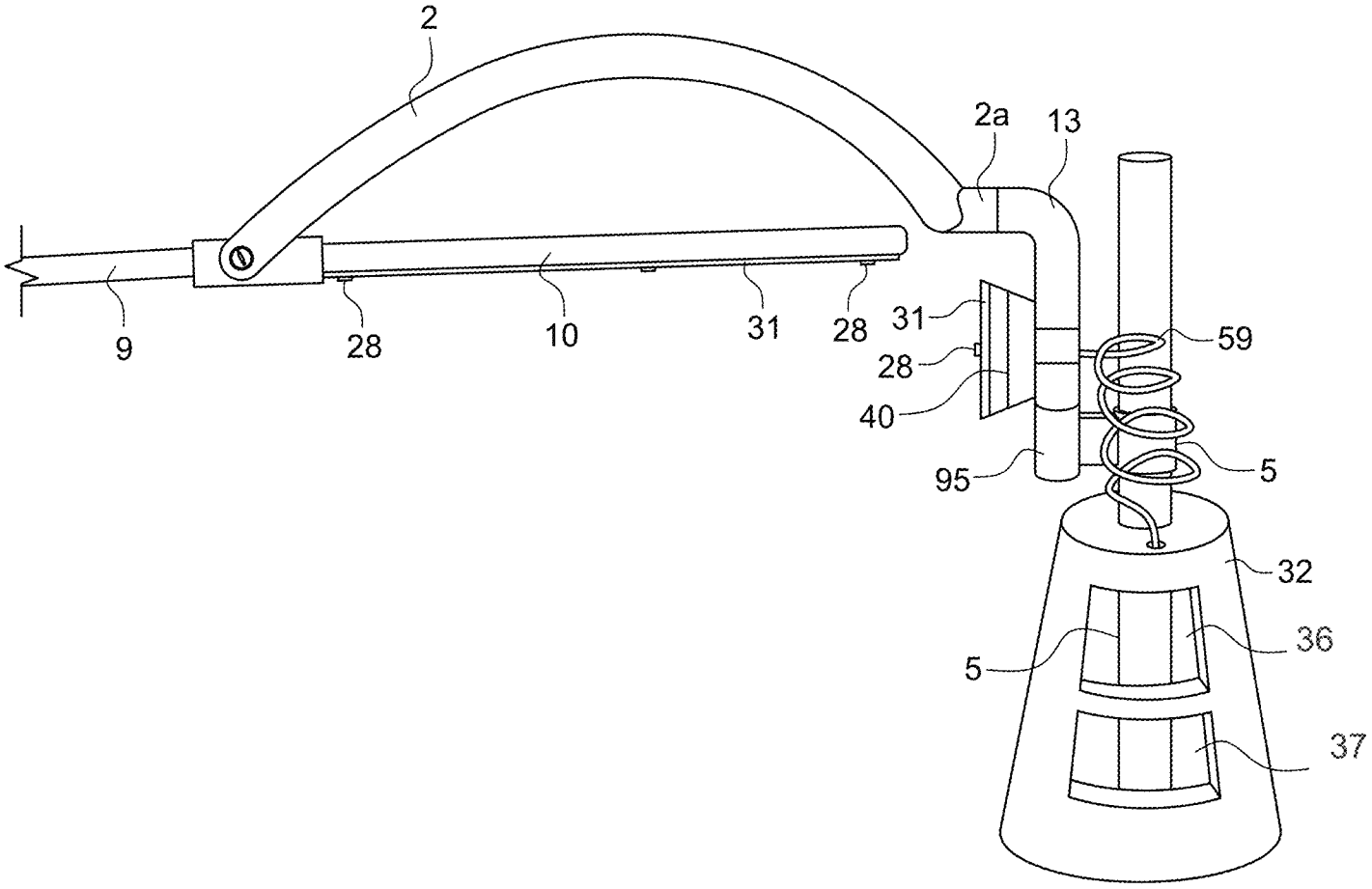
FIG. 20 is a schematic of an embodiment of a sunshade/shield in side view.

FIG. 20 illustrates the sunshade/shield 1 of FIG. 1, wherein said yoke 2 is connected to a water supply 59 for the mister 28, the water coming from a storage compartment 32 which is located surrounding the leg 5 behind the chair, the storage compartment 32 has a cabinet door 37 for locking utility items in and another cabinet door 36 for personal items with locks.

Figure 21:
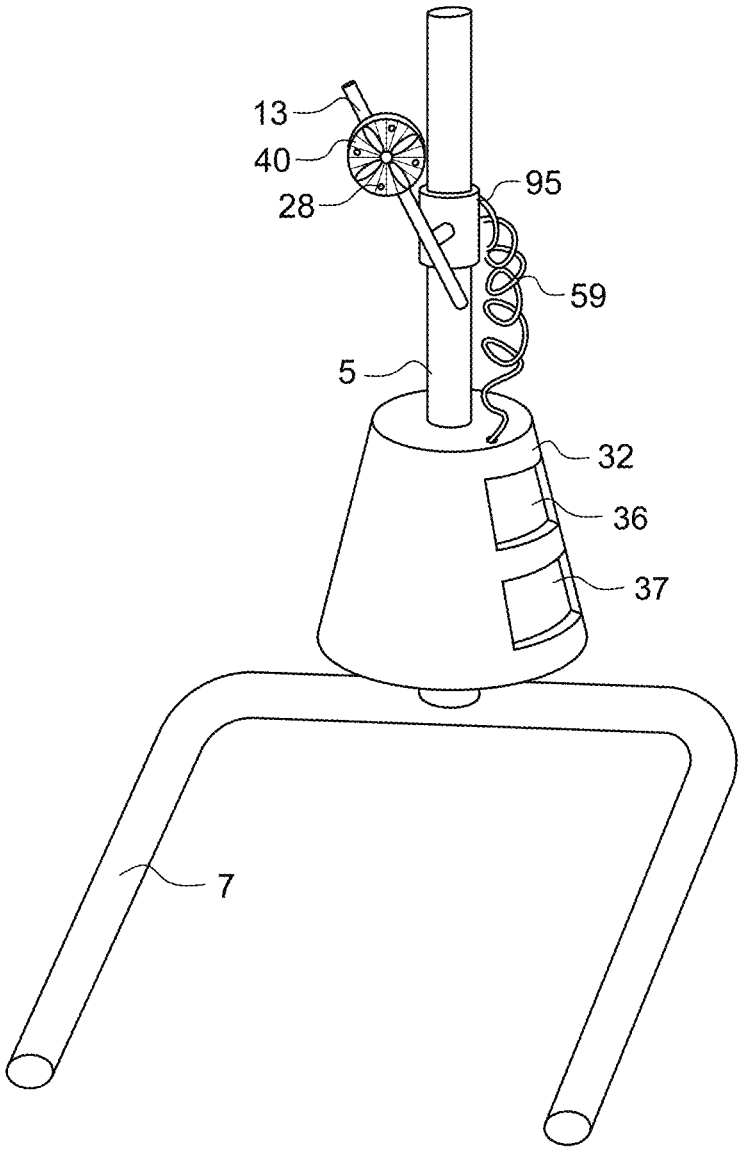
FIG. 21 is a schematic of an embodiment of a portion of a sunshade/shield showing a storage compartment around a leg in perspective view.

FIG. 21 illustrates the sunshade/shield 1 of FIG. 1, wherein said storage compartment 32 surrounding leg 5 which supplies the water from it container in a portion of part 37 through hose 59 to fan 40 located on 13.

Figure 22:
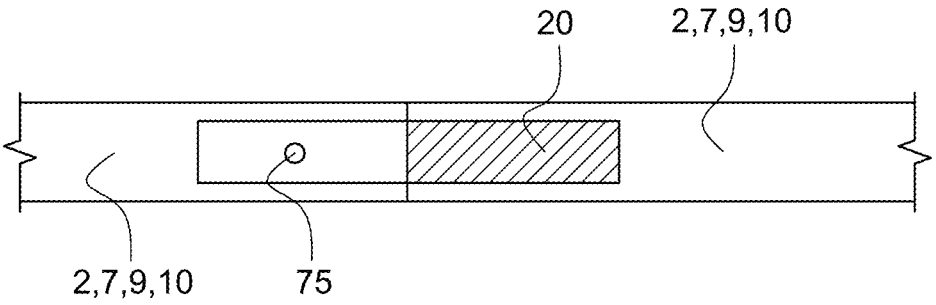
FIG. 22 is a schematic of an embodiment of a portion of a sunshade/shield frame in cross-section that is expandable.

FIG. 22 illustrates the sunshade/shield of FIG. 1, wherein 2/7/9/10 can be expanded in width or length via glued end of member 20 in said parts via pushpin 75, which when the push-pin releases frame 2/7/9/10, related parts expands and locks in in a new width or length. These expanding or disassembled parts greatly reduce the related components for portability and storage needs.

Figure 23:
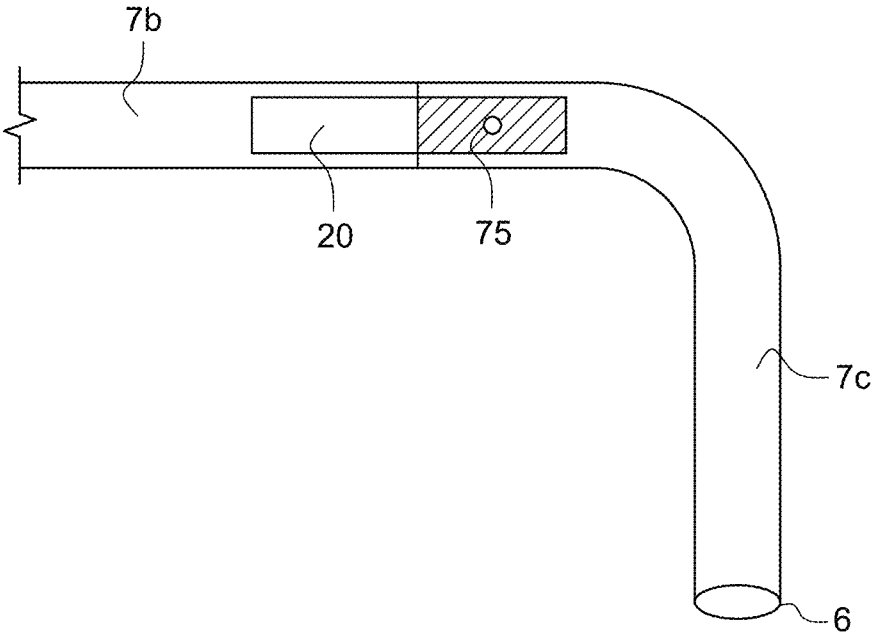
FIG. 23 is a schematic of an embodiment of a portion of a sunshade/shield ground frame in side view.

FIG. 23 illustrates the sunshade/shield of FIG. 1 and FIG. 4, wherein ground frame 7 can be disassembled or expanded in length via glued member 20 to part 7*b* and pushpin 75, which when the push-pin 75 releases ground frame parts 7*b* and 7*c*, frame then can be disassembled.

Figure 24:
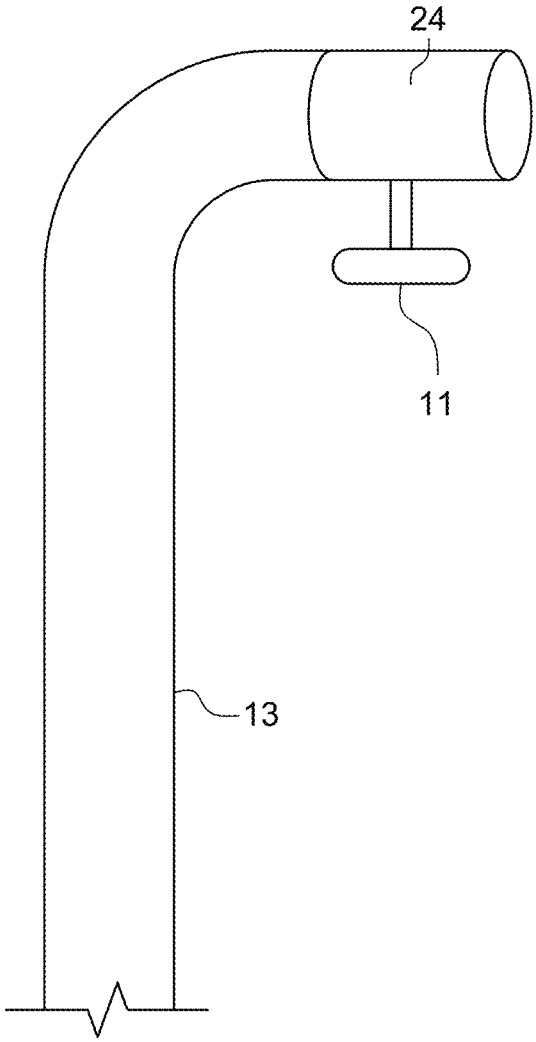
FIG. 24 is a schematic of an embodiment of a portion of a sunshade/shield gooseneck in side view.

FIG. 24 illustrates the sunshade/shield 1 of FIG. 1, wherein the gooseneck 13 is attached to yoke 2 via a quick release or thumbscrew 11, and gooseneck collar 24 is used to control the rotation of yoke part 2.

Figure 25:
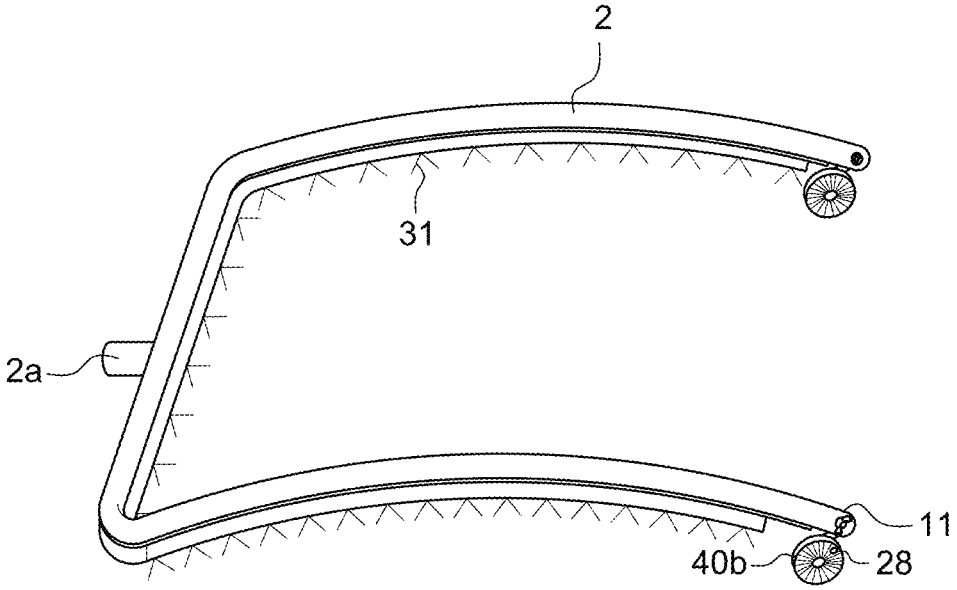
FIG. 25 is a schematic of an embodiment of a portion of a sunshade/shield yoke with attachments from perspective view.

FIG. 25 illustrates the sunshade/shield 1 of FIG. 1 wherein the yoke 2 is shown with LED lighting waterproof string lights 31 and yoke fan 40*b*, available to blow fog/mist through the fogging/misting nozzle 28. The yoke fan 40*b* and the fogging/misting nozzle 28 are attached to the yoke 2 via a mechanical clamp.

Figure 26:
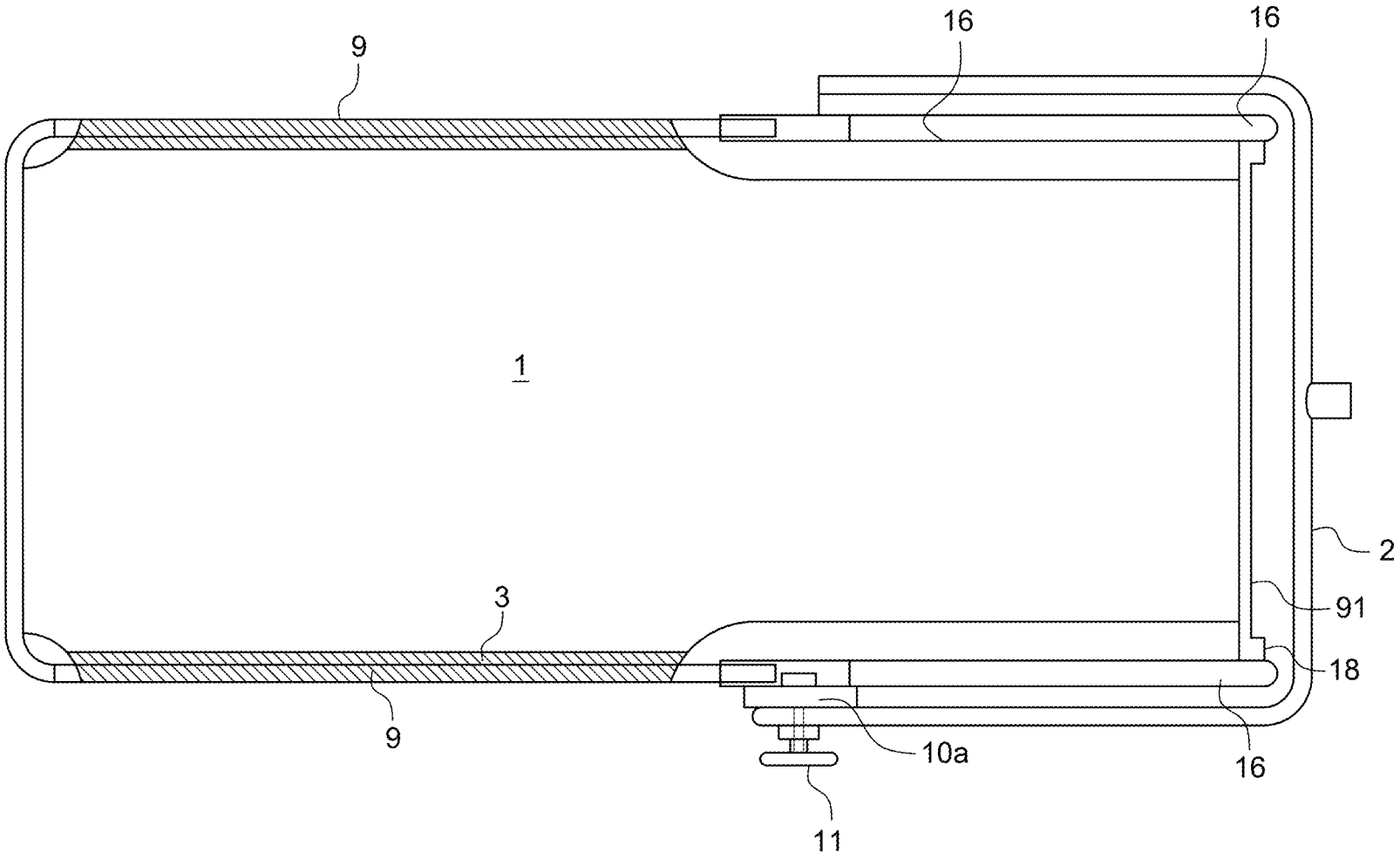
FIG. 26 is a schematic of an embodiment of a portion of a sunshade/shield shield/shade roller assembly from top view.

FIG. 26 illustrates the sunshade of FIG. 1, detailing the shield/shade roller assembly 91/18 comprising the shield/shade roller tube 91 and shield/shade racket assembly 18. Also shown is round tubing 9 sliding into square rear shade frame tubing 16 and thumbscrew 11 which attaches yoke 2 to sunshade/shield 1.

Figure 27:
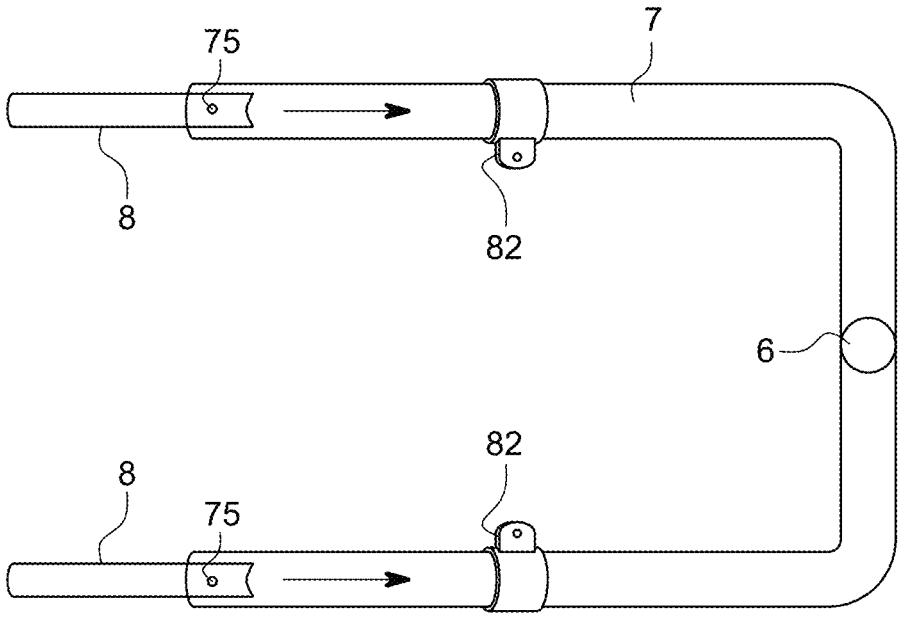
FIG. 27 is a schematic of an embodiment of a portion of a sunshade/shield ground frame from top view.

FIG. 27 illustrates the sunshade/shield 1 of FIG. 1, wherein the ground frame 7 is extendable in length by inserted sleeve 8 sliding into and out of ground frame 7 via push pin connector 75. Also shown is ground plate 82 attached to ground frame 7 which the chair rest on supplying additional stability created by the chair and or users weight placed on said plate.

Figure 28:
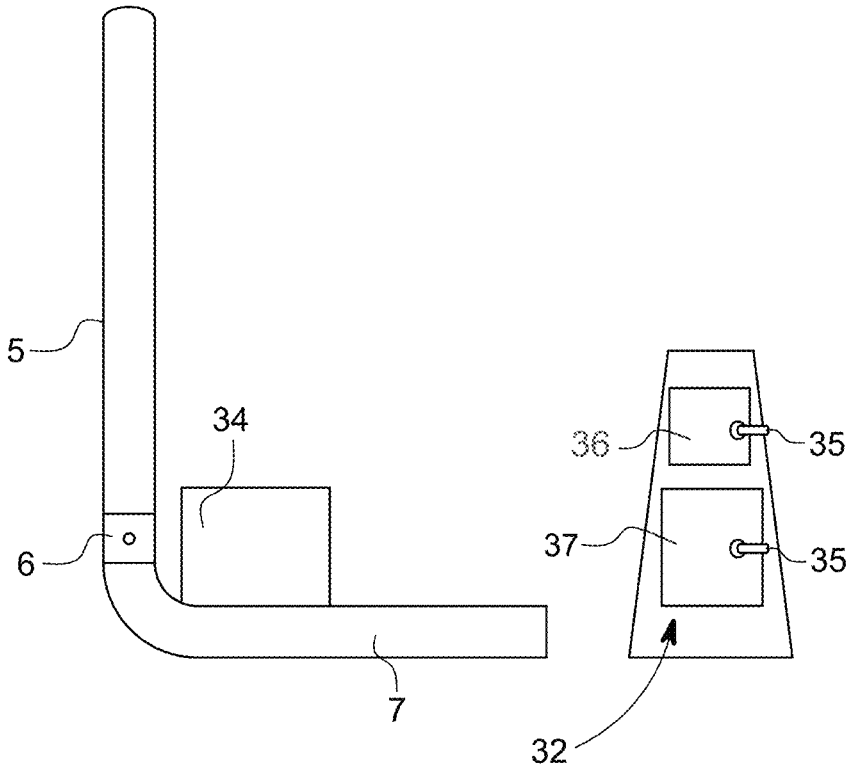
FIG. 28 is a schematic of an embodiment of a portion of a sunshade/shield showing storage receptacles in side view.

FIG. 28 illustrates the sunshade/shield of FIG. 1, detailing two different lockable storage receptacles 34/32 tucked into the ground frame 7 for convenient access to the utility and personal storage compartment. Lockable unit 32 has two lockable doors 35 on personal and utility compartments. The bottom compartment 37 is for utilities, the top compartment 36 is for personal items.

Figure 29:
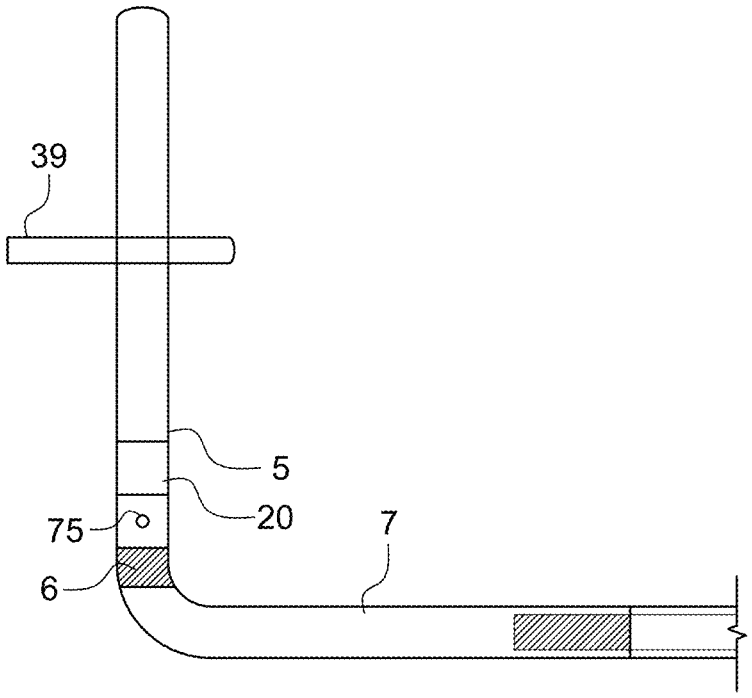
FIG. 29 is a schematic of an embodiment of a portion of a sunshade/shield leg in cross-section.

FIG. 29 illustrates the sunshade/shield of FIG. 1, detailing how personal items can be accessible on leg 5, via push pin connector 75 can extend the movable shelf 39 up and down leg 5 for personal items.

Figure 30:
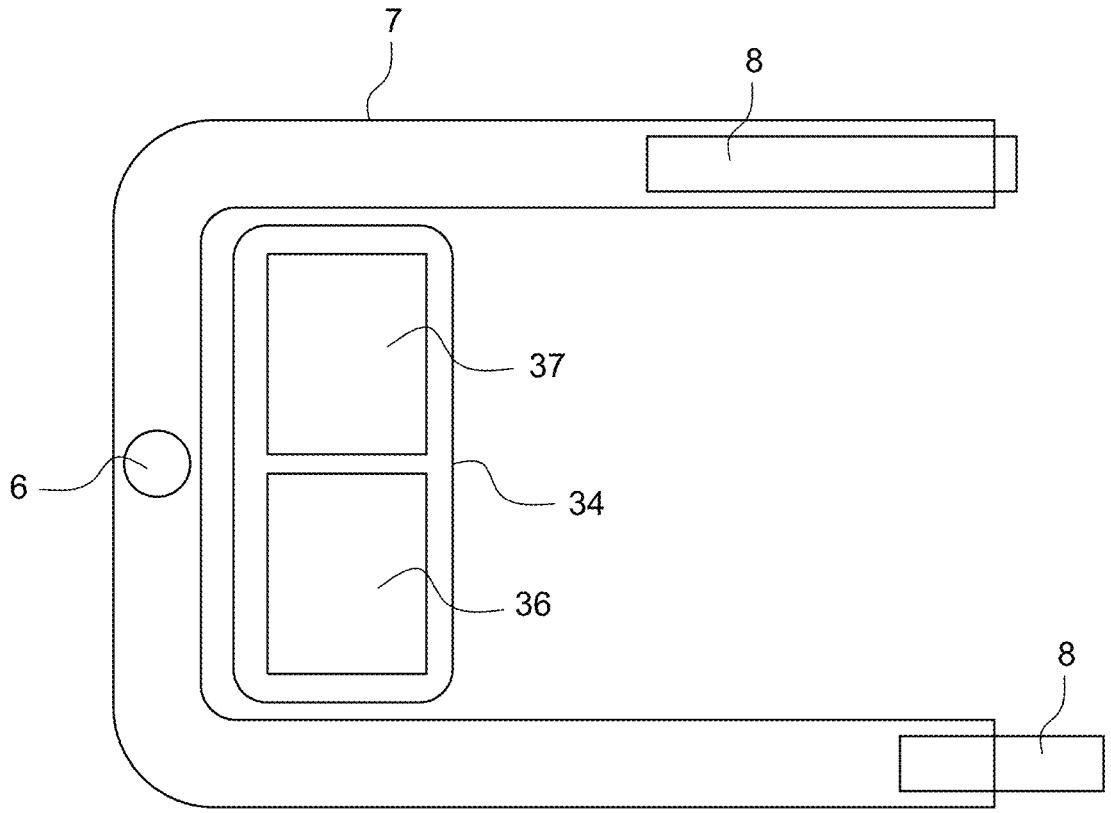
FIG. 30 is a schematic of an embodiment of a portion of a sunshade/shield showing storage receptacles and legs in cross-section.

FIG. 30 illustrates the sunshade/shield of FIG. 1 detailing lockable storage receptacles 34 tucked within the ground frame 7 with individual parcels 36 and 37. Also shown is extendable legs in length 8 in and out of ground frame 7.

Figure 31:
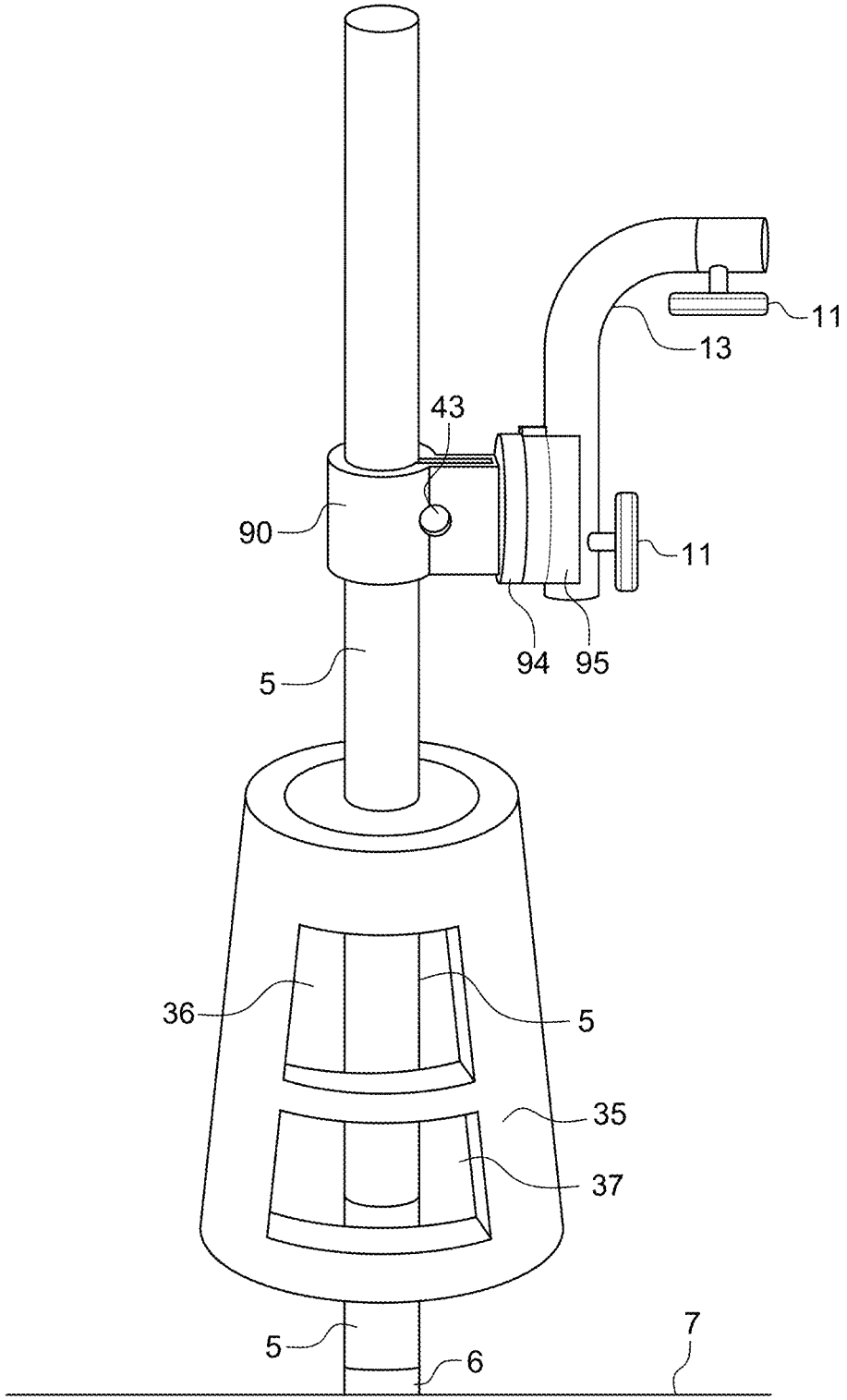
FIG. 31 is a schematic of an embodiment of a portion of a sunshade/shield leg with components in perspective view.

FIG. 31 illustrates the sunshade/shield of FIG. 1 detailing lockable storage receptacle 35 around leg 5. Individuals personal items can be locked inside compartment 36 parcels 36 and utility components in 37. Sliding leg adjuster 90, also connected to height disc 94 which is Interfacing rotator gooseneck connector 95 controls rotational feature of shades via gooseneck 13, all of which are connected via thumbscrew 11. Gooseneck 13 connects leg 5 to yoke 2, and yoke 2 connects to sunshade/shield 1 (not shown). This sliding height adjuster 90 slides up and down leg 5 raising and lowering the yoke 2/shade/shield 1 combination via gooseneck 13. Also shown are lockable storage compartments 36 and 37 in cabinet 35.

Figure 32:
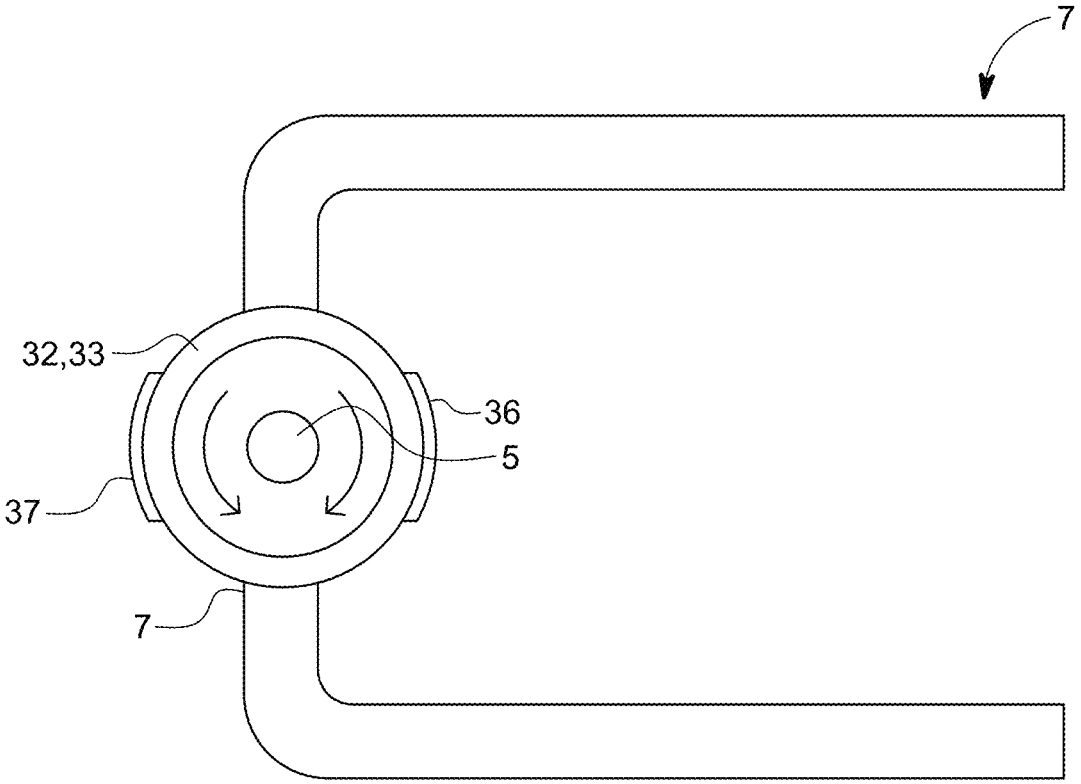
FIG. 32 is a schematic of an embodiment of a portion of a sunshade/shield storage from a top view.

FIG. 32 illustrates the sunshade/shield 1 of FIG. 1, wherein a top view of storage facility 32,33 and 35 is shown showing leg 5 coming up the middle of the storage areas 32,33 and 35 also how the storage area can rotate around leg 5. Separate parcels 36 and 37 of storage areas 32,33 and 35 are shown as is ground frame 7, which supports storage facilities 32,33 and 35.

Figure 33:
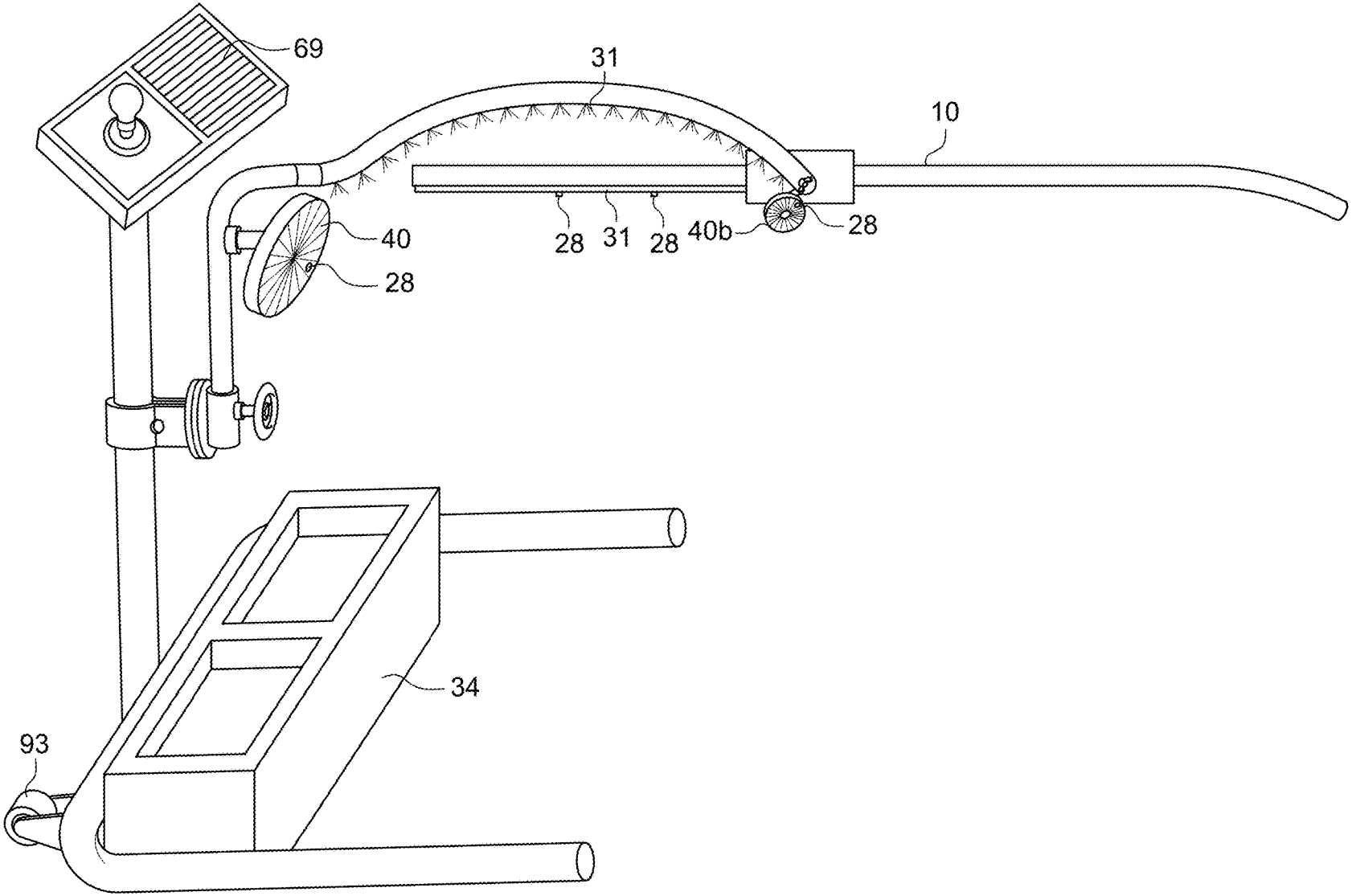
FIG. 33 is a schematic of an embodiment of a portion of a sunshade/shield in a perspective view.

FIG. 33 illustrates the sunshade/shield 1 of FIG. 1 wherein the yoke 2 is shown with LED lighting waterproof string lights 31 and yoke fan 40*b*, available to blow fog/mist through the fogging/misting nozzle 28. The yoke fan 40*b* and the fogging/misting nozzle 28 are attached to the yoke 2. Also displayed is fan 40 blowing fog/mist via spray nozzles 28 on gooseneck 13. Further, storage facilities 34 are mounted between ground frame 7 legs. A roller assembly 93 mounted on the ground frame 7, enables the entire sunshade/shield structure 1, to move easily. In addition, solar panel 69 is mounted on top of leg 5, to power various attached solar components such as string lights 31 and maybe a light bulb.

Figure 34:
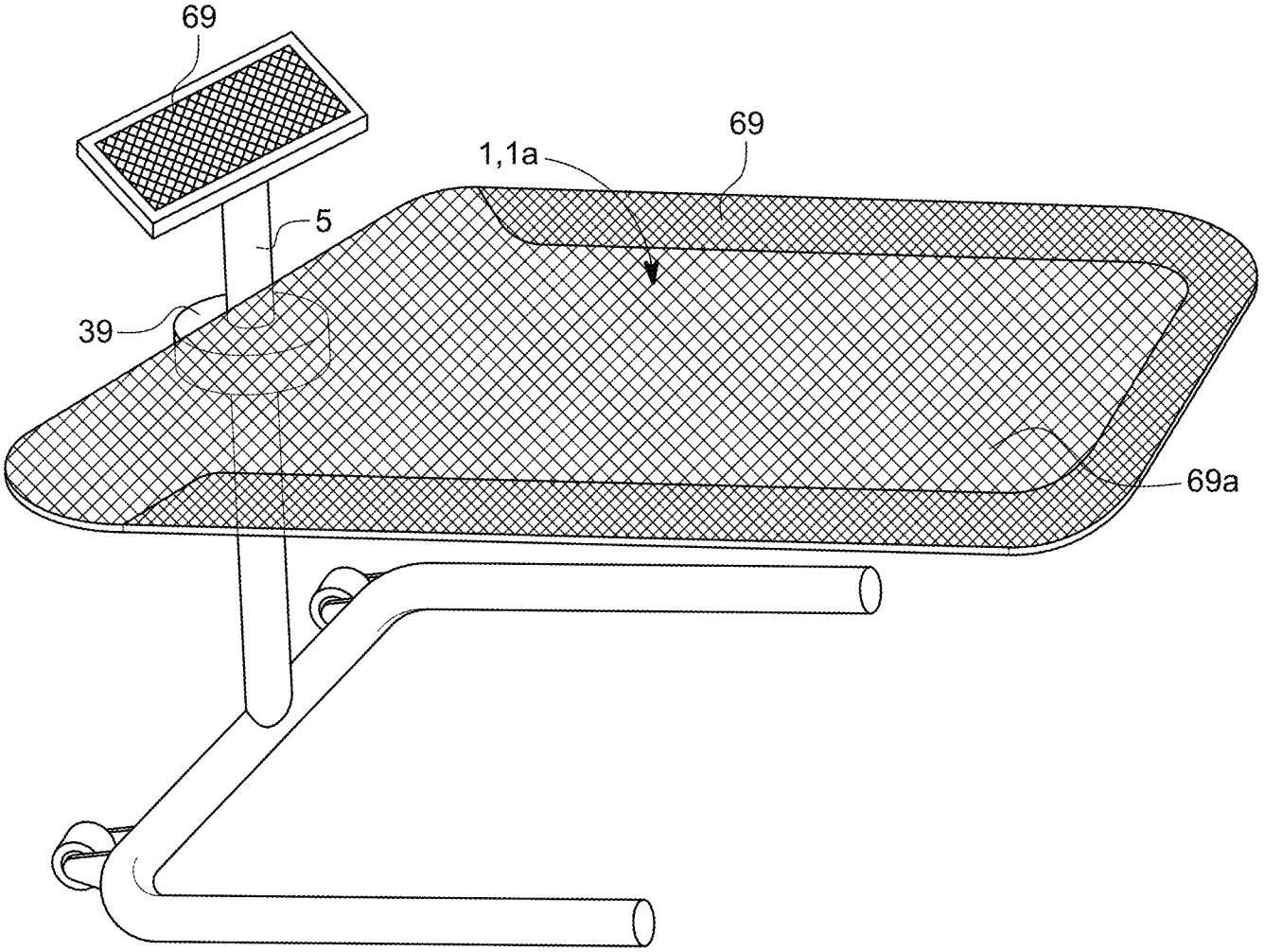
FIG. 34 is a schematic of an embodiment of a portion of a sunshade/shield in a perspective view showing solar collection components.

FIG. 34 illustrates the sunshade/shield 1 of FIG. 1, detailing solar collection strips 69 and solar around shade 1 and fabric 69*a*, covering sunshade/shield 1 as well as a solar panel 69 mounted atop said leg 5.

Figure 35:
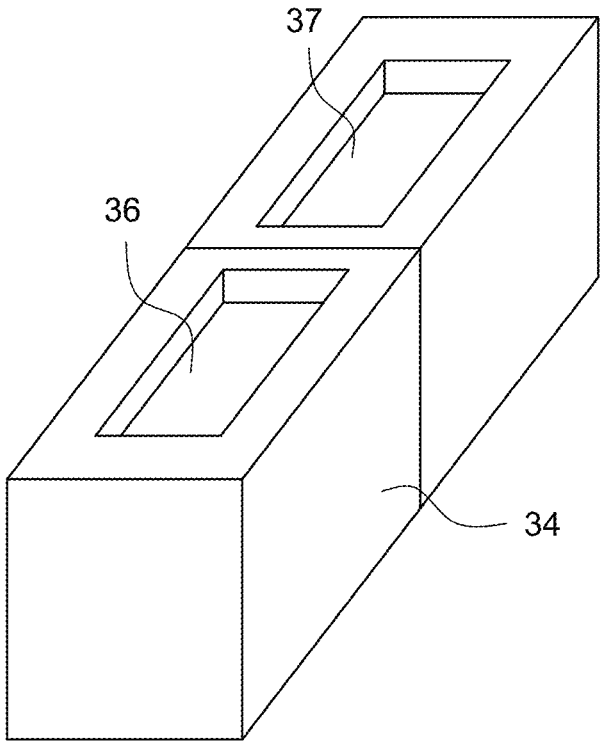
FIG. 35 is a schematic of an embodiment of a portion of a sunshade/shield storage compartments in perspective view.

FIG. 35 illustrates the sunshade/shield 1 of FIG. 1, detailing storage compartments 34 with individual parcels 36 and 37.

Figure 36:
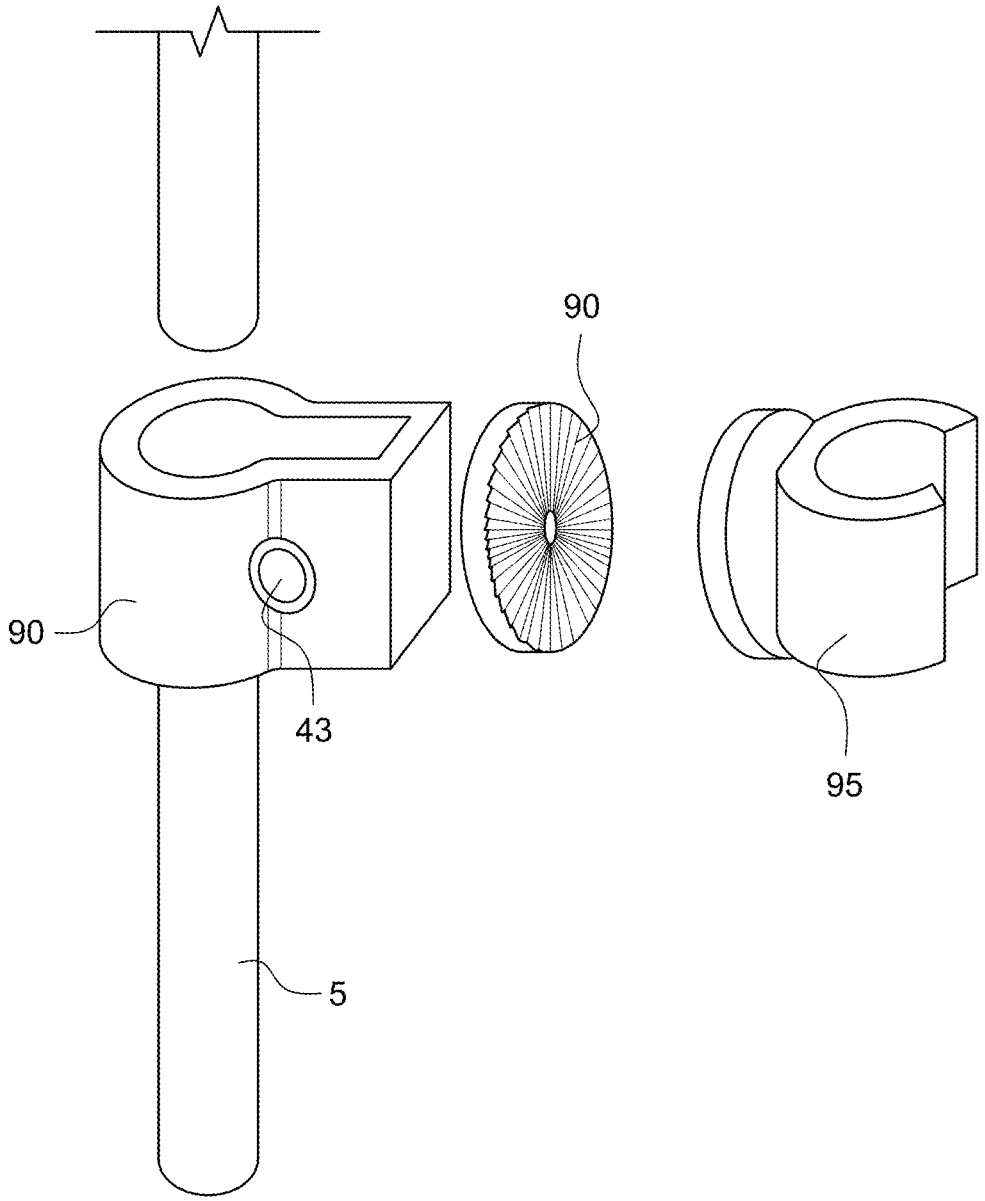
FIG. 36 is a schematic of an embodiment of a portion of a sunshade/shield leg height adjuster collar in perspective view.

FIG. 36 illustrates the sunshade/shield 1 of FIG. 1, wherein the leg height adjuster collar 90 which interfaces with 95, also shown is adjuster wedge hole 43 around leg collar 90 which adjust height up or down leg. Leg height disc 90 interfaces with gooseneck collar 95 allow the sunshade/shield to be rotated on gooseneck 13 (not shown) via yoke 2 connected to sunshade/shield 1), is detailed.

Figure 37:
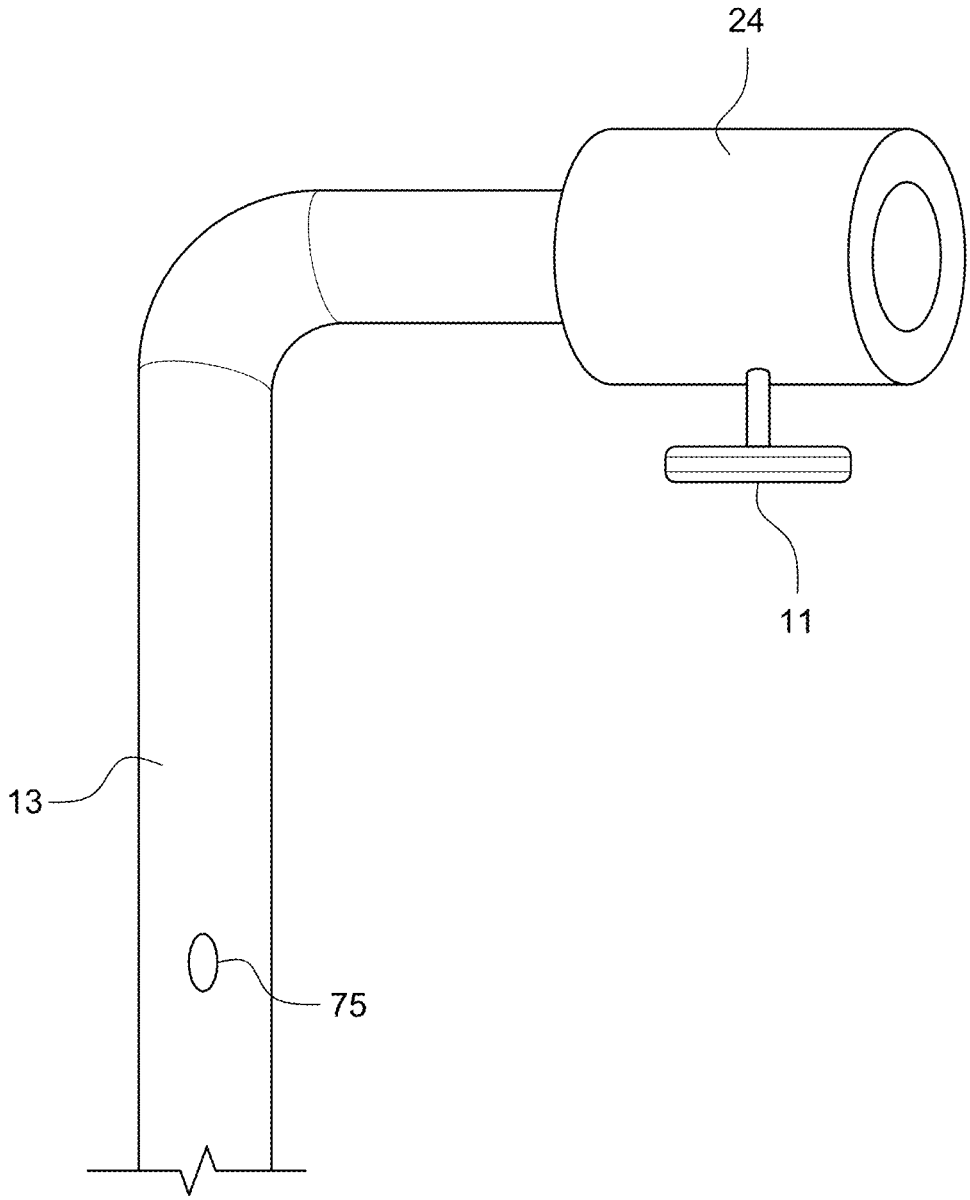
FIG. 37 is a schematic of an embodiment of a portion of a sunshade/shield gooseneck in perspective view.

FIG. 37 illustrates the sunshade/shield 1 of FIG. 1, detailing gooseneck 13 connected to gooseneck collar 24 with thumbscrew 11 which connects gooseneck 13 to yoke 2. Also shown is push pin hole 75 on gooseneck 13.

Figure 38:
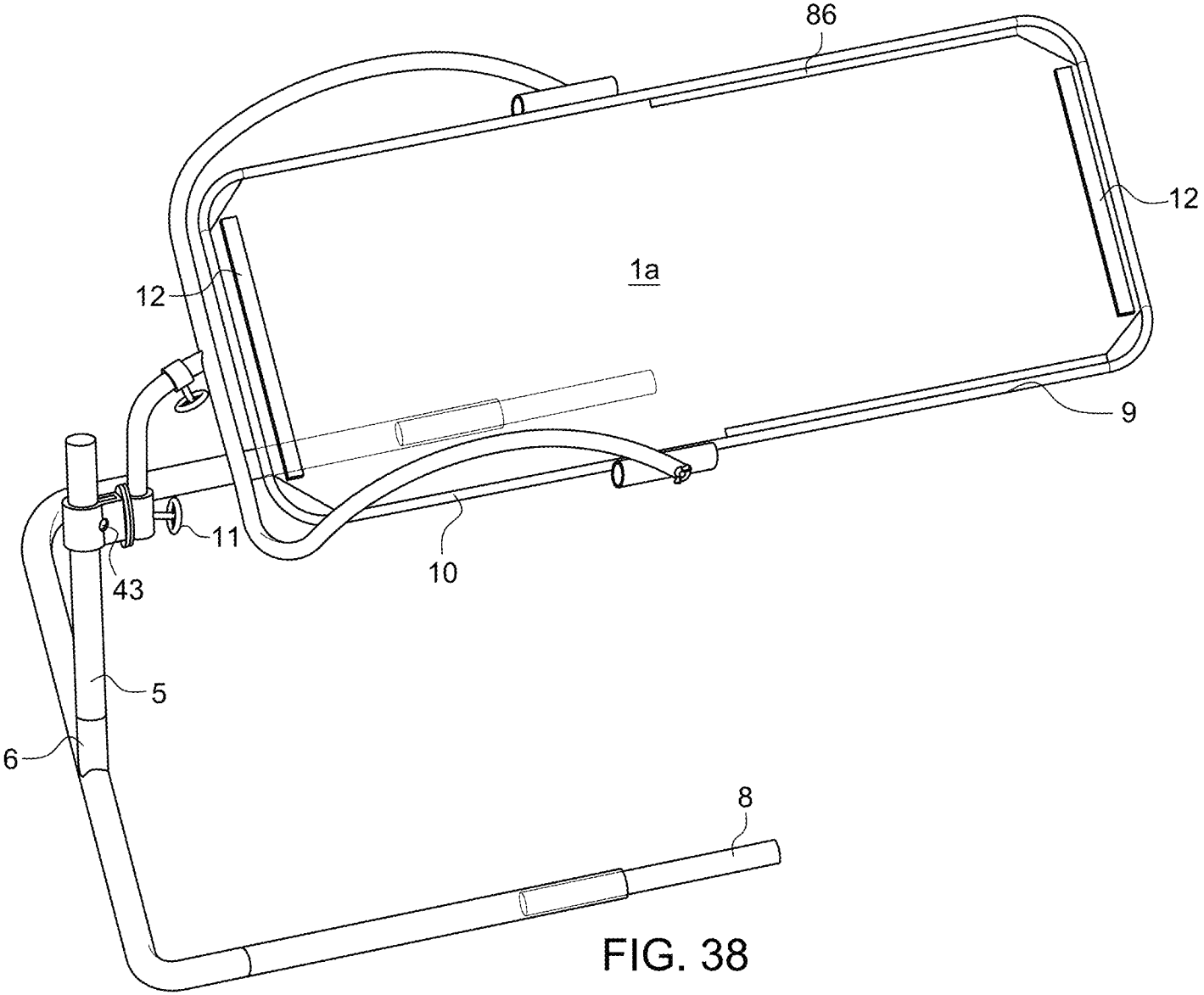
FIG. 38 is a schematic of an embodiment of a portion of a sunshade/shield sunshade/shield in perspective view.

FIG. 38 illustrates the sunshade/shield 1 of FIG. 1, detailing hook and loop 12 mounted on the ends of sunshade/shield 1 and 1*a*, for folding down either or both ends of the sunshade/shield 1 and 1*a*, to make the sunshade/shield 1 or/and 1*a* tighter for different shade needs.

Figure 39:
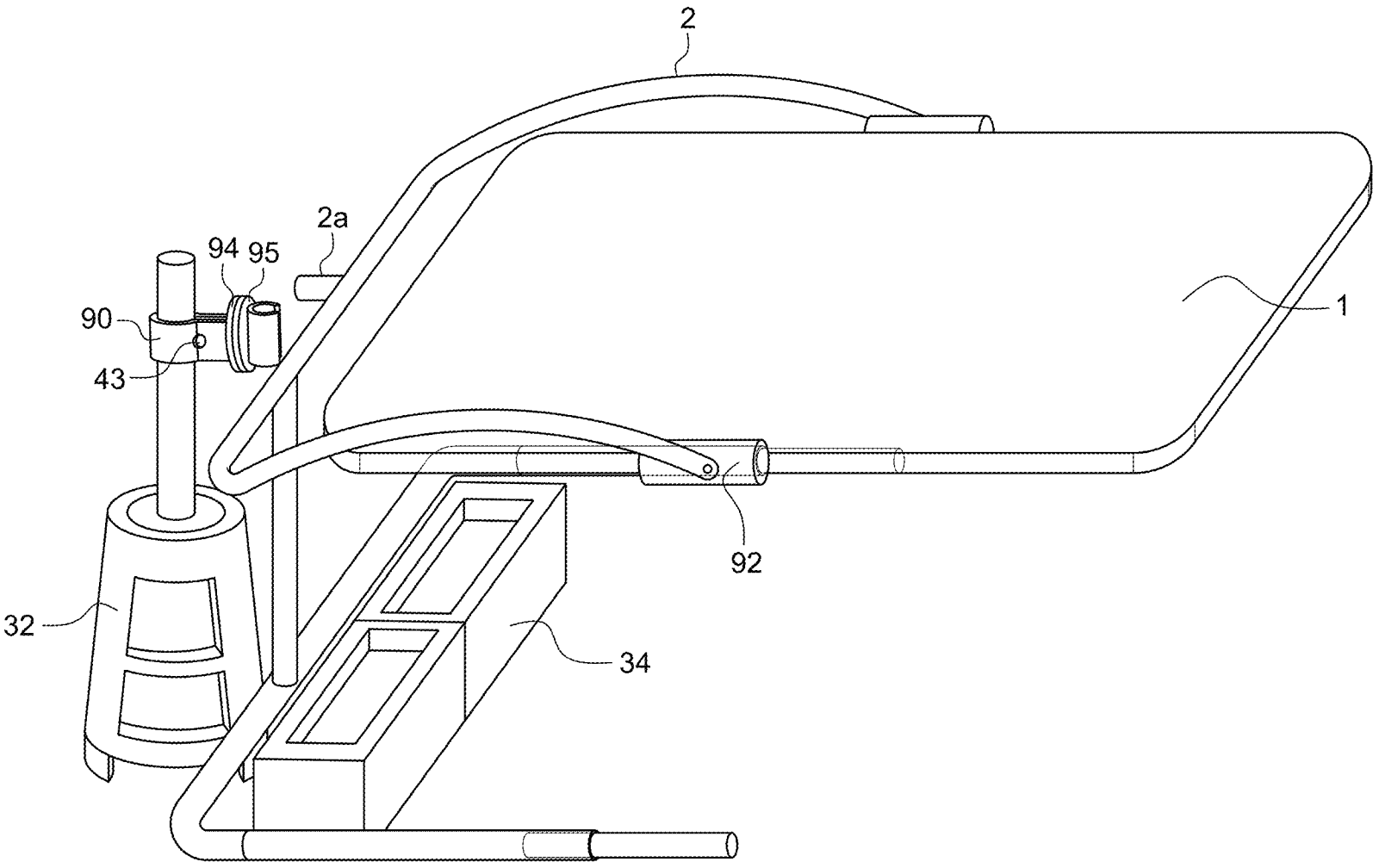
FIG. 39 is a schematic of an embodiment of a portion of a sunshade/shield sunshade/shield in perspective view.

FIG. 39 illustrates the sunshade/shield of FIG. 1, further comprising utility and/or personal compartments 32 and 34, the tilt adjuster/leg height/gooseneck rotator 90/94/95 which is available to raise or lower or tilt the sunshade/shield 1 one way or another when it is connected via gooseneck 13 (not shown) to yoke 2. Yoke 2 is attached to sunshade/shield 1 via sleeve 92, and storage compartment 32 surrounds leg 5.

Figure 40:
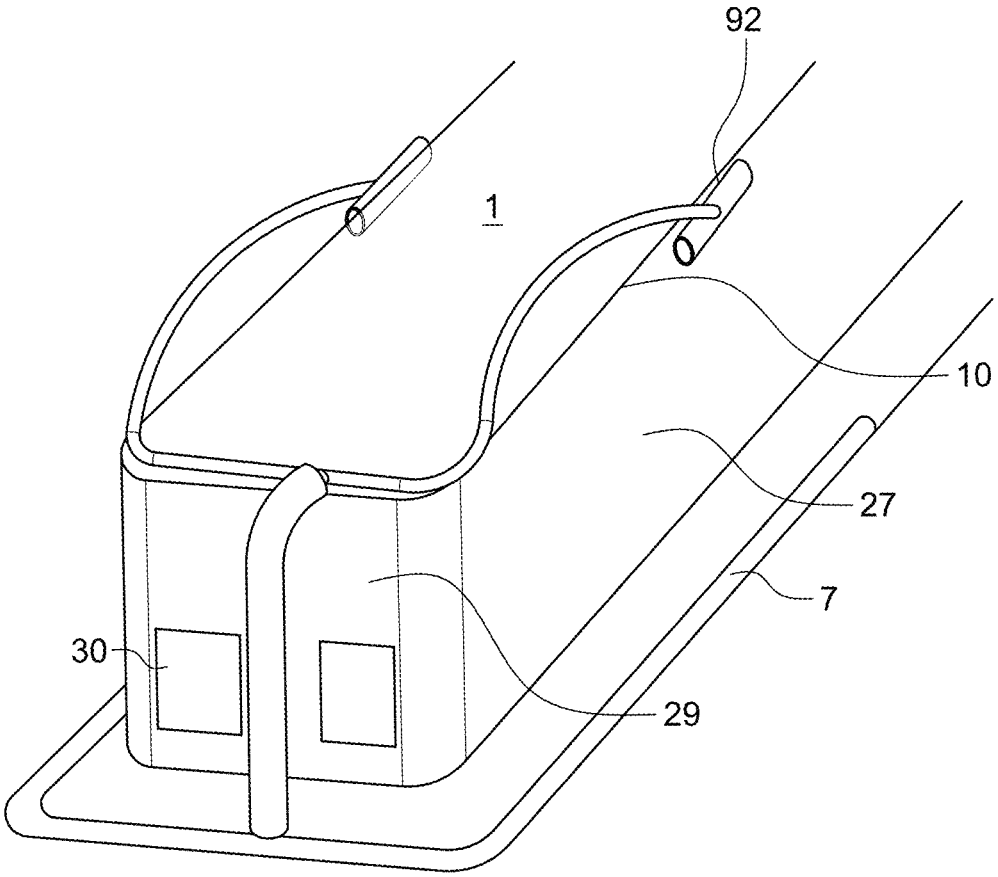
FIG. 40 is a schematic of an embodiment of a portion of a sunshade/shield showing insect netting/UV micro-mesh in perspective view.

FIG. 40 illustrates the sunshade/shield of FIG. 1, detailing insect netting/UV micro-mesh screen 27 surrounding and covering the occupant. Part 29 is the rear sunshade which attaches to leg 5 with pouches for personal items 30.

Figure 41:
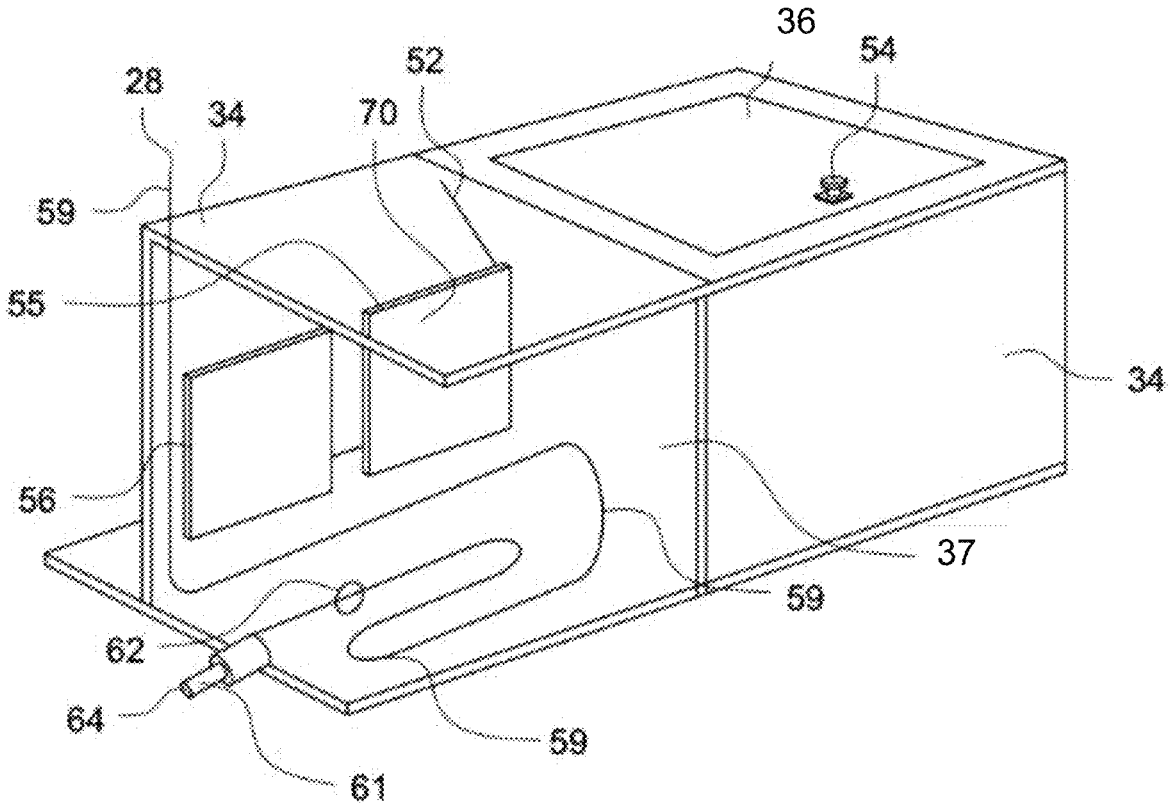
FIG. 41 is a schematic of an embodiment of a portion of a sunshade/shield showing multiple components in perspective view.

FIG. 41 illustrates the sunshade/shield of FIG. 1, detailing storage compartments 34 with two compartments 36 and 37, wherein 36 is a storage compartment with locking door 54 and parcel 37 is a utility closet, on one side showing DC controller component 55, with feed 52 to components from part 55, and solar-powered component 70 to power feed part 55, and wherein 59 is the water tubing to misters 28. Parts 61/62 and 64 are the water supply connectors, where 62 is the water filter, 61 is the utility water supply connector/reducer to increase line pressure and 59 is the tubing to the mister nozzles 28. (Not Shown) is the locking compartment for utility compartment 37. Part 36 is the personal locking compartment.

Figure 42:
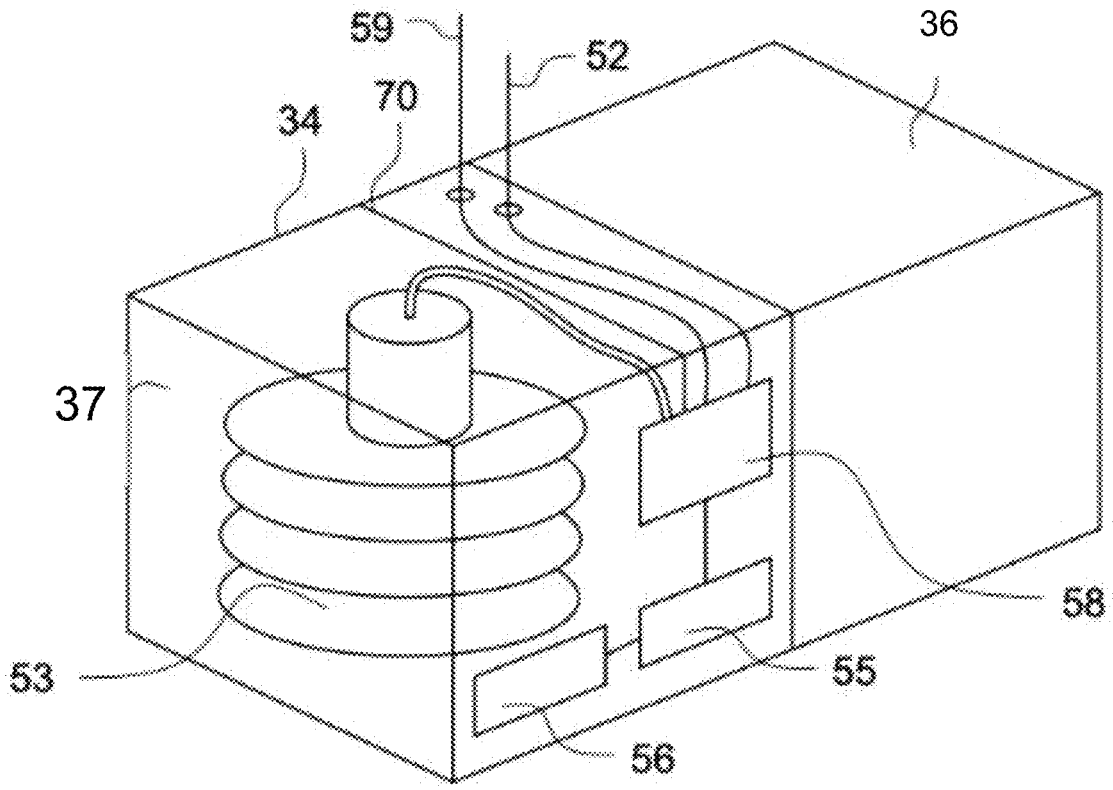
FIG. 42 is a schematic of an embodiment of a portion of a sunshade/shield showing multiple components in perspective view.

FIG. 42 illustrates the sunshade/shield of FIG. 1, although not shown in FIG. 1 which is compatible with all models of ground frame support 7 sunshades/shields, detailing storage compartment 34 with parcels 36 and 37, where 37 is a utility parcel comprising, portable refillable water container 53, battery 56, water pump 58 to increase line pressure via water tubing 59 to mister nozzles (not shown) 28, DC controller/distributor 55, DC solar feed 52, from DC source 55, to all components, solar power source 70 to feed part 55.

Figure 43:
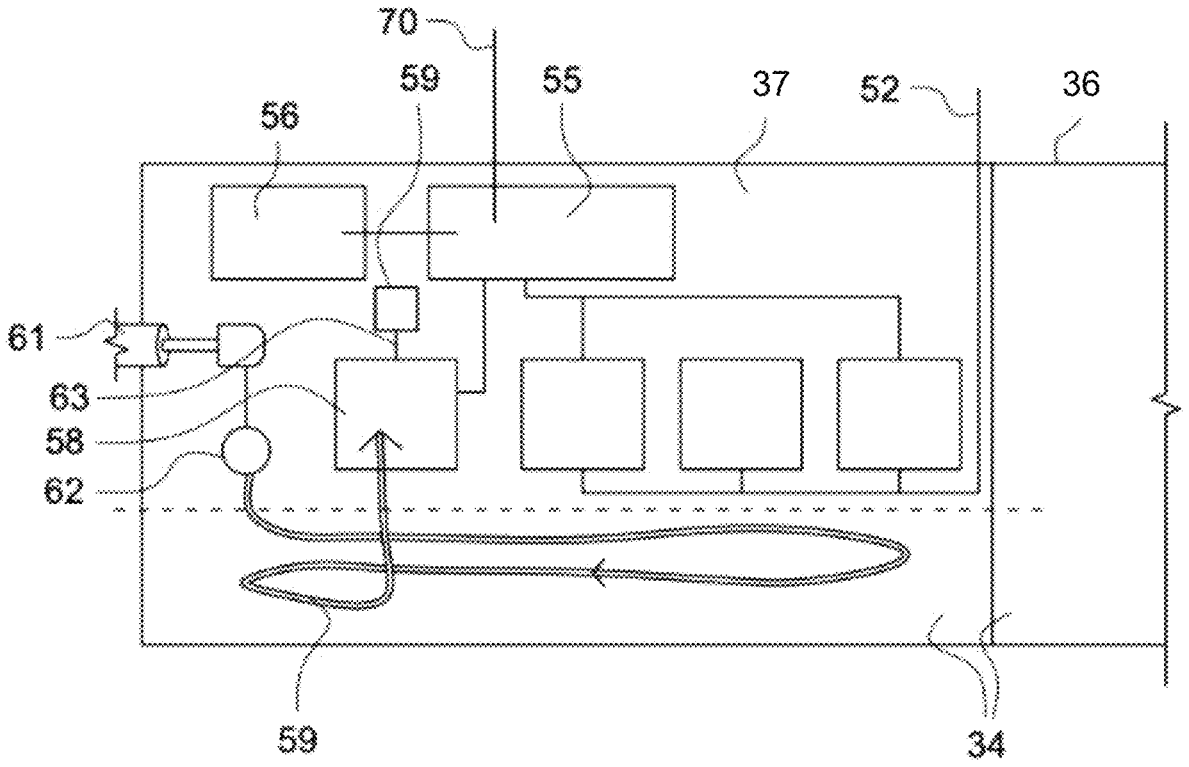
FIG. 43 is a schematic of an embodiment of a portion of a sunshade/shield showing multiple components.

FIG. 43 illustrates the sunshade/shield of FIG. 1, showing utility and personal cabinet 34 which comprised DC controller/distributor 55, utility storage parcel 37, solar power supply lines to components 59, water intake 61, solar power gauge and distribution 70, battery 56, water line filter 62, water intake 61, pump to increase water pressure 58, and utility water supply line 59.

Figure 44:
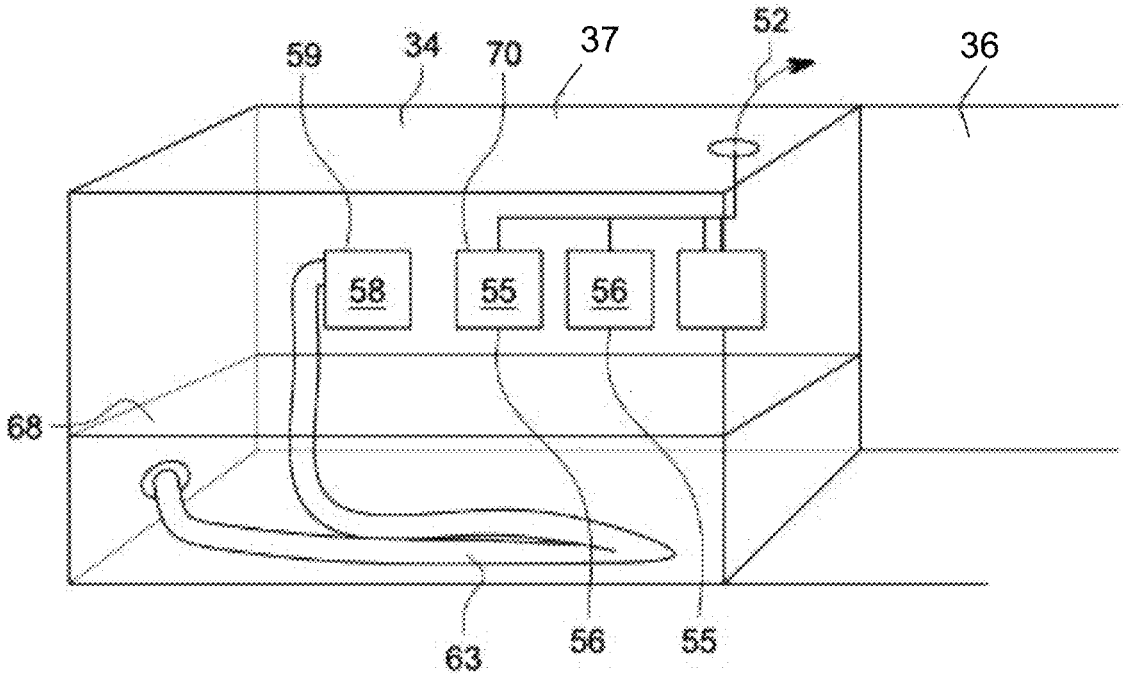
FIG. 44 is a schematic of an embodiment of a portion of a sunshade/shield showing multiple components.

FIG. 44 illustrates the sunshade/shield of FIG. 1, showing utility 37 and personal cabinet 36, water to water nozzles 28 is water pump 58 to increase water pressure and water tubing 59 to reach nozzles 28 (not shown), solar power gauge 55 fed by solar supply source 70, water tank 68 to supply contained water to source sunshade/shield water nozzles 28, DC feed 52 from solar supply to power all components and battery 56 all tucked away in utility cabinet 34, utility storage compartment 37. The water tank 68 can be filled with ice to cool down the temperature of the water spraying from nozzles 28. Water supply from hose connector 63 connects to pump 58.

Figure 45:
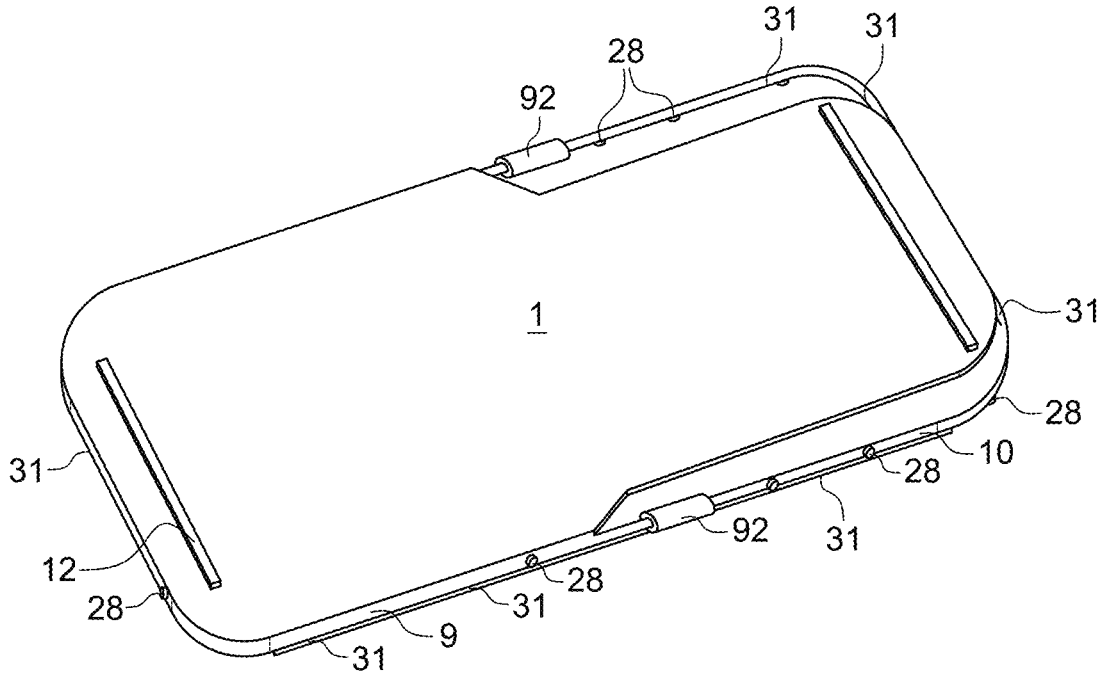
FIG. 45 is a schematic of an embodiment of a portion of a sunshade/shield showing multiple components in a perspective view.

FIG. 45 illustrates the sunshade/shield of FIG. 1, detailing string lights 31 and water nozzles 28, where string lights 31 and water nozzles 28 are attached to shade frame's part 9/10, all mounted on the edge of sunshade/shield 1.

Figure 46:
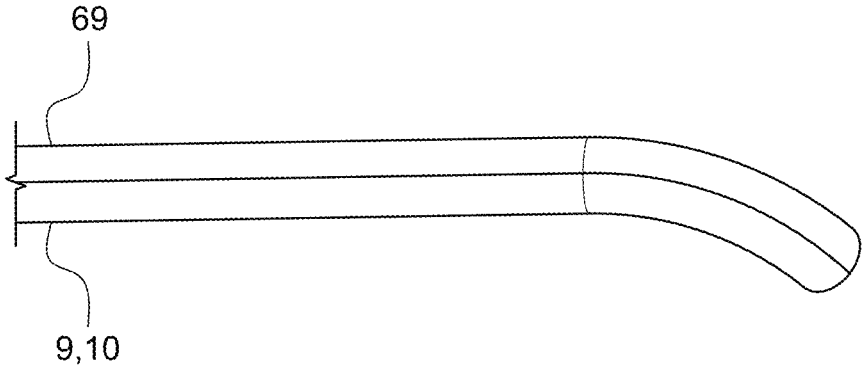
FIG. 46 is a schematic of an embodiment of a portion of a sunshade/shield showing a flexible solar panel.

FIG. 46 illustrates the sunshade/shield of FIG. 1, detailing the flexible solar panel 69, on the tubing 9/10 edging sunshade/shield 1.

Figure 47:
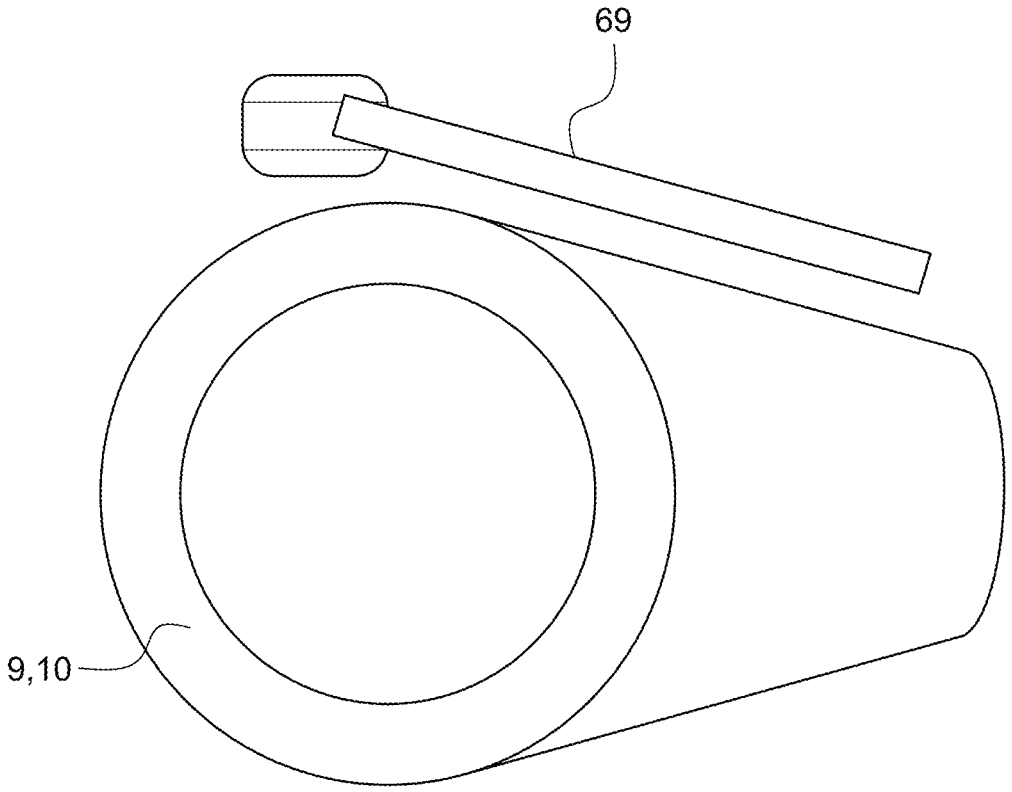
FIG. 47 is a schematic of an embodiment of a portion of a sunshade/shield showing a flexible solar panel.

FIG. 47 illustrates the sunshade/shield of FIG. 1, detailing the flexible solar panel 69, on the tubing 9/10 edging sunshade/shield 1.

Figure 48:
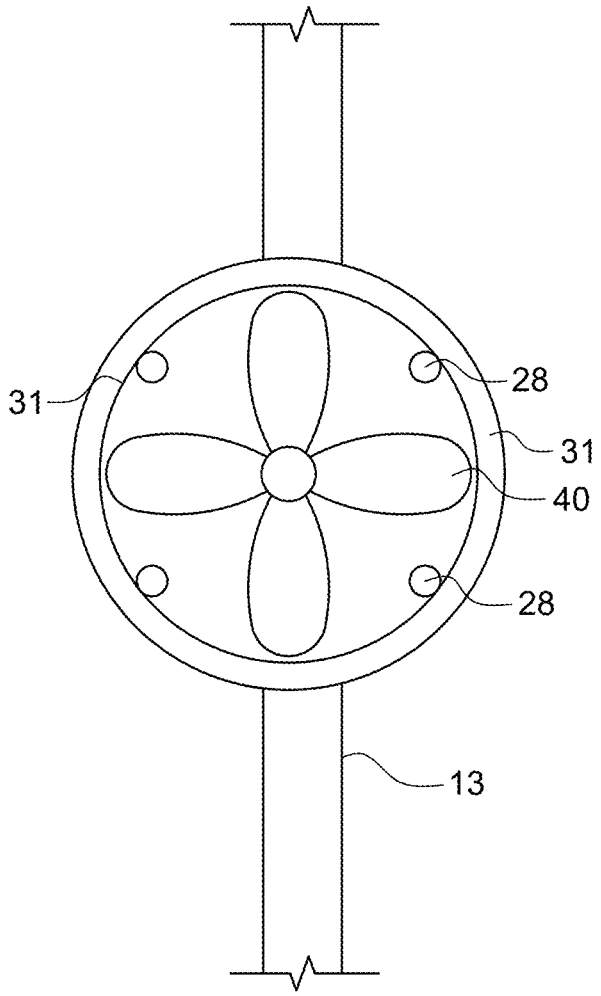
FIG. 48 is a schematic of an embodiment of a portion of a sunshade/shield gooseneck shown in perspective view.

FIG. 48 illustrates the sunshade/shield of FIG. 1, detailing the gooseneck 13 with fan 40 comprising water nozzles 28 and string lights 31 surrounding the edges of fan 40.

Figure 49:
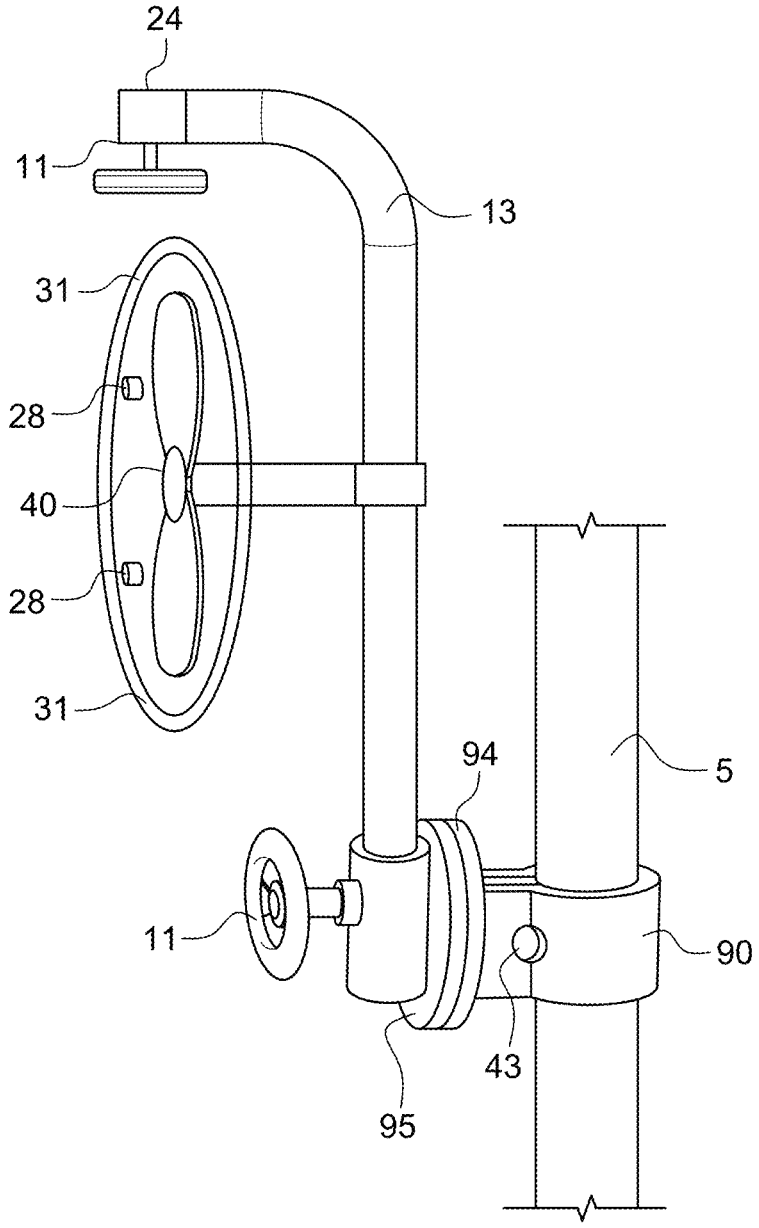
FIG. 49 is a schematic of an embodiment of a portion of a sunshade/shield gooseneck shown in perspective view.

FIG. 49 illustrates the sunshade/shield of FIG. 1, detailing the misting apparatus comprising the fan 40, blowing out water from nozzles 28, two quick release or thumbscrews 11, one ready to connect the yoke 2 (Not shown) to the gooseneck 13 via gooseneck collar 24, and the other thumbscrew to attach the tilt adjuster/leg height/goose neck rotator 90/94/95 which is available to raise or lower or tilt the sunshade/shield 1 one way or another, all mounted on leg 5.

Figure 50:
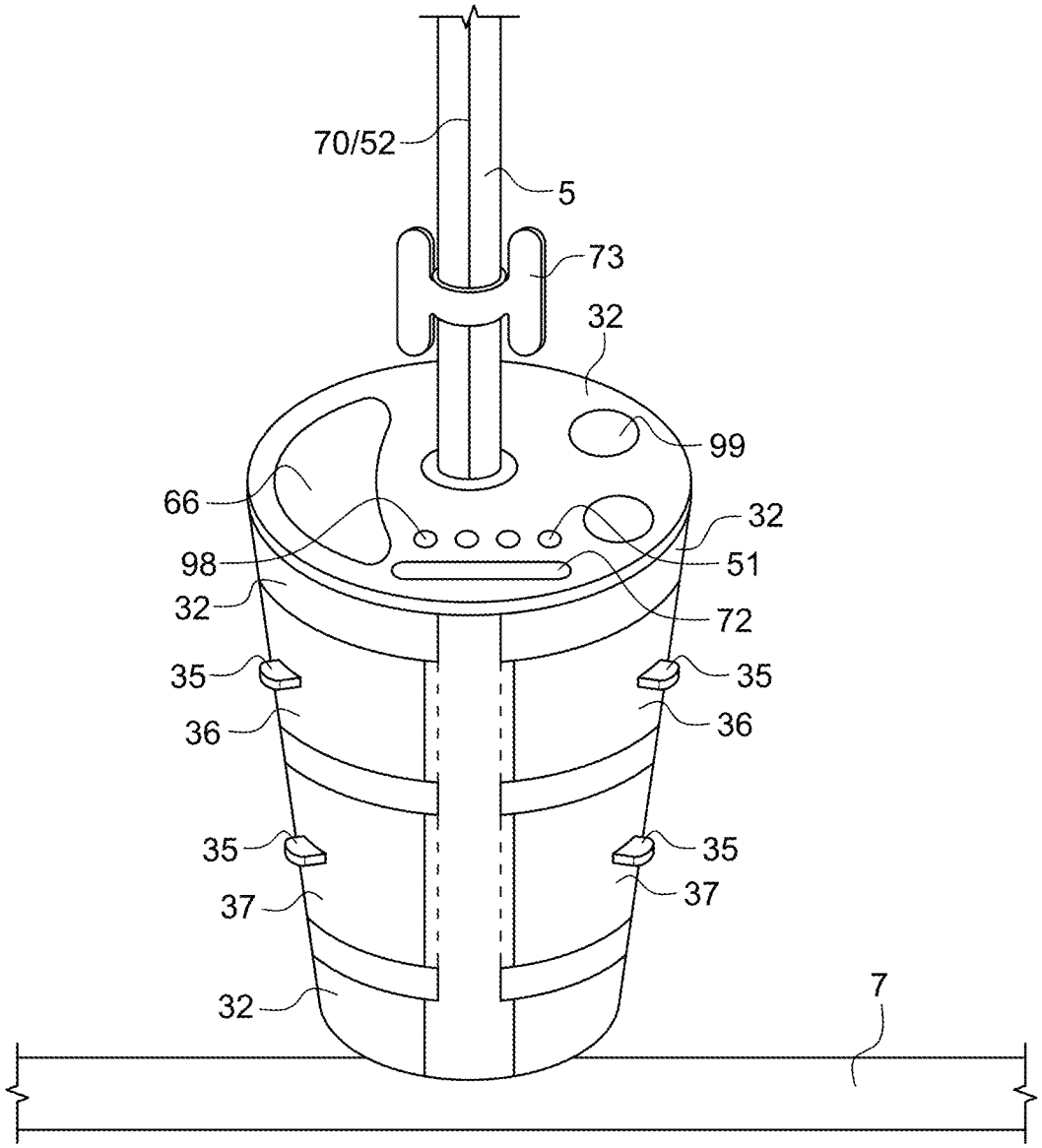
FIG. 50 is a schematic of an embodiment of a portion of a sunshade/shield leg and components in perspective view.

FIG. 50 illustrates the sunshade/shield of FIG. 1, detailing a storage compartment 32 that surrounds leg 5 and sits on ground frame 7. There are locking storage compartments 36/37 with locks 35. The top of the storage compartment 32 can be used as a dish for keys 66, glasses slot 72, cup holder 99, USB connector 51, and a USB-audio jack 98. Also shown is electronic/solar power feed, 70, and mister water supply tubing 52 running up the middle of leg 5. Speakers 73 are mounted just above storage compartment 32, which can be wireless or wired to a sound source.

Figure 51:
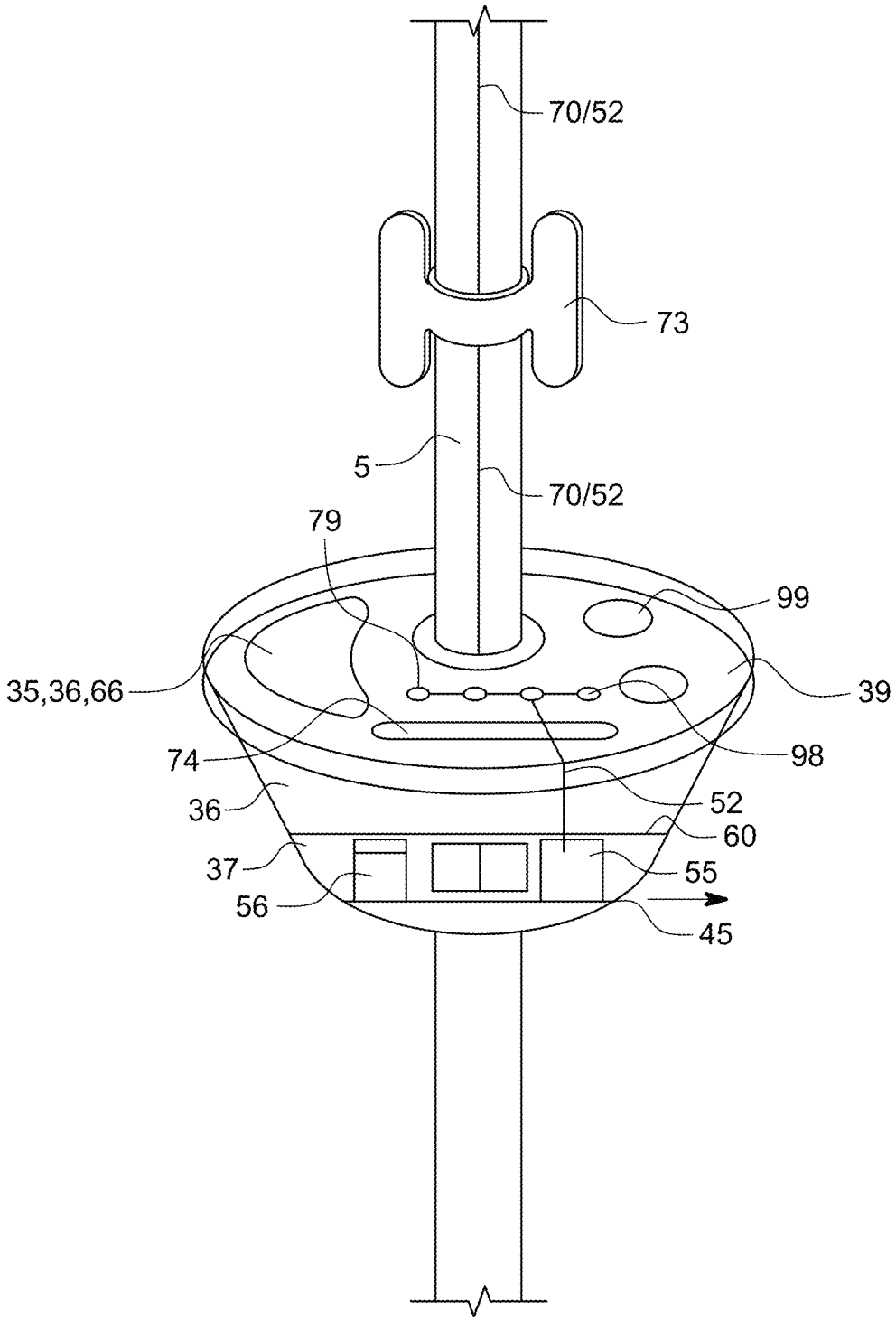
FIG. 51 is a schematic of an embodiment of a portion of a sunshade/shield leg and components in perspective view.

FIG. 51 illustrates the sunshade/shield of FIG. 1, detailing wired or wireless speakers 73 mounted on leg 5, with appliance shelf 39 mounted underneath the speakers 73. The indented dish for keys, 66, phone spot 74, cup holder 99 and USB/Audio jack 98, and the audio plug 79. A battery 56 and DC power distribution 55 are located underneath appliance shelf 39 in a lockable separate walled-off area of shelf 39 and lockable personal storage compartment 36. This power section shelf 45 is removable/accessible from shelf 39 by simply sliding the power section 45 out from under the shelf 39, for power adjustments, etc. that are needed to power plugged in devices of shelf 39. Solar power 70/DC feed source wiring and misting supply source tubing 52 running up the middle of leg 5, could feed shelf 39, and DC controller 55 can feed components requiring DC on shelf 39 also.

Figure 52:
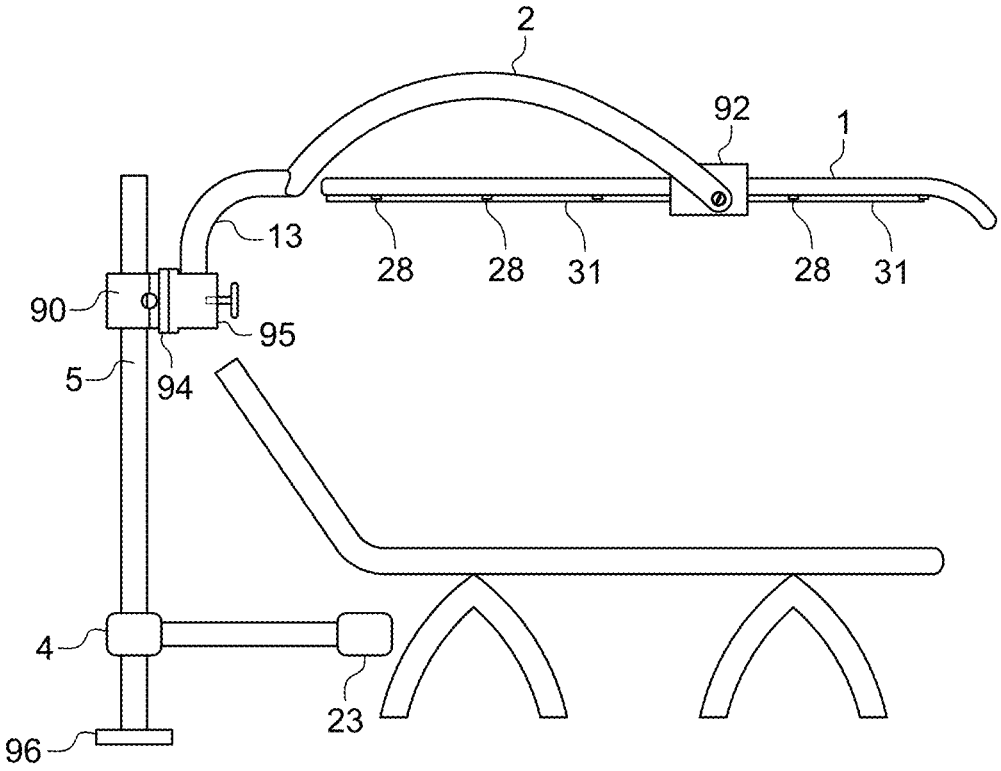
FIG. 52 is a schematic of an embodiment of a portion of a sunshade/shield and components in side view.

FIG. 52 illustrates the sunshade/shield of FIG. 1, detailing the sunshade/shield 1 with yoke 2 attached to gooseneck 13 rising above and connecting to said sunshade/shield 1, both supported by leg adjuster/rotator 90/94/95 which is also located on leg 5. Sunshade/shield 1 frame also has water misters 28 and LED lighting 31 along the bottom edge of sunshade/shield 1 to provide light and cool the occupant sitting in the chair below. The chair is connected to leg 5 via leg/chair height adjustable collar 4 and c-clamp 23 on the chair on leg 5. Leg 5 is attached to flat plate base 96

Figure 53:
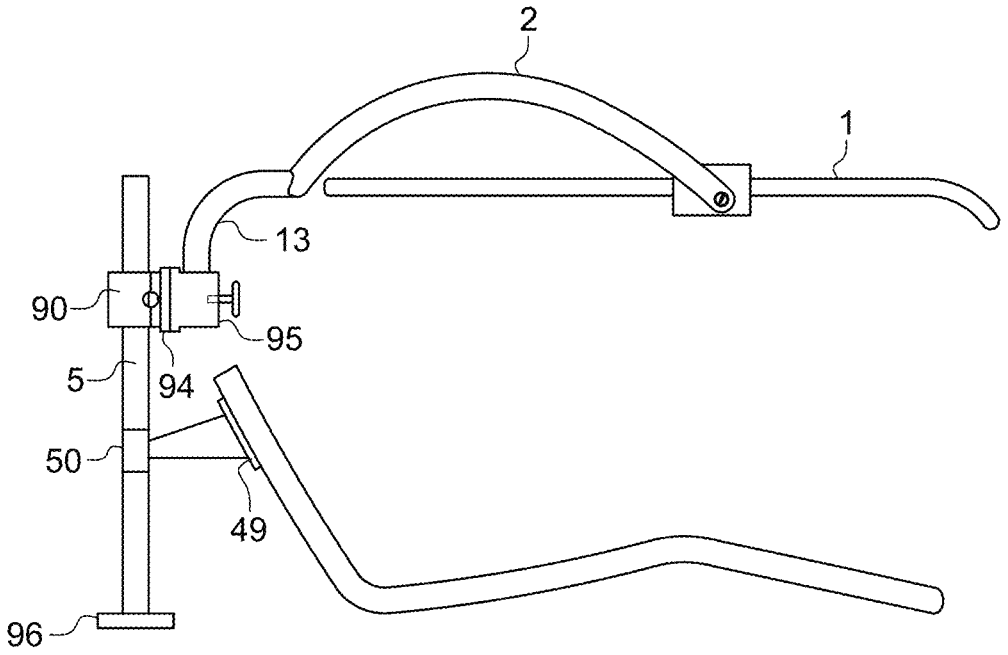
FIG. 53 is a schematic of an embodiment of a portion of a sunshade/shield and components in an in-pool application in side view.

FIG. 53 illustrates the sunshade/shield of FIG. 1, detailing an optional in-pool design, where the sunshade/shield 1 hangs over a pool chair, located in the water, connected to the leg 5 of sunshade/shield 1, via leg-to-chair attachment assembly 50 which includes in water chair mount 49 attached to the in the water pool chair. Said leg may be of shorter length, depending on chair styles structural strength and not require flat base 94 as shown. Also illustrated is the tilt adjuster/leg height/gooseneck rotator 90/94/95 which is available to raise or lower or tilt the sunshade/shield 1 one way or another, connected to sunshade/shield 1 via gooseneck 13 and yoke 2. 96 is the foot of leg 5 that sits on the floor of the pool which as mentioned above, may or may not be needed.

Figure 54:
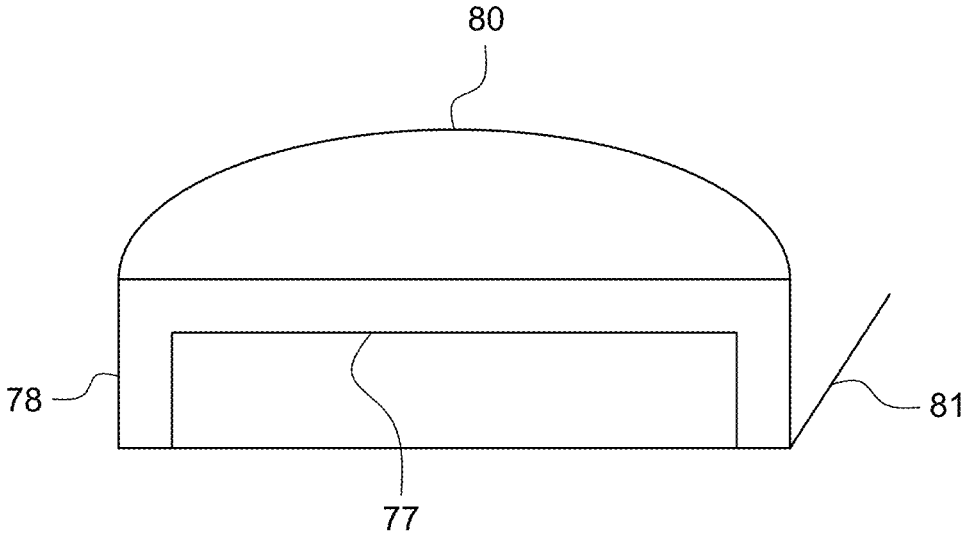
FIG. 54 is a schematic of an embodiment of a carry bag for a sunshade/shield.

FIG. 54 illustrates the sunshade/shield of FIG. 1 when disassembled, detailing a carry bag 78 with strap 80 and zipper 77 to carry to the sunshade/shield 1 to the beach.

Figure 55:
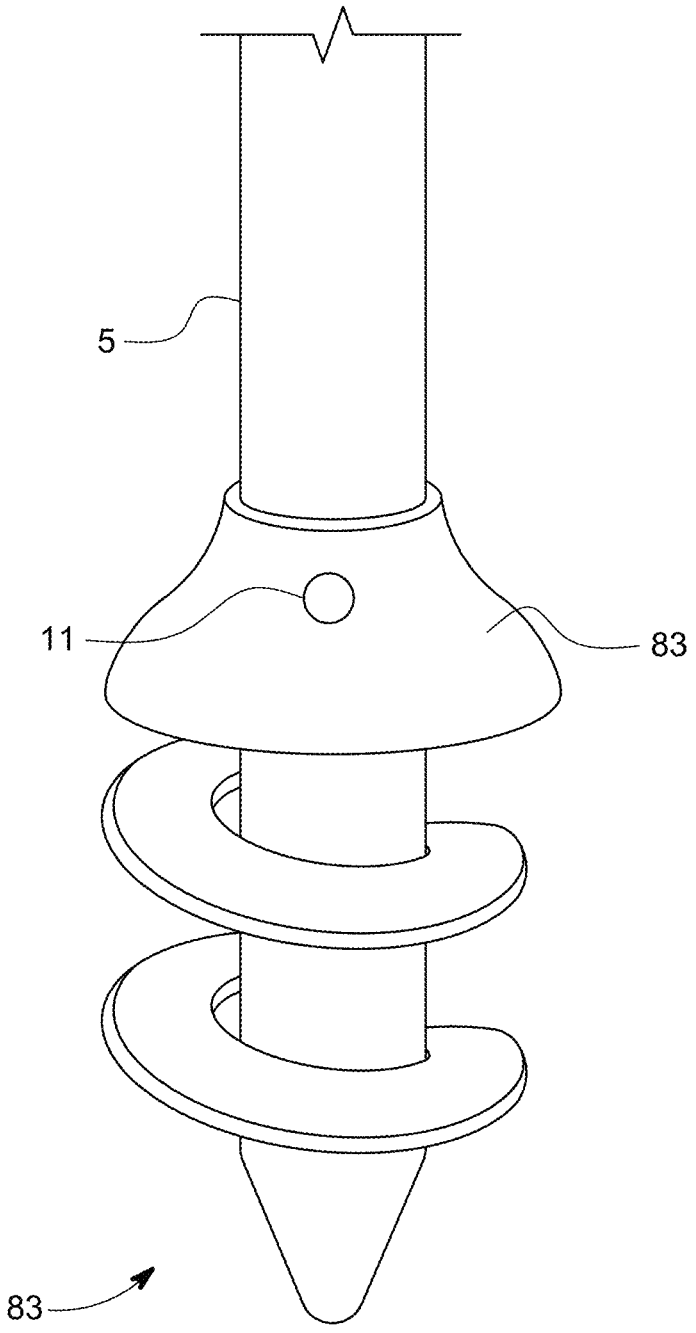
FIG. 55 is a schematic of an embodiment of an anchor for a sunshade/shield.

FIG. 55 illustrates the sunshade/shield of FIG. 1, detailing sand/ground anchor 83 to attach leg 5 firmly into the ground. There is a thumbscrew 11 that attaches that anchor 83 to leg 5.

Figure 56:
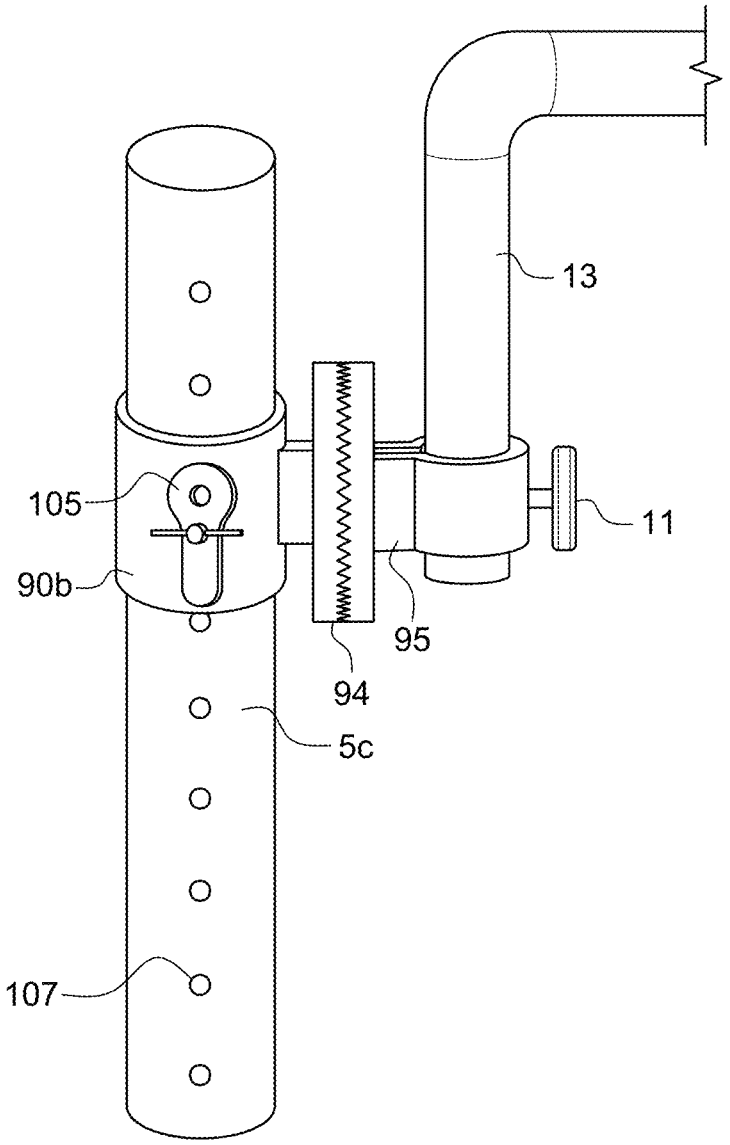
FIG. 56 is a schematic of an embodiment of a leg attachment for a sunshade/shield.

FIG. 56 illustrates the sunshade/shield of FIG. 1, detailing an alternative to the tilt adjuster/leg height/gooseneck rotator 90/94/95 means, is a push/pull button type fixation 90*b* and 105 means for leg 5*c* using part 94 as a leg attachment, connected to gooseneck 13 via collar 90*b* which allows the sunshade/shield 1 assembly to raise and lower. Also shown is interface 105 for quick release design with push button receiving hole 107 for part 105, part 105 securing the location of 94/95 controlling rotation of gooseneck 13 and yoke (not shown).

Figure 57:
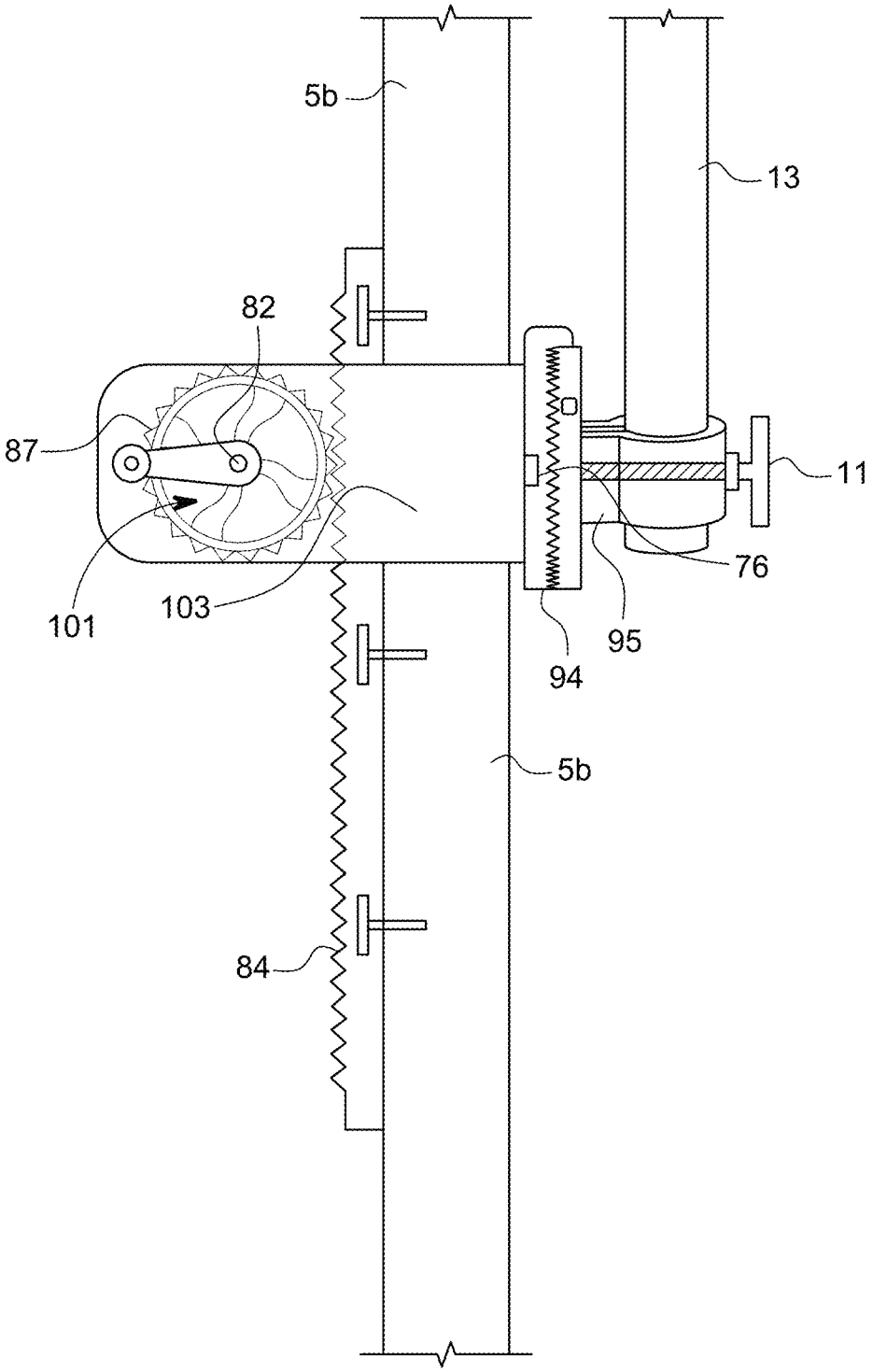
FIG. 57 is a schematic of an embodiment of a leg embodiment with an assembly to raise and lower shown in cross-section.

FIG. 57 illustrates the sunshade/shield of FIG. 1, detailing a cog/crank 87 centered on crankshaft 82 that when cranked interfaces with rail 84 to adjust shades height and rail 84 mounted on a leg 5*b*, which holds a cog roller interface 103 with crank assembly 101. In shown but designed to raise and lower the shade assembly is a DC powered motor replacing the hand crank to raise and lower said shade assemble. This design comprises a DC-powered right angle motor (not shown) or crank 87 with cog teeth 87 to interface with rail 84. Also shown is crankshaft hole 82 which holds crank assembly 101 in place on the cog roller interface surrounding leg 5*b* part 103.

Figure 58:
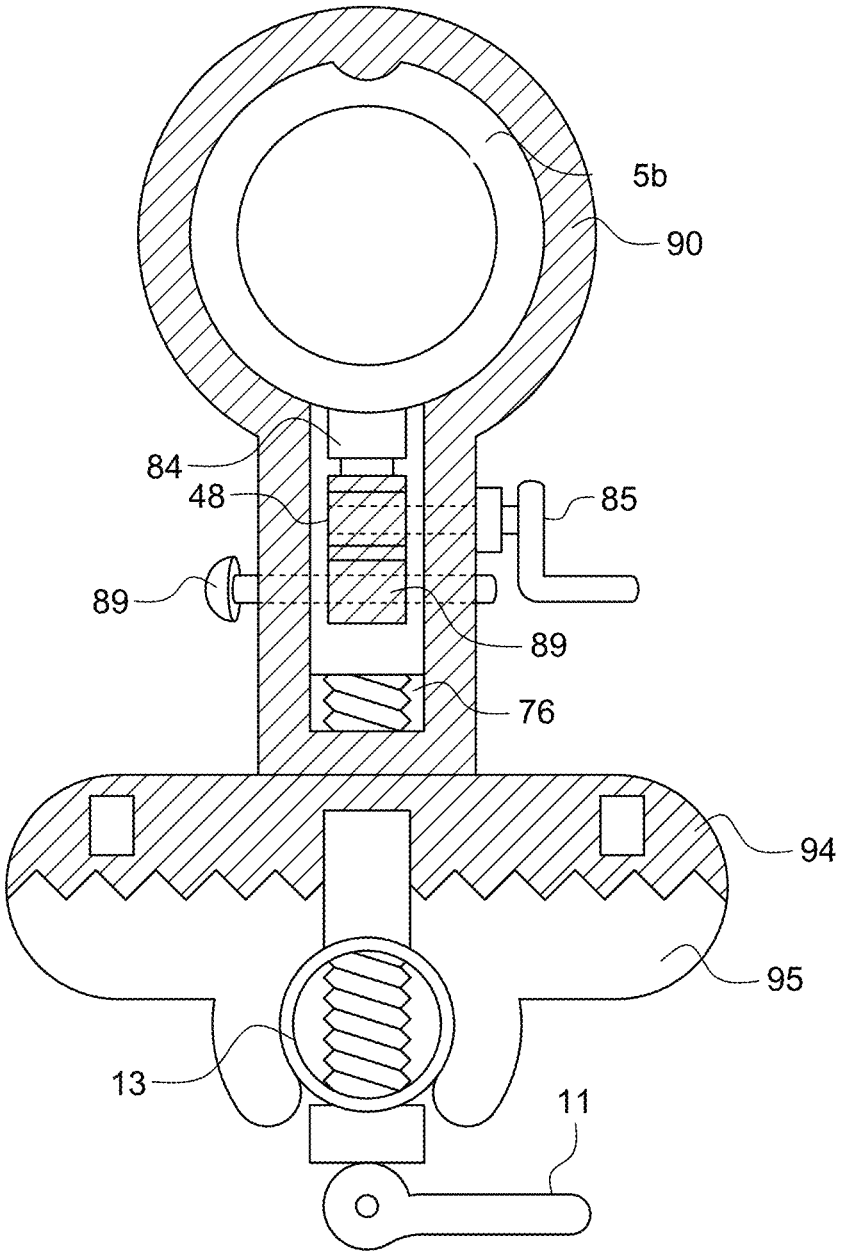
FIG. 58 is a schematic of an embodiment of a portion of a sunshade/shield leg assembly in cross-section.

FIG. 58 illustrates the sunshade/shield of FIG. 1, detailing FIG. 57, showing the rail 84 attached to leg 5 via rotator to leg assembly 90*a*/94/95, the cog roller interface 48 w/crank 85 and safety push pins 89 to prevent unintended height changes which lock the cog roller interface. Also shown is gooseneck 95 housing with interfacing teeth to mesh with the rotator leg assembly 94 and thumbscrew/quick release lever 11 which controls rotation of gooseneck 13 and shade/sunshield 1. The 2 square boxes shown in part 94 and the rectangular shape incorporated in part 95 shown are rotational limiters that limit the degree of rotation possible of gooseneck 13 and yoke 2 components of shade/sun shield 1.

Figure 59:
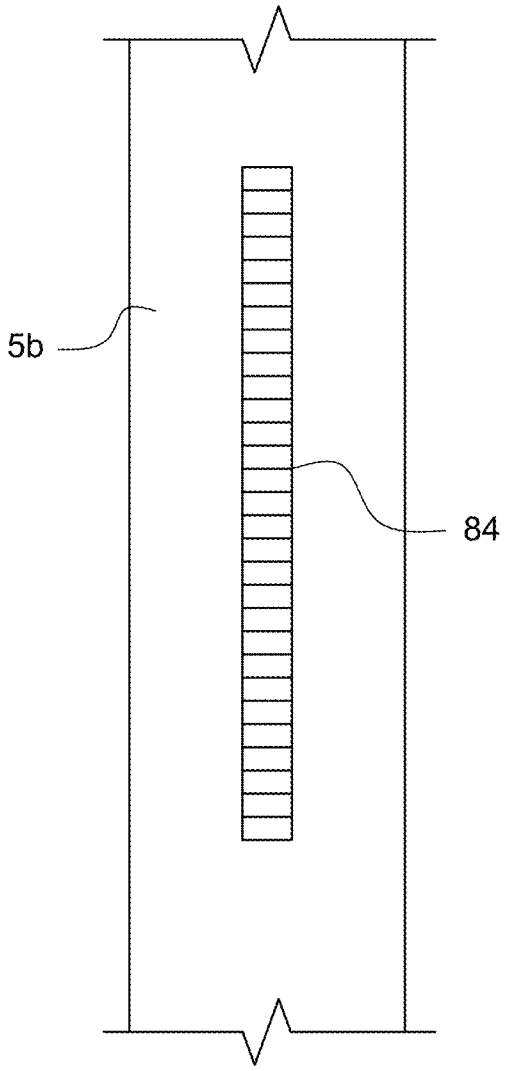
FIG. 59 is a schematic of an embodiment of a portion of a sunshade/shield leg assembly in cross-section.

FIG. 59 illustrates the sunshade/shield of FIG. 1, detailing the frontal view of gear track/rail (pinion rail) 84 mounted on the face of leg 5*b*.

Figure 60:
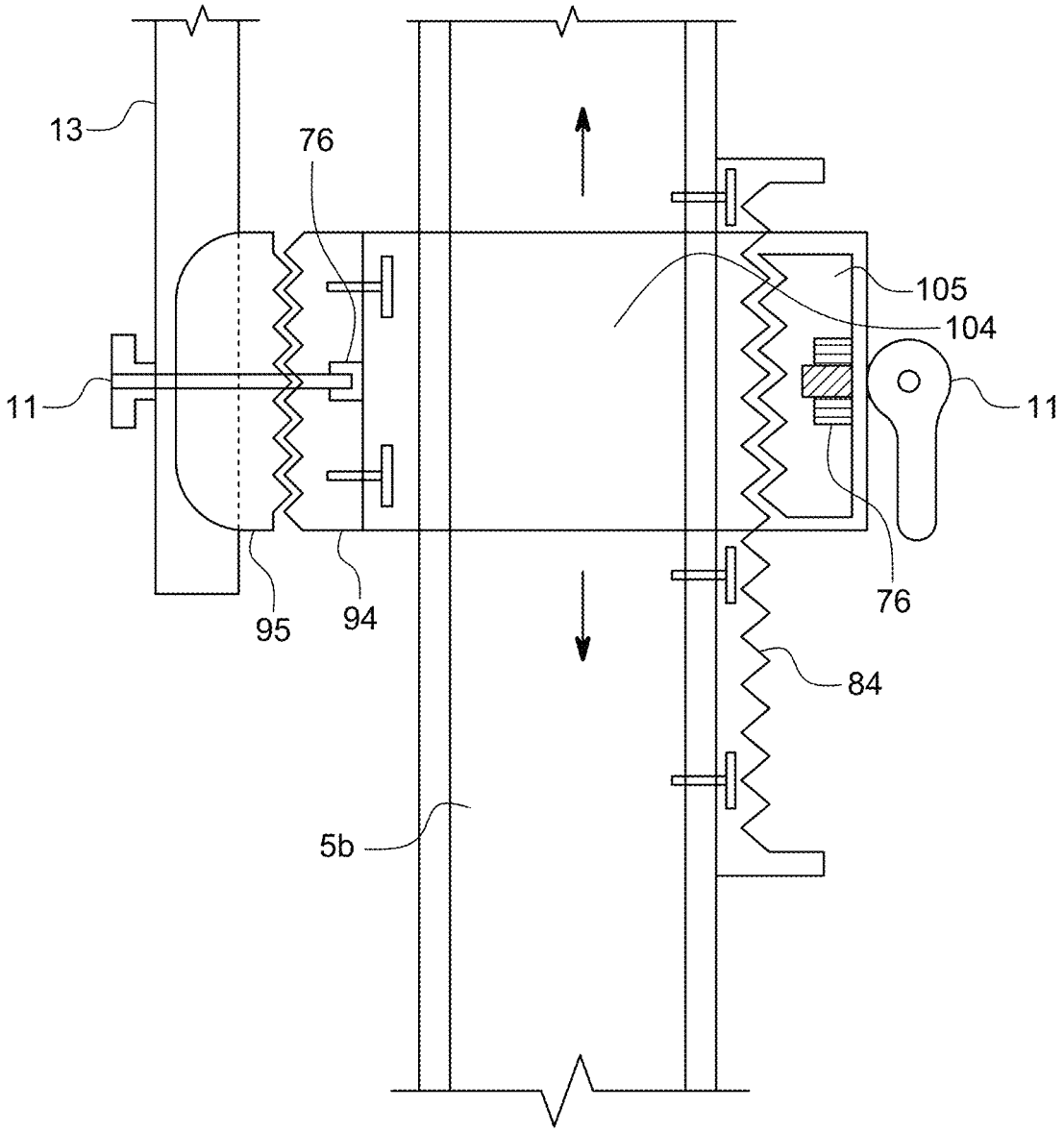
FIG. 60 is a schematic of an embodiment of a portion of a sunshade/shield leg assembly in cross-section.

FIG. 60 illustrates the sunshade/shield of FIG. 1, detailing the side view of the cog rail 84 mounted on leg 5*b* with height adjustment rail collar 104 and rail interface 105 for quick release 11. Also shown is gooseneck 13 and rotator disc 95 interfaced with part 94.

Figure 61:
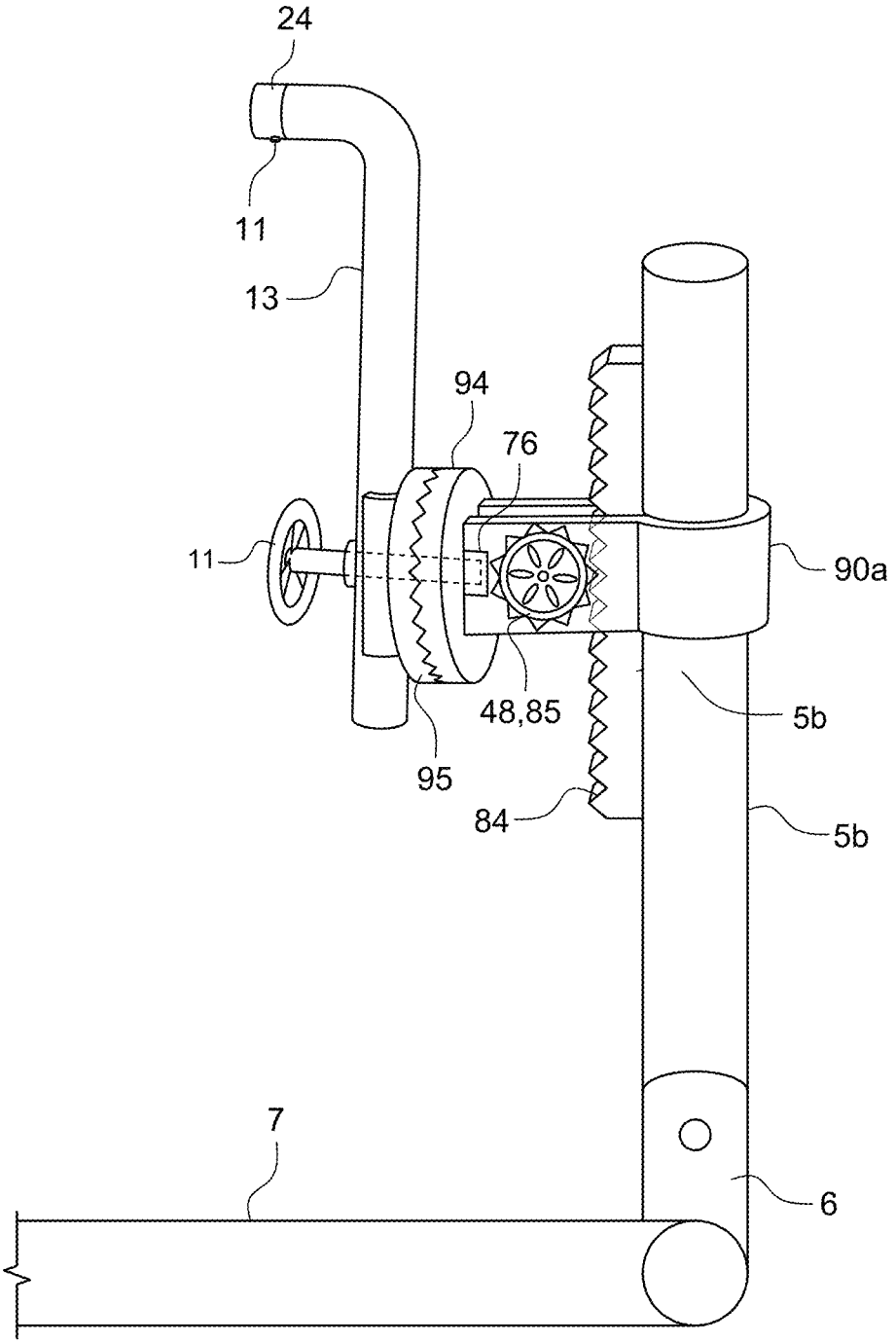
FIG. 61 is a schematic of an embodiment of a portion of a sunshade/shield leg assembly in cross-section.

FIG. 61 illustrates the sunshade/shield of FIG. 1, detailing a method of adjusting the height and rotating the sunshade/shield 1 with tilt adjuster/leg height/gooseneck rotator 90/94/95 and rail 84 and gear assembly 48/85 and housing to cog rail 84.

Figure 62:
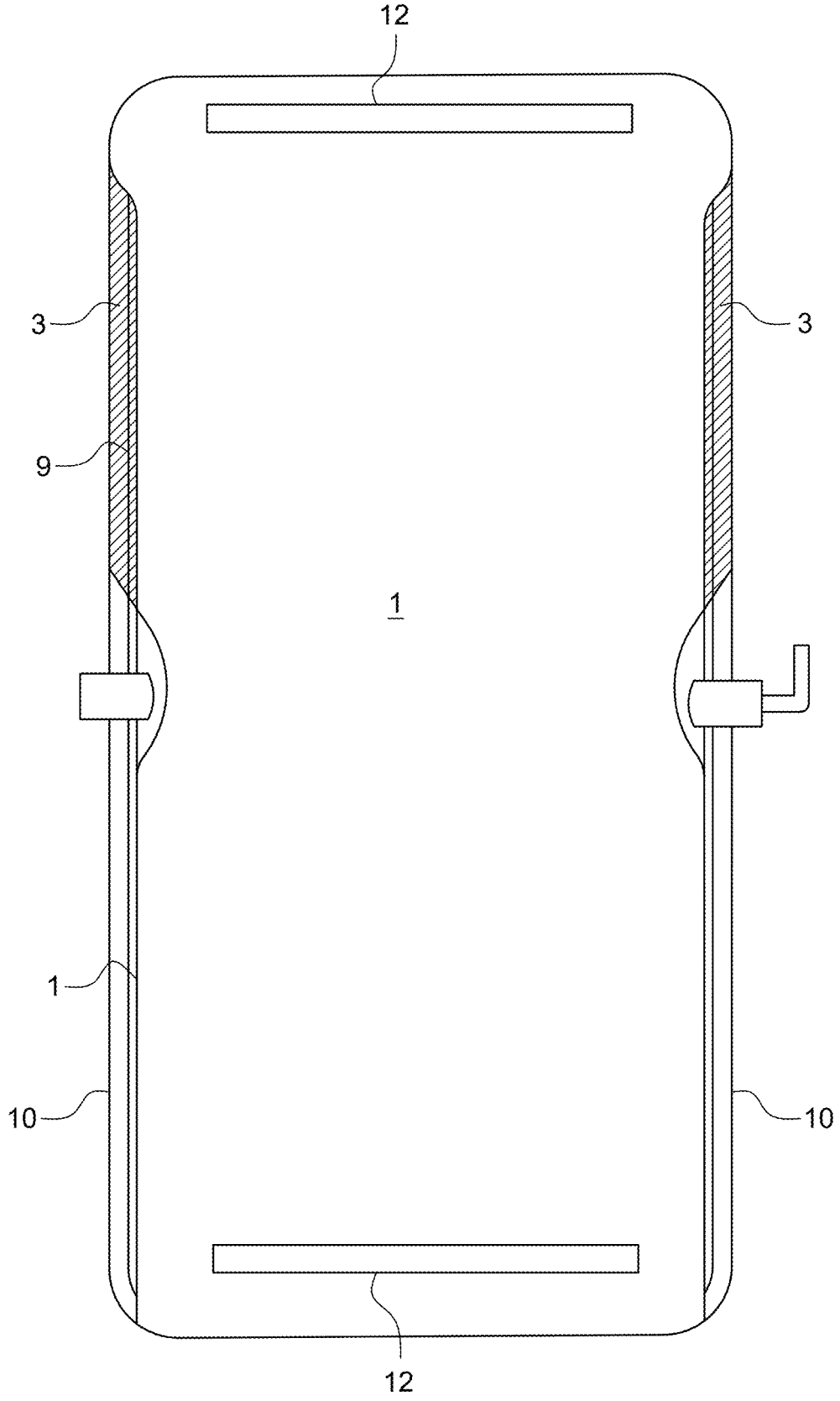
FIG. 62 is a schematic of an embodiment of a portion of a sunshade/shield shade frame assembly from top view.

FIG. 62 illustrates the sunshade/shield of FIG. 1, detailing the shade frame pocket 3 which part 9 slides into to create said shades shape the top edges of sunshade/shield 1 and 1*a*.

Figure 63:
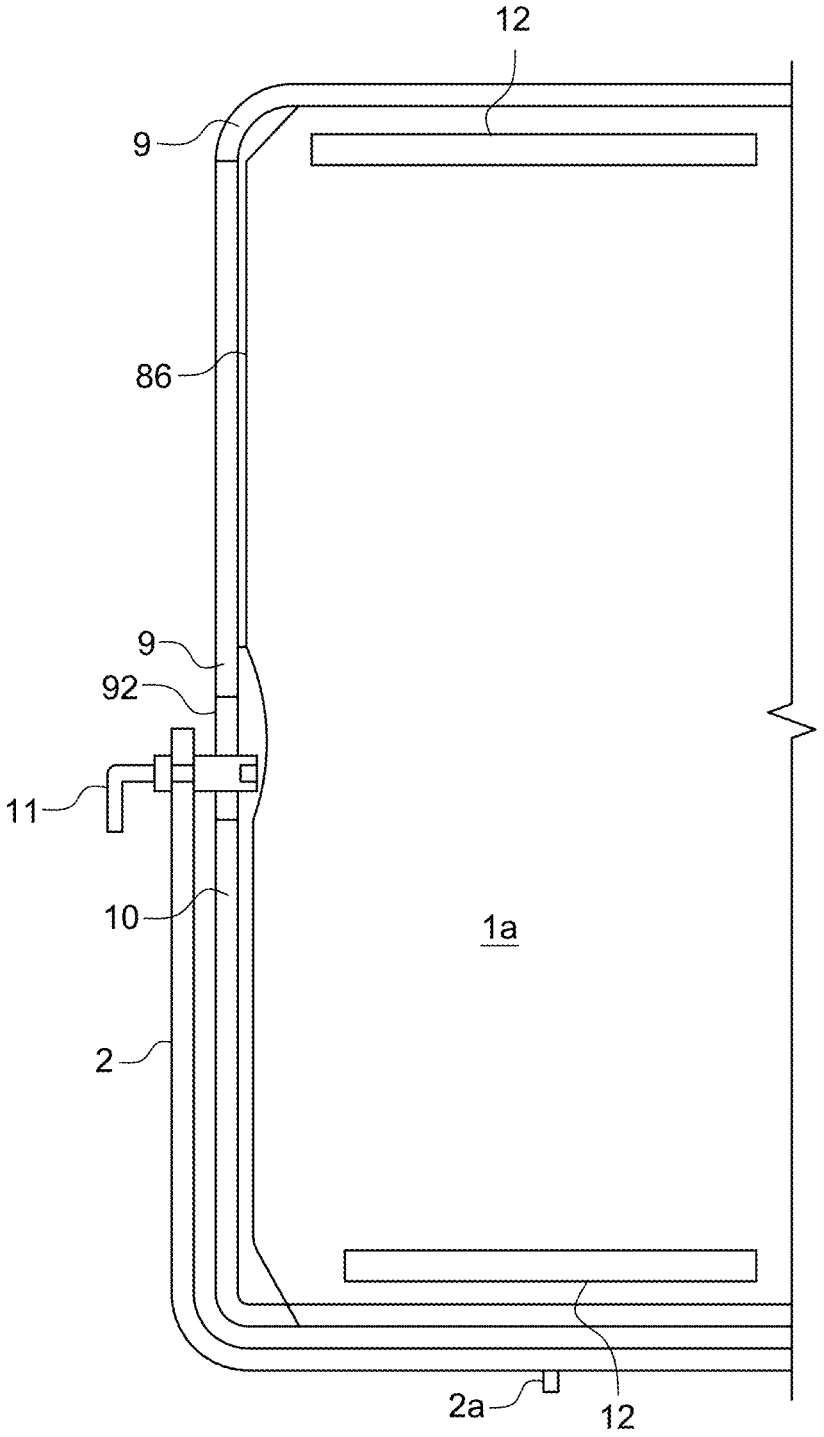
FIG. 63 is a schematic of an embodiment of a portion of a sunshade/shield shade frame assembly from top view.

FIG. 63 illustrates the sunshade/shield of FIG. 1, adding a rope edge 100 instead of sleeve part 3, which is held in place by attaching part 86 to part 9 to the sunshade/shield 1*a* that runs along the inside length of part 9 frame with a rope edge in track 100.

Figure 64:
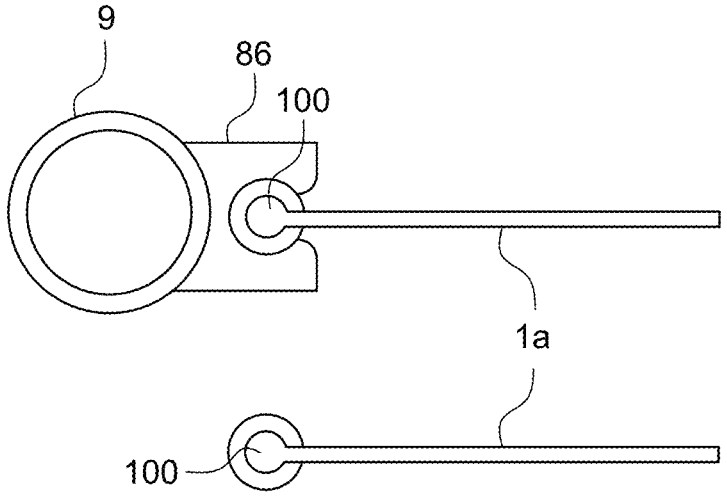
FIG. 64 is a schematic of an embodiment of a portion of a sunshade/shield edge assembly in a cross-section view.

FIG. 64 illustrates the sunshade/shield of FIG. 1, the sunshade/shield edge 9 has a rope 100 running along a shade 1*a* rope edge track 86 along the entire far edge of shade 1*a*.

Figure 65:
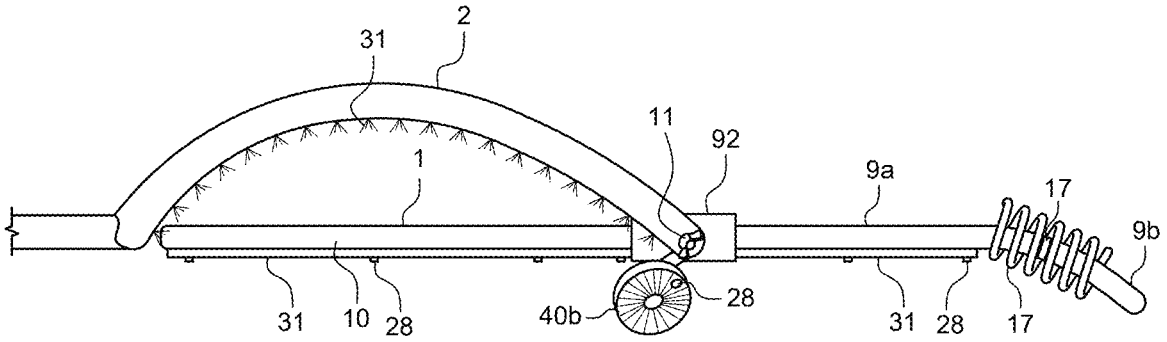
FIG. 65 is a schematic of an embodiment of a portion of a sunshade/shield showing component attachments in a perspective view.

FIG. 65 illustrates the sunshade/shield of FIG. 1, adding LED lights 31 to yoke 2, and misters 28 to edge of 9*a*/10 of sunshade/shield 1, and fan 40*b* with misters 28, attached to yoke part 2 via thumbscrew 11, and further LED lights 31 continue along a front 9*a* edge of sunshade/shield 1 and shade front frame drop nose knuckle joint 17 forces the front end of shade/shield 1 to drop down.

Figure 66:
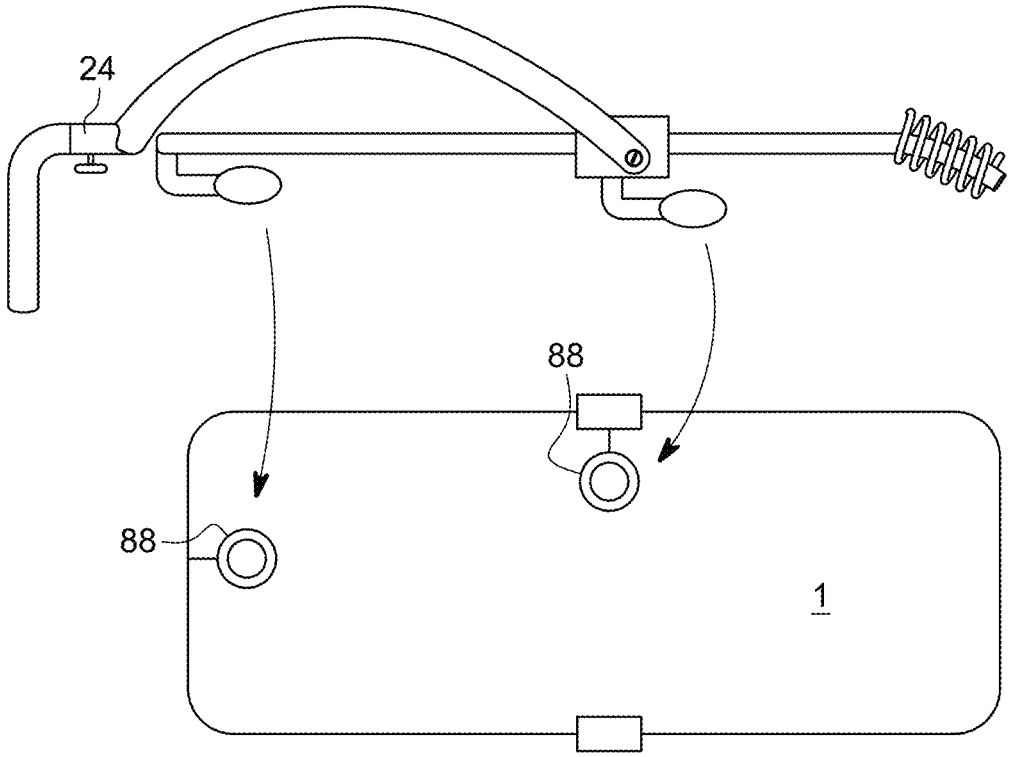
FIG. 66 is a schematic of an embodiment of a portion of a sunshade/shield showing component attachments from a top view.

FIG. 66 illustrates the sunshade/shield of FIG. 1, adding UV level indicators 88 which can be attached by wireless apps to audio/visual alert systems to show or tell worn users of the UV rays they are exposed to and take heed of the levels. This system can also include an audible timer set by the users alerting them of the time they are under the shade. This is a warning timer system for users who fall asleep as an example need. Remember the indirect rays one is exposed to are dangerous too. So those who think they are truly safe being in the shade must be mindful of indirect ray exposure. Part 88 UV rays' sensors are mounted just under sunshade/shield 1 in multiple places and interface with the device's alert mechanism.

Figure 67:
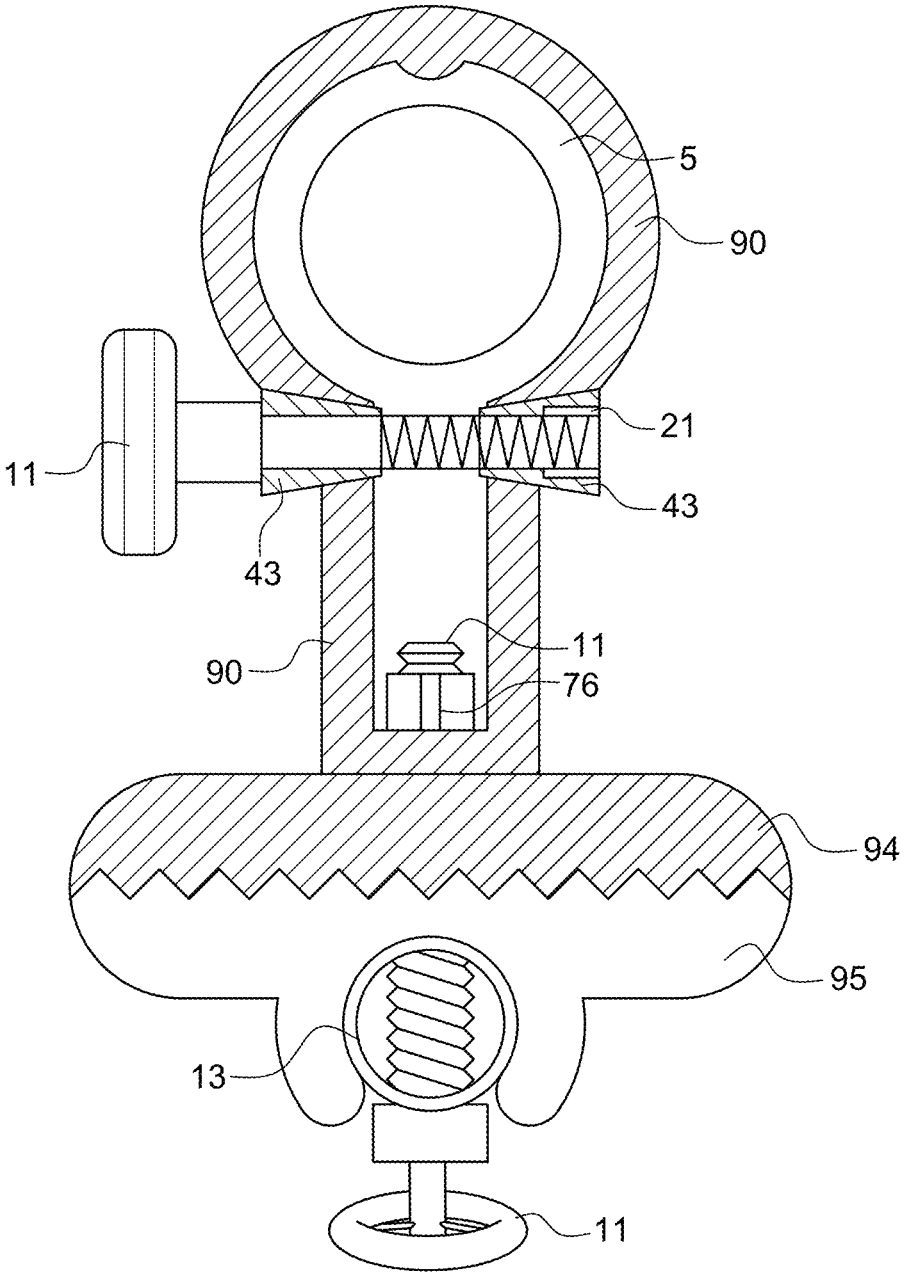
FIG. 67 is a schematic of an embodiment of a portion of a sunshade/shield rotator component in cross-section.

FIG. 67 illustrates the sunshade/shield of FIG. 1, detailing the tilt adjuster/leg height/gooseneck rotator 90/94/95, showing that as thumbscrew or quick release lever 11 is turned within the threaded insert 21, 43 filets tighten or loosen the assembly 90/94/95 to leg 5. Loosen this thumbscrew 11 and the tilt adjuster/leg height/gooseneck rotator 90/94/95 can move up and down and rotate or can be stopped from moving up or down or rotating.

Figure 68:
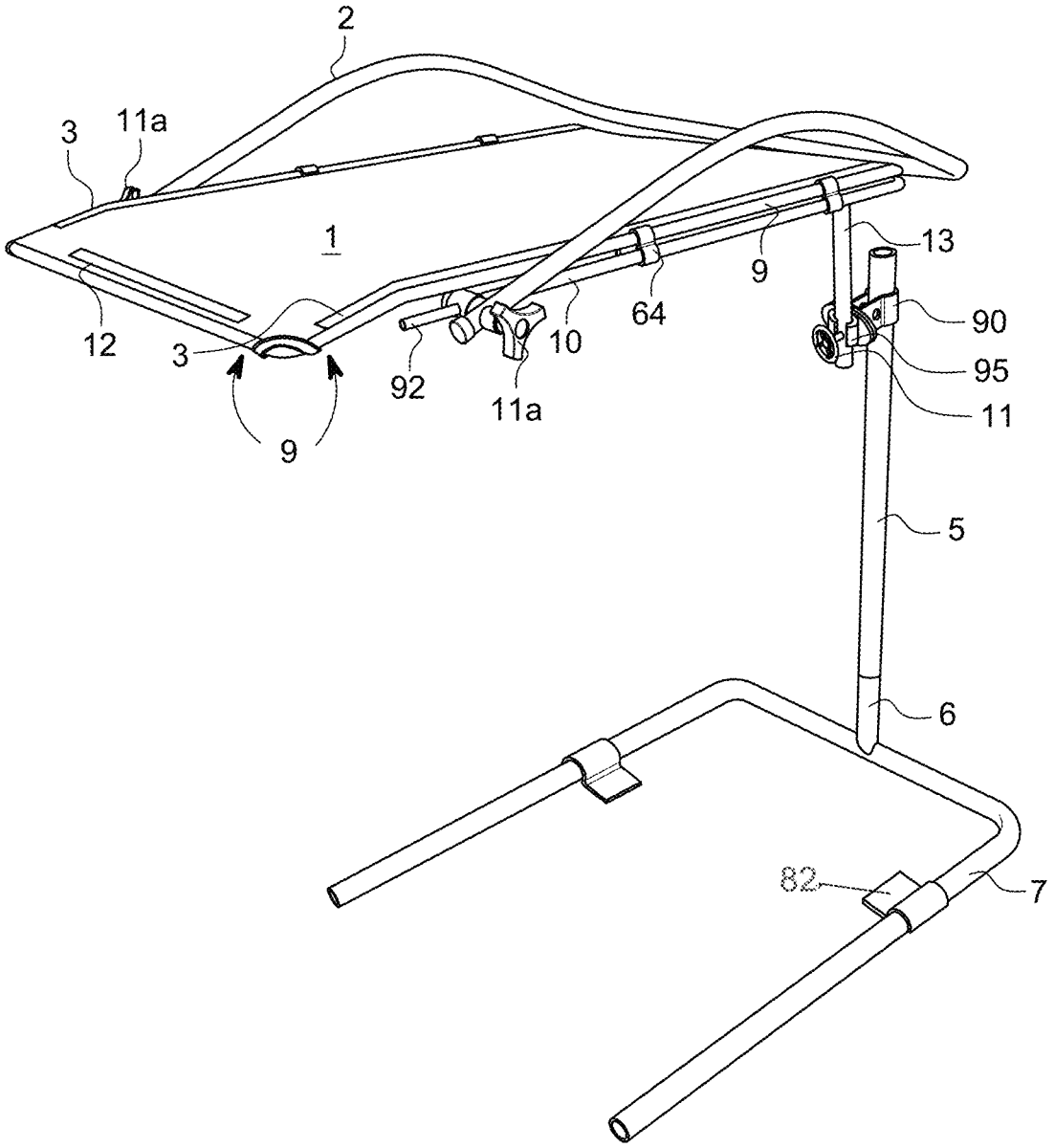
FIG. 68 is a schematic of a sunshade/shield embodiment shown in a perspective view.

FIG. 68 illustrates the sunshade/shield of FIG. 1, detailing a shorter version of sunshade/shield 1 where the front edge of sunshade/shield 1, gets disconnected from 92 (which usually connects the yoke 2 to sunshade/shield 1 front edge 9) and lies on top of sunshade/shield 1 back edge 10 thereby shortening sunshade/shield 1 by a good amount.

The invention improves on existing technologies because it's more effective shade creating products as stated above. It also handles wind and bad weather better by its aerodynamic design and porous weave shade which allows the wind to pass thru it versus capturing the gust.

It has the option of user comfort features such as solar power by offering a wide variety of solar powered components can be connected to with my design. An example being panels that are rigid in structure and attached to the frame, flexible and more discrete flexible solar panels can be incorporated in the shade/shield or a shade/shield that is made of solar collection material. The misting/fogging feature may be attached to the fan located on the leg or shield yoke. A blower system design is in the before mention utility compartment with tubing attached to the leg, gooseneck, or yoke. In some cases, users will be able to by hand the direction of the tubing exhaust. To capitalize on the flash evaporation capabilities, the misting/fogging nozzles can be in front of the fan or blower fan tubing exhaust. The forced air greatly increases the effectiveness of the water droplets creating flash evaporation process. Another option allows the users directing the mist/fog nozzles via handheld tubing.

Residential and commercial owners/guest as a hospitality service or rental like at the beach are all potential end users. Commercial buyers want to offer their guest the best experience possible. That in many cases is why they choose that specific location. Often hotels offer umbrellas around the pool or on their beach free or rent. This is where my invention can help solves their hospitality goals and guest comfort. It could also be an added revenue source by rental. They stack and store when needed or be disassembled quickly then bungie cords flat on the lounge chair in the case of inclement weather. In this case the support frame is left in its location related to the seating arrangement. The best vacation can quickly become the worst one when many unknowingly overdo their exposure to the sun. In less than 30 minutes many people burn. Remember you can burn even on a cloudy, cold day on the beach or mountain. Skin color will not the suns damaging rays or stop skin cancer developing or progressing. Anyone can damage their skin, increasing the chance of skin cancer and not know it until it too late.

This invention reduces UV exposure which cause skin cancer and damage/wrinkling of skin which may not be cancerous, provides cooler/shaded outdoor environment, reduced glare, and eye strain, offers portability and multiple location use options for hard surfaces or ground anchor for sand. Technical features like LED lighting, USB connected devices, wireless networking (e.g., Wi-Fi®), wireless technology to exchange data over short distances using short-wavelength UHF radio waves (e.g., Bluetooth®) expected by everyone today. Evaporative cooling fogging/misting, insect netting, locking personal storage, locking utility compartment for optional hose or tank/portable water container for water which may be precooled water via cooling coils which connect to the pump then reduced in diameter tubing to the nozzle/s. Increasing water pressure creates a more efficient evaporative cooling and reduces water consumption. The utility compartment will also hold electrical components and connections from solar power source to Fan/blower, USB components, LED lighting, etc.

Skin damage, skin cancer prevention starts by limiting or eliminating users UV rays' exposure. Controlled shade drastically reduces temperatures, increases users' outdoor comforts and length of time users stay outdoors. Users with preexisting medical problems are advised to limit sun exposure. Ease of use, it's size, bulk/weight and effort required move umbrella shade must be considered along with shield/seating location and seat type. My invention as described above addresses these factors. In addition to the shading factors, users today expect connectivity to electronic devices like phones, wireless networking (e.g., Wi-Fi®), wireless technology to exchange data over short distances using short-wavelength UHF radio waves (e.g., Bluetooth®), solar fan/blower feature and practical portability and assembly. I address these features via solar power connectivity, which powers optional pressure increasing pump for misting/fogging cooling which may be, interfaced with the fan/blower. LED lighting also increases the time of use during the evening. The ambience created by the lights is a nice feature in addition to creating reading light and area of light coverage. Either string style or cluster style LED lighting will be available. In addition to these features, attaching its insect netting when needed is a major creature comfort feature.

One version by design the product can be disassembled as shown in the supplied drawings and photos. Internal shock cords may be used to make assembly quick and easy. This also makes transporting size smaller and easier. An applicable carry bag is included with the model. The commercial/less portable model is designed to work with portable features are less prominent. This model still has some points of disassembly such as the ground frame.

Another feature is both commercial and residential/consumer models can be adjusted increasing or decreasing the shade/shield length via the frame design and shield adjustments. This unique feature changes a lounge chair coverage to accommodate upright chairs not requiring a longer shade/shield. Also previously stated, the ground frame can be lengthened or made wider to accommodate the user's needs.

This greatly expands the market and end users' applications. Deck, patios, and porches are examples of where this feature comes to play.

Both commercial and residential uses are limitless. The shield/shade can be used around the pool deck, patio decks, balconies, yard, campsite, and beach. The ability to use with its self-supporting ground frame, or when attached to the lounge chair or beach anchor when needed is an easy disassembly. All ages, especially senior citizens often have previous health related problems that force them to seek shade. Even children can easily adjust the device to control the sun too. NOT to be forgotten, 1 in 5 people in the US get skin cancer and as stated earlier it's found worldwide.

The shield/shade frame is extendable for added coverage or reduced coverage, depending on the sun and seating. The front shield/shade tubing slide into or out of the rear frame tubing thus extending or reducing its length and coverage.

The sun shield/shade is totally adjustable by thumbscrews to adjust to the sun and seat types. It will be available in different shade weaves and films to control the user's exposure to the sun. Open weaves or chemicals used in the film will allow some UV rays transmission for a slower more controlled tanning experience or up to 100% blockage for no exposure to direct UV rays. Optional double shade cover applications will offer the ability to turn a tanning weave to a blocking weave in minutes. No major assembly needed.

Optional Misting/fogging nozzles may be placed in front of the solar powered fan/blower exhaust area, frame mounted or handheld tubing nozzle. This will cool the users along with the shaded area seating. Solar collection devices or fabric will power the LED light, blower/fan and H2O water pump devices will be held in the utility compartments which also houses the electric system distribution. USB, wireless networking (e.g., Wi-Fi®), wireless technology to exchange data over short distances using short-wavelength UHF radio waves (e.g., Bluetooth®), audio speakers and jacks will connect to the electrical system. Detachable insect netting will increase user's experience without bugs.

The optional uses utility compartment may house portable water containers or hose connection which supply H2O for the water pump and cooling tubes which prechill the water before it is sent to the nozzles or nozzle handheld tubing. The lockable, personal storage is attached to the utility compartment for users' phones, wallet, purse, etc. or behind the leg post or under the users seating. A shelf is attached to the same leg post for drinks, glasses, etc.

This invention is a combination of extruded and injection molded plastic parts, electronic welded and sewn shield/shade UV absorbing mesh or film materials. The frame is constructed of polycarbonate, PC. Polycarbonate is available in solid color throughout the depth of the material. Because PC is rustproof, in pool use is possible. All fittings made of metal are Stainless Steel. Our designs and materials used are drastically reduced in production cost because the shapes, bends, mating parts are formed by heat and mold vs. expensive bending machinery. When fabricated, no welding is needed. The solar and misting/fogging technologies which require skilled labor to best configure the most efficient way to deliver the intended results. "Certain embodiments of present invention include but are not limited to the following description of applications, parts, and accessories." Assembly will be accomplished after the individual parts/components are acquired where needed.

While several embodiments have been shown and described, the above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments on the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Furthermore, the disclosed embodiments include a plurality of features that are described in concert but which can be used independently and/or combined with other features. The present invention is not limited to only those embodiments that include all of these features or that provide all of the stated benefits, except to the extent otherwise expressly set forth in the issued claims. Any reference to claim elements in the singular, for example, using articles "a," "an," "the" or "said" is not to be construed as limiting the element to the singular.

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

I claim:

1. An adjustable sunshade/shield for a user of a lounge chair, deck chair, beach chair, in-pool chair, pool chair, or ground cloth, or the user lying on a surface, the adjustable sunshade/shield comprising:

a. a structural frame comprising:

i. a yoke frame portion for holding a rectangular shade/shield frame portion, ii. the rectangular shade/shield frame portion holding at least one sunshade and shield, each sunshade and shield comprising fabric, UV absorbing film, rigid solar panel/s and/or solar enabled fabric, the yoke frame portion and the rectangular shade/shield frame portion being at the topmost part of the adjustable sunshade/shield when it is suspended over said user, iii. a gooseneck frame portion, the gooseneck frame portion being attached to the yoke frame portion and a leg frame portion, the gooseneck frame portion being adjustable to change the position of the yoke frame portion in order to provide shade, UV protection or UV absorbing and a shield from the sun to the user, iv. the leg frame portion being attached to the gooseneck frame portion and a bottommost portion, the bottommost portion comprising a ground frame portion, a ground/sand anchor, an in-pool chair attachment, or an attachment to a structure, v. the bottommost portion being at the bottommost part of the adjustable sunshade/shield and providing stability to the adjustable sunshade/shield, b. one or more solar collectors comprising one or more panels, films, or fabrics, each solar collector connected to a solar powered battery/power distribution device, each solar collector attached to the structural frame or sunshade and shield;

c. one or more fans connected to the battery/power distribution device, each fan being attached to the structural frame and/or flexible tubing supplied with one or more misting nozzles allowing the user to direct emitted mist, d. a water mister comprising a water supply or water storage, which may be prechilled or at ambient temperature, and a water pump, the water pump being connected to the battery, and the water mister being attached to the structural frame and/or handheld flexible tubing supplied with one or more misting nozzles.

2. The adjustable sunshade/shield of claim 1, further comprising a removeable, surrounding UV ray screen which also works as insect netting surrounding the user and attached to the structural frame;

an audio communicator comprising wireless networking, wireless technology to exchange data over short distances using short-wavelength UHF radio waves, and audio speaker connectivity that is connected to the battery;

at least one USB plug connected to the battery;

a lockable personal property and utility device storage that can be attached to the structural frame; and adjustable LED lighting connected to the battery and attached to the structural frame.

3. The adjustable sunshade/shield of claim 1, wherein the rectangular shade/shield frame portion further comprises an adjustable drop nose portion on its front for providing shade and shield from the sun when it is in front of the adjustable sunshade/shield.

4. The adjustable sunshade/shield of claim 1, further comprising:

an additional sunshade and shield that lays on the primary sunshade and shield comprising fabric, UV absorbing film, and/or solar-enabled fabric, which additional sunshade and shield frame portion is positioned on top of the primary shield/shade to effectively increase the UV protection and/or vertically to the top of the leg frame portion and/or the yoke frame portion, wherein when said sunshade and shield frame is shortened, the rear portion is rolled or dropped down the leg creating a rear shade, and a detachable separate rear shade is connected to the top of the leg.

5. The adjustable sunshade/shield of claim 1, further comprising one or more UV sensors connected to an audible and/or visual alert, each sensor being located under the shield and shade, each sensor sensing the UV levels and alerting the user if certain UV levels are reached.

6. The adjustable sunshade/shield of claim 1, wherein the bottommost rear portion on the ground frame portion comprises one or more wheels.

7. The adjustable sunshade/shield of claim 1, wherein the bottommost portion comprises one or more ground/surfaces/sand anchors, and wherein the adjustable sunshade/shield may use ground tethers to increase stability when the tethers are attached to the structural frame.

8. The adjustable sunshade/shield of claim 1, wherein the adjustable sunshield/shade is portable and the structural frame can be at least partially dissembled by moving a tubing sleeve, releasing one or more thumbscrews, operating pop-out style buttons, operating threaded interfaces, and/or operating quick-release levers.

9. The adjustable sunshade/shield of claim 1, wherein each sunshade and shield is comprised of solar enhanced fabric, mesh fabric, film, and/or UV absorbing fabric.

10. The adjustable sunshade/shield of claim 1, wherein there is a primary sunshade and shield and a secondary overlaying sunshade and shield or a combination of such.

11. The adjustable sunshade/shield of claim 1, wherein the rectangular shade/shield frame portion comprises polycarbonate, plastic-based material, powder-coated metals or a combination of such.

12. The adjustable sunshade/shield of claim 1, wherein the yoke frame portion and the rectangular shade/shield frame portion are adjustable to change their positions with respect to the sun and wherein the sunshield and shade may be shortened or lengthened to accommodate a user's location and the user's desire for more or less UV protection.

13. The adjustable sunshade/shield of claim 1, further comprising a drop-down, forward-facing shield/shade nose/frame to increase shade protection from the position of the sun when it is lower on the horizon, which is attached to the yoke frame portion.

14. The adjustable sunshade/shield of claim 1, wherein the rectangular shade/shield frame portion is at least partially adjustable in length.

15. The adjustable sunshade/shield of claim 1, wherein the ground frame portion is adjustable in length and/or width.

16. The adjustable sunshade/shield of claim 1, wherein a lounge chair, deck chair, beach chair or ground cloth is used and the adjustable sunshade/shield is adjustable in height by adjusting the gooseneck frame portion which comprises a rotator/lateral mechanism, the ground frame portion further comprises movable plates that provide support, and the ground frame portion further comprises attachment hardware that can be used to attach the structural frame to the lounge chair, deck chair, or beach chair for increased stability.

17. The adjustable sunshade/shield of claim 1, wherein the leg frame portion is attached to the gooseneck portion by said rotator/lateral mechanism that is adjustable by (i) moving a pin into one of multiple pin-holes in the leg frame portion to change the height of the leg frame portion, or (ii) using a hand crank cog and rail, mechanical friction type or a motorized height adjustor.

18. The adjustable sunshade/shield of claim 1, wherein when the adjustable sunshade/shield is used with the lounge chair, it further comprises at least one sunshade and shield that is contained in a slotted track that is attached to the rectangular shade/shield frame portion or a sleeve-type pouch in which the shade/shield frame is slid into, which in both configurations is secured by hook and loop fabric on each end.

19. The adjustable sunshade/shield of claim 1, wherein when the adjustable sunshade/shield is used with the in-pool chair, it further comprises a flat plate that sits at the bottom of the pool behind the in-pool chair in which the leg frame portion is attached to the back and or side portion of said chair, said leg frame portion also attaching to said in-pool chair and thereby providing additional stability and shade adjustments.

20. The adjustable sunshade/shield of claim 1, wherein when the adjustable sunshade/shield is used with the in-pool chair, said leg frame portion is attached to said in-pool chair and thereby providing support, stability and shade adjustments without the need of the leg frame portion touching the pool bottom.

21. The adjustable sunshade/shield of claim 1, wherein when the adjustable sunshade/shield is used with the pool chair, it further comprises a leg frame portion that is attached to the pool chair.

22. An adjustable sunshade/shield for use with furniture that holds a person, the sunshade/shield comprising:

a. a structural frame comprising:

i. a yoke frame portion that holds a horizontal/lateral adjustable rectangular shade/shield frame portion, ii. the horizontal/lateral adjustable rectangular shade/shield frame portion holds at least one sunshade and shield, each sunshade and shield comprising fabric, a panel style solar collector, or a solar collecting fabric, or a combination of such, the yoke frame portion and the horizontal/lateral adjustable rectangular shade/shield frame portion being at the topmost part of the adjustable sunshade/shield, iii. a gooseneck frame portion, the gooseneck frame portion being attached to the yoke frame portion and a leg frame portion, the gooseneck frame portion being adjustable to change the position of the yoke frame portion in order to provide shade and a shield from the sun to the person, iv. the leg frame portion being attached to the gooseneck frame portion and a bottommost portion, the bottommost portion comprising a ground frame portion, a ground/sand anchor portion, or a flat plate at the bottom, and v. the bottommost portion being at the bottommost part of the adjustable sunshade/shield and providing stability to the adjustable sunshade/shield, b. one or more solar collectors comprising one or more panels, films, or fabrics, each solar collector connected to a battery/solar distribution device, each solar collector attached to the structural frame or sunshade and shield;

c. one or more fans connected to the battery/solar distribution device and each fan attached to the structural frame;

d. water mister comprising water storage, pre-chiller, and a water pump, the water pump being connected to the battery/solar distribution device and/or a utility-supplied water source that comprises water and/or pre-chilled water, the water mister being attached to the structural frame, fans and/or flexible tubing and one or more mist emitting nozzles;

e. a removeable draping and drop down UV blocking screen and insect netting attached to the structural frame;

f. an audio/video communicator comprising multiple features, the multiple features comprising wireless networking, wireless technology to exchange data over short distances using short-wavelength UHF radio waves, video screen, UV sensors located under the sunshade and shield with external alert and audio alarm communicator and audio speaker connectivity, all of the audio communicator features being connected to the battery/solar distribution device and an audible alert timer that indicates to the user the length of time they have been under the adjustable sunshield/shade to assist in keeping track of the amount of exposure to the sun;

g. at least one USB plug connected to the battery/solar distribution device;

h. one or more lockable personal property and utility device storage units attached to the structural frame;

i. a shelf attached to the leg frame portion for holding items, the items comprising drinks, glasses, and keys, and which shelf may or may not be incorporated into the lockable personal property and utility devices storage; and j. adjustable LED lighting connected to the battery/solar distribution device and attached to the structural frame.

23. The adjustable sunshade/shield of claim 22, wherein the yoke frame portion is adjustable in height to change the sunshade and shield position with respect to the sun, the rectangular shade/shield frame portion is adjustable in height and/or in length, and the ground frame portion is adjustable in length and/or width.

24. The adjustable sunshade/shield of claim 22, wherein each fan attached to the structural frame has misting nozzles that propel the mist and/or handheld tubing comprising one or more mist emitting nozzles.

* * * * *